US005497984A

United States Patent [19]

Murakami et al.

[11] Patent Number: 5,497,984

[45] Date of Patent: Mar. 12, 1996

[54] SHEET POST-PROCESSING APPARATUS

[75] Inventors: Susumu Murakami, Ikoma; Naoya Okamura, Nara; Tomonori Ohata, Nara; Kazuya Hamaguchi, Nara; Koji Katamoto, Yamatokoriyama; Toshiya Mikita, Yao, all of Japan

[73] Assignee: Sharp Kabushiki Kaisha, Osaka, Japan

[21] Appl. No.: 275,684

[22] Filed: Jul. 15, 1994

[30] Foreign Application Priority Data

Jul. 16, 1993 [JP] Japan ..... 5-177106
Aug. 6, 1993 [JP] Japan ..... 5-196336

[51] Int. Cl.[6] ..... B42B 5/00; B65H 31/04; B65H 31/10

[52] U.S. Cl. ..... 270/53; 271/213; 271/217

[58] Field of Search ..... 270/53, 58; 271/213, 271/215, 217, 258, 176; 355/322, 324; 414/21

[56] References Cited

U.S. PATENT DOCUMENTS

| | | | |
|---|---|---|---|
| 5,137,265 | 8/1992 | Sato et al. | 270/53 |
| 5,320,336 | 6/1994 | Asami | 270/58 |
| 5,344,130 | 9/1994 | Suzuki et al. | 270/53 X |
| 5,350,169 | 9/1994 | Hiroi et al. | 271/213 |

FOREIGN PATENT DOCUMENTS

| | | | |
|---|---|---|---|
| 0346851A1 | 12/1989 | European Pat. Off. . | |
| 0371403A3 | 6/1990 | European Pat. Off. . | |
| 63-41350 | 2/1988 | Japan | 271/213 |
| 1-17754 | 1/1989 | Japan | 271/213 |
| 3-95065 | 4/1991 | Japan | 271/217 |
| 3-182458 | 8/1991 | Japan | 271/213 |
| 4-327462 | 11/1992 | Japan | 271/213 |
| 925871 | 5/1963 | United Kingdom | 271/213 |

*Primary Examiner*—John E. Ryznic

[57] ABSTRACT

A sheet post-processing apparatus is provided with a discharge tray which can be selectively moved between a processing mode position corresponding to a processing mode and a non-processing mode position corresponding to a non-processing mode. The apparatus is also provided with a control device which controls a tray drive unit which drives so as to set the discharge tray in the processing mode position when the processing mode is selected, while in the non-processing mode position when the non-processing mode is selected. The apparatus offers an improved discharging efficiency of processed sheets from a processing tray to the discharge tray in the processing mode and an improved aligning facility of sheets discharged on the discharge tray in the non-processing mode.

35 Claims, 35 Drawing Sheets

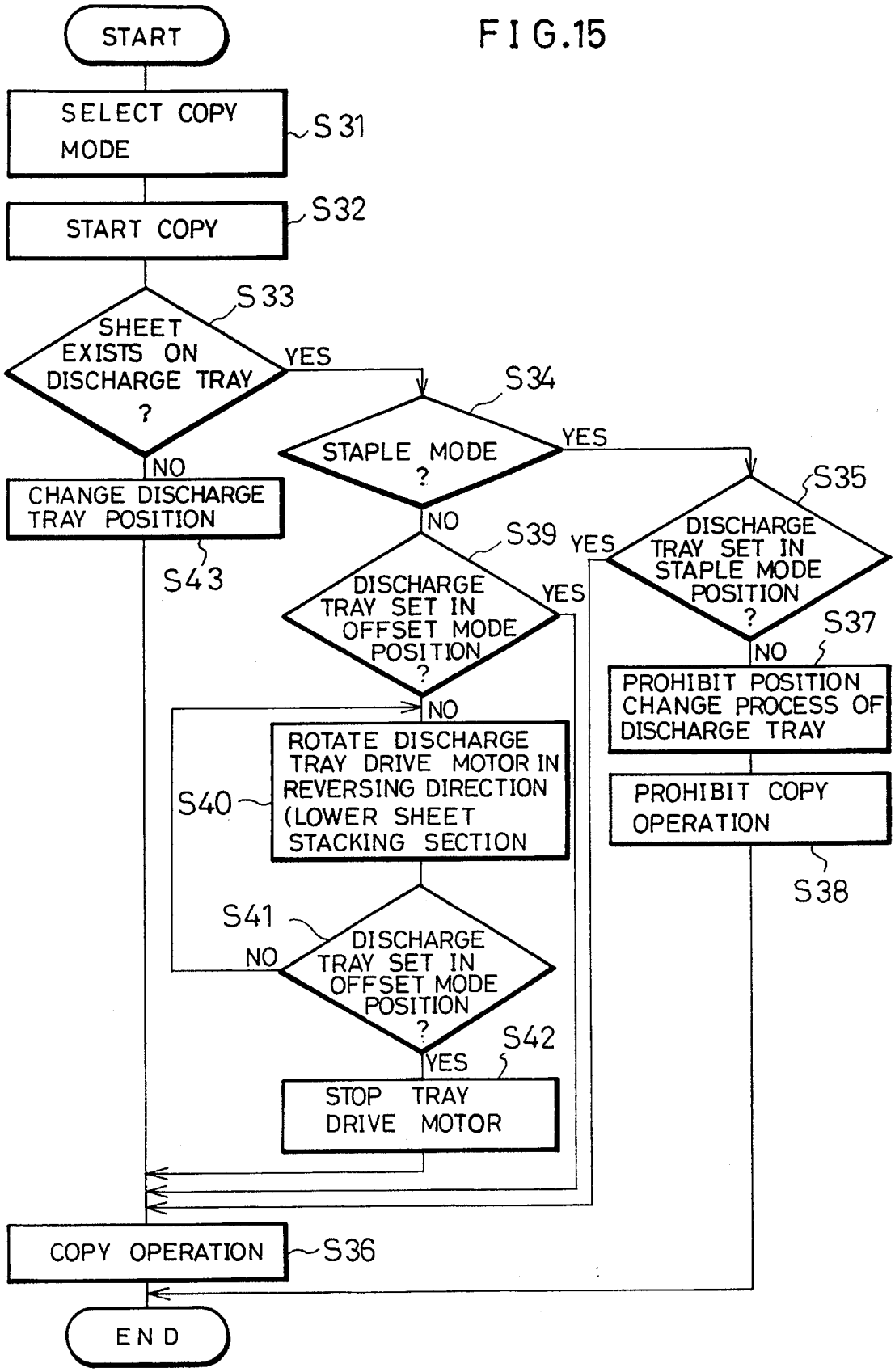
FIG.15
START
SELECT COPY MODE
S31
START COPY
S32
S33
SHEET EXISTS ON DISCHARGE TRAY ?
YES
NO
CHANGE DISCHARGE TRAY POSITION
S43
S34
STAPLE MODE ?
YES
NO
S35
DISCHARGE TRAY SET IN STAPLE MODE POSITION ?
YES
NO
S37
PROHIBIT POSITION CHANGE PROCESS OF DISCHARGE TRAY
PROHIBIT COPY OPERATION
S38
S39
DISCHARGE TRAY SET IN OFFSET MODE POSITION ?
YES
NO
ROTATE DISCHARGE TRAY DRIVE MOTOR IN REVERSING DIRECTION (LOWER SHEET STACKING SECTION
S40
S41
DISCHARGE TRAY SET IN OFFSET MODE POSITION ?
NO
YES
S42
STOP TRAY DRIVE MOTOR
COPY OPERATION
S36
END

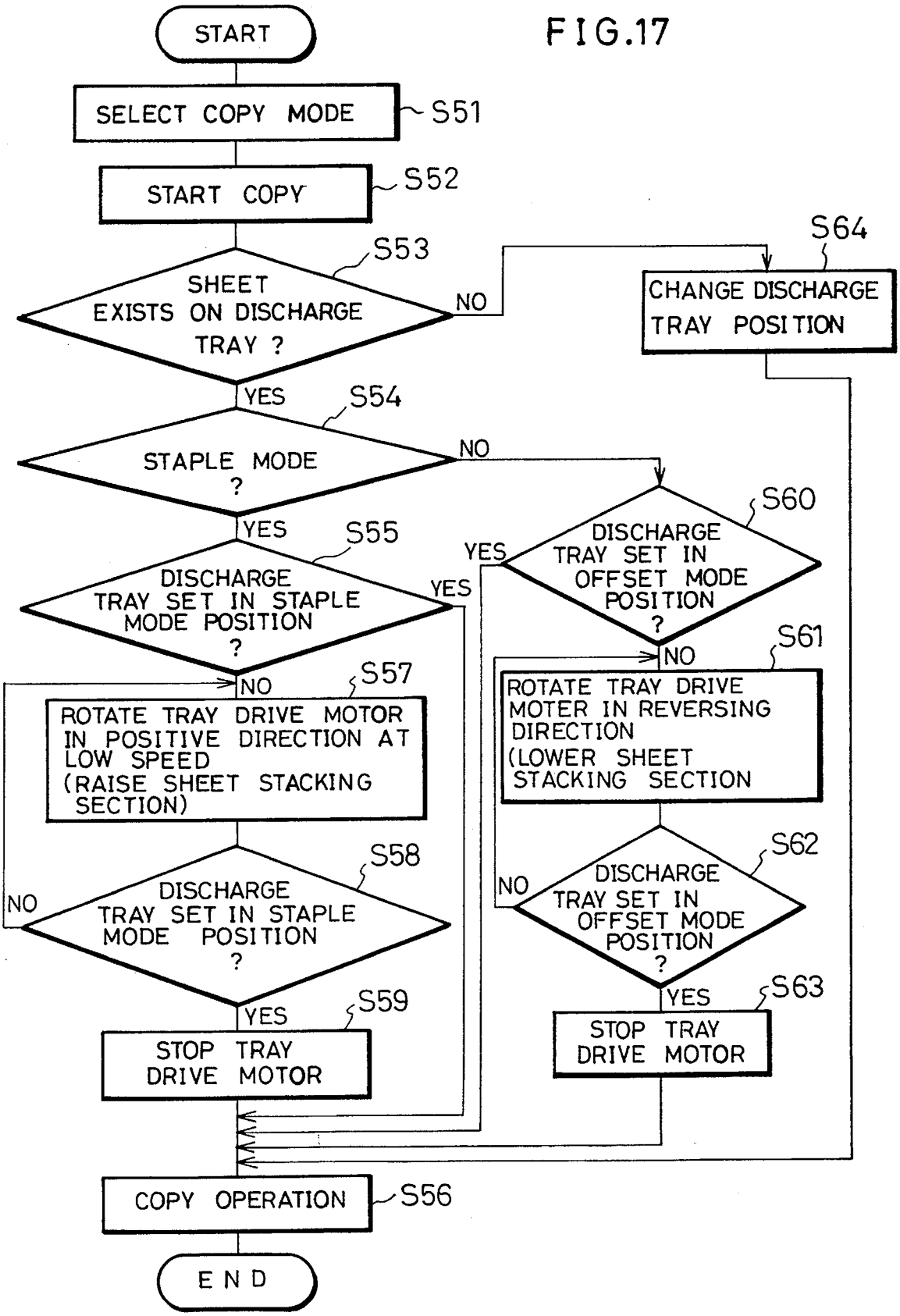
FIG.17
START
SELECT COPY MODE
S51
START COPY
S52
S53
SHEET EXISTS ON DISCHARGE TRAY ?
NO
S64
CHANGE DISCHARGE TRAY POSITION
YES
S54
STAPLE MODE ?
NO
YES
S55
DISCHARGE TRAY SET IN STAPLE MODE POSITION ?
YES
S60
DISCHARGE TRAY SET IN OFFSET MODE POSITION ?
YES
NO
S61
ROTATE TRAY DRIVE MOTER IN REVERSING DIRECTION (LOWER SHEET STACKING SECTION
NO
S57
ROTATE TRAY DRIVE MOTOR IN POSITIVE DIRECTION AT LOW SPEED (RAISE SHEET STACKING SECTION)
S58
DISCHARGE TRAY SET IN STAPLE MODE POSITION ?
NO
S62
DISCHARGE TRAY SET IN OFFSET MODE POSITION ?
NO
YES
S63
STOP TRAY DRIVE MOTOR
YES
S59
STOP TRAY DRIVE MOTOR
COPY OPERATION
S56
END

SHEET POST-PROCESSING APPARATUS

FIELD OF THE INVENTION

The present invention relates to a sheet post-processing apparatus, for use in combination with an image forming apparatus such as a copying machine, a laser printer, etc., more particularly relates to a sheet post-processing apparatus with a finishing function which enables sheets transported from the image forming apparatus to be processed, for example, by stapling.

BACKGROUND OF THE INVENTION

Recently, many copying machines are combined with automatic document feeders and sheet post-processing apparatuses for stapling or punching the copied sheets in order to automate the process. The automatic document feeder is placed on a document tray of the copying machine, for example, for transporting a plurality of documents one by one onto the document tray of the copying machine. The sheet post-processing apparatus is provided for carrying out a post-process of sheets, such as stapling, punching, etc., on every predetermined number of sheets with images on documents copied thereto fed from the copying machine.

An example of the conventional sheet post-processing apparatus is shown in FIG. 33. The apparatus is provided with separately provided three transport paths: a transport path 101 for transporting sheets from a copying machine main body (not shown), a non-processing discharge path 102 for transporting non-processed sheets transported through the transport path 101, and a processing discharge path 103 for discharging processed sheets fed through the transport path 101. At the respective discharge ends of the discharge paths 102 and 103, provided are a non-processed sheet discharge opening 102*a* and a processed set discharge opening 103*a*.

In the described apparatus, when for example an offset mode (non-processing mode) is selected by the copying machine main body, the sheets transported from the main body are fed into the transport path 101, and further transported into the non-processing discharge path 102 by transport rollers 113 via a deflector 105 which is rotated beforehand in a X direction shown by an arrow. Then, sheets are discharged through the non-processing sheet discharge opening 102*a* by discharge rollers 110 onto a discharge tray 106 which is inclined at a predetermined angle. The sheets discharged onto the discharge tray 106 are aligned by rotating a aligning roller 111 which pushes the sheets until the trailing edges thereof come in contact with an aligner plate 112.

On the other hand, when, for example, a staple mode (processing mode) is selected in the copying machine main body, the sheets transported from the main body are first fed into the transport path 101, and further transported into the processing discharge path 103 by the transport rollers 113 via the deflector 105 rotated beforehand in a Y direction shown by an arrow so as to place the sheets onto a processing tray 104. When a predetermined number of sheets are stacked on the processing tray 104, a stapling process is carried out. Then, the processed sheets are discharged onto the discharge tray 106 through the processed set discharge opening 103*a* by a pushing member 109.

The processing tray 104 is inclined in a direction where the processed set discharge opening 103*a* is provided on an upper end thereof and a stopper 108 is provided on a lower end thereof. Therefore, in the staple mode, the sheets fed into the processed sheet discharge path 103 from the transport path 101 are temporarily discharged onto the discharge tray 106 through the processed set discharge opening 103*a* from the leading edges thereof, and after the sheets are completely discharged, the sheets are dropped by the dead weight until the trailing edges thereof are stopped by the stopper 108 provided on the processing tray 104. In this state, the sheets are placed over the discharge tray 106 and the processing tray 104. Additionally, a paddler 107 is provided so as to support the sheets being dropped to the stopper 108 being rotated in a Z direction shown by an arrow.

In the described sheet post-processing apparatus, in the staple mode, the sheets are placed over the discharge tray 106 and the processing tray 104, and in order to accurately process the sheets, it is required to surely drop the sheets to the stopper 108. Moreover, when discharging a complete set from the processing tray 104 onto the discharge tray 106, the complete set become heavy as being composed of a plurality of sheets, thereby presenting the problem that a discharge failure may occur by being buckled in the discharge process due to the dead weight. In order to counteract this, it is preferable that a sheet receiving face 106*a* of the discharge tray 106 is formed on a plane extended from the surface of the processing tray 104 at the same or almost same angle as shown in FIG. 33.

On the other hand, in the offset mode, as the sheets are discharged onto the discharge tray 106 one by one, the dead weight of the sheet to be discharged is light, and thus the discharge tray 106 must have a greater angle with respect to the horizontal direction than that in the staple mode in order to desirably align the sheets on the discharge tray 106.

As shown in FIG. 34(*a*), the described discharge tray 106 is arranged such that the sheet receiving face 106 on the side of the aligner plate 112 is inclined. In the offset mode, the trailing edges of the sheets S discharged onto the discharge tray 106 may not be aligned desirably to the aligner plate 112 by rotating the aligning roller 111 as a number of sheets S placed on the discharge tray 106 increases due to the rigidity of the sheets, thereby presenting the problem of lowering the aligning facility of the sheets S.

The discharge tray 116 may be arranged as shown in FIG. 34(*b*). In this discharge tray 116, since a horizontal section 116*b* is formed on the side of the aligning roller 111 of the sheet receiving face 116*a*, the trailing edges of the sheets S can be easily aligned by the aligner plate 112 irrespectively of the rigidity of the sheets S, thereby achieving an improved efficiency of stacking the sheets S onto the discharge tray 106.

However, in this arrangement of the discharge tray 116, when the staple mode is selected, the leading edges of the sheets remain dangling to the horizontal section 116*b*, and thus it is difficult to precisely drop the sheets to the stopper 108 provided on the stapler plate 104.

Moreover, in both of the discharge trays 106 and 116, as a number of complete sets S increases, the stapled section H of the compete set S becomes more bulky than the non-processed section of the complete set S as shown in FIG. 35. Thus, this raised stapled section H of the complete sheets S may be stuck by contacting the aligning rollers 111 or a shaft 111*a* or by being creased. Therefore, in the staple mode, a number of sets to be discharged at one time is restricted, thereby presenting the problem of low operation efficiency of the sheet post-processing apparatus.

SUMMARY OF THE INVENTION

An object of the present invention is to provide a sheet post-processing apparatus wherein a discharge tray position can be altered between a non-processing mode position and a processing mode position so that in the non-processing mode, an alignment of trailing edges of sheets on the discharge tray can be surely carried out and in the processing mode, sheets can be surely dropped to a stopper and then discharged on the discharge tray from the processing tray, thereby achieving an improved operation efficiency in post-processing the sheets.

In order to achieve the above object, a sheet post-processing apparatus of the present invention is characterized by including: a processing tray for stacking thereon sheets to be post-processed; post-processing means for carrying out a predetermined post-process on sheets stacked on the processing tray; a discharge tray capable of selectively moving between a first discharge position at which processed sheets can be smoothly discharged and a second discharge position at which discharged non-processed sheets can be smoothly aligned; control means for controlling the discharge tray so as to be set in the first discharge position in a processing mode, while in the second discharge position in a non-processing mode; and discharge means for discharging the processed sheets onto the discharge tray in the first discharge position in the processing mode, while discharging the non-processed sheets onto the discharge tray in the second discharge position in the non-processing mode.

According to the above arrangement, in the processing mode, the control means controls the discharge tray to be set in the first discharge position. Then, the sheets which have been post-processed by post-processing means are smoothly discharged onto the discharge tray by the discharge means. On the other hand, in the non-processing mode, the control means controls the discharge tray so as to be set in the second discharge position. Then, non-processed sheets are discharged by the discharge means onto the discharge tray with a desirable alignment. Therefore, in the processing mode, the processed sheets can be desirably discharged from the processing tray to the discharge tray, while in the non-processing mode, non-processed sheets discharged on the discharge tray can be desirably aligned.

For a fuller understanding of the nature and advantages of the invention, reference should be made to the ensuing detailed description taken in conjunction with the accompanying drawings.

BRIEF DESCRIPTION OF THE DRAWINGS

FIG. 1 through FIG. 32 show one embodiment of the present invention.

FIG. 1 is a view showing a schematic configuration of a sheet-post processing apparatus of one embodiment of the present invention, wherein a discharge tray is set in an offset mode.

FIG. 2 is a view showing a schematic configuration of the sheet post-processing apparatus of FIG. 1, wherein the discharge tray is set in a staple mode.

FIG. 3 is a view showing an entire configuration of a copying machine provided with the sheet post-processing apparatus of the present invention.

FIG. 4 is a view schematically showing an entire configuration of the sheet post-processing apparatus of FIG. 1.

FIG. 5 is a perspective view of the discharge tray shown in FIG. 1.

FIG. 6 is a divisional perspective view of the discharge tray shown in FIG. 5.

FIG. 7 is a perspective view showing a discharging process of sheets onto the discharge tray of FIG. 5 in an offset mode.

FIG. 8(*a*) is a perspective view showing a discharging process of sheets onto the discharge tray of FIG. 5 in a staple mode.

FIG. 8(*b*) is an explanatory view showing a bulkiness of stapled sheets.

FIG. 9 is a front view of a tray drive unit for driving the discharge tray of FIG. 5.

FIG. 10 is a plan view of the tray drive unit of FIG. 9.

FIG. 11 is an explanatory view showing the arrangement for detecting the discharge tray shown in FIG. 5 in the staple mode and in the offset mode.

FIG. 12 is a block diagram of the control device provided in the sheet post-processing apparatus of FIG. 1.

FIG. 13 is a flowchart showing operations of the sheet post-processing apparatus of FIG. 1.

FIG. 14 is a flowchart showing operations of a sheet post-processing apparatus of another embodiment of the present invention.

FIG. 15 is a flowchart showing operations of a sheet post-processing apparatus of still another embodiment of the present invention.

FIG. 16 is a flowchart showing operations of a sheet post-processing apparatus of still another embodiment of the present invention.

FIG. 17 is a flowchart showing operations of a sheet post-processing apparatus of still another embodiment of the present invention.

FIG. 18 is a view showing a schematic configuration of a sheet post-processing apparatus of still another embodiment of the present invention.

FIG. 19 is a block diagram of a control device provided in the sheet post-processing apparatus of FIG. 18.

FIG. 20 is a flowchart showing operations of the sheet post-processing apparatus of FIG. 18.

FIG. 21 is a flowchart showing operations of the sheet post-processing apparatus of still another embodiment of the present invention.

FIG. 22 is a view showing a schematic configuration of the sheet post-processing apparatus of still another embodiment of the present invention.

FIG. 23 is a perspective view of a discharge tray provided in the sheet post-processing apparatus of FIG. 22.

FIG. 24 is a view showing a schematic configuration of the discharge tray shown in FIG. 23.

FIG. 25 is a plane view showing the state where a complete set is placed on a sheet receiving face of the discharge tray shown in FIG. 23

FIG. 26 is a block diagram of a control device provided in the sheet post-processing apparatus of FIG. 22.

FIG. 27 is a view showing a schematic configuration of the sheet post-processing apparatus of still another embodiment of the present invention.

FIG. 28 is a perspective view of a discharge tray provided in the sheet post-processing apparatus of FIG. 27.

FIG. 29 is a view showing a schematic configuration of the discharge tray of the sheet post-processing apparatus of FIG. 27.

FIG. 30 is an explanatory view showing a detecting state of an upper limit of a complete set placed on the discharge tray of FIG. 28.

FIG. 31 is a side view showing a state where a complete set is placed on the discharge tray of FIG. 28.

FIG. 32 is a block diagram of a control device provided in the sheet post-processing apparatus of FIG. 27.

FIG. 33 is a view showing a schematic configuration of a conventional sheet post-processing apparatus.

FIG. 34(*a*) and FIG. 34(*b*) are explanatory views respectively showing the processes for aligning the trailing edges of sheets stacked on the discharge tray with different shapes, wherein FIG. 34(*a*) is an explanatory view showing the state of aligning the trailing edges of sheets stacked on a discharge tray which is inclined substantially at the same angle as a stapler plate, and FIG. 34(*b*) is an explanatory view showing the processes for aligning the trailing edges of sheets stacked on a discharge tray including a horizontal section formed on a rear end portion of a sheet receiving face.

FIG. 35 is an explanatory view showing a contact state of a complete set to an aligning roller in the sheet post-processing apparatus of FIG. 33.

DESCRIPTION OF THE EMBODIMENT

[EMBODIMENT 1]

The following description will discuss one embodiment of the present invention in reference to FIG. 1 through FIG. 13. The present embodiment is given through the case where a sheet post-processing apparatus is provided in a copying machine. In the copying machine, an offset mode can be set as a non-processing mode, and a staple single mode and a staple multiple mode can be set as processing modes.

In the offset mode, the sheets transported from a copying machine main body are discharged one by one onto a discharge tray without being further processed. In the single staple mode, the sheets transported from the main body are stapled, and then a bound set of sheets (hereinafter referred to as a complete set) is discharged onto the discharge tray, and after carrying out the described sequential process once, the operation is terminated; while in the multiple staple mode, the described sequential process is repeated a plurality of times.

Figure 3:
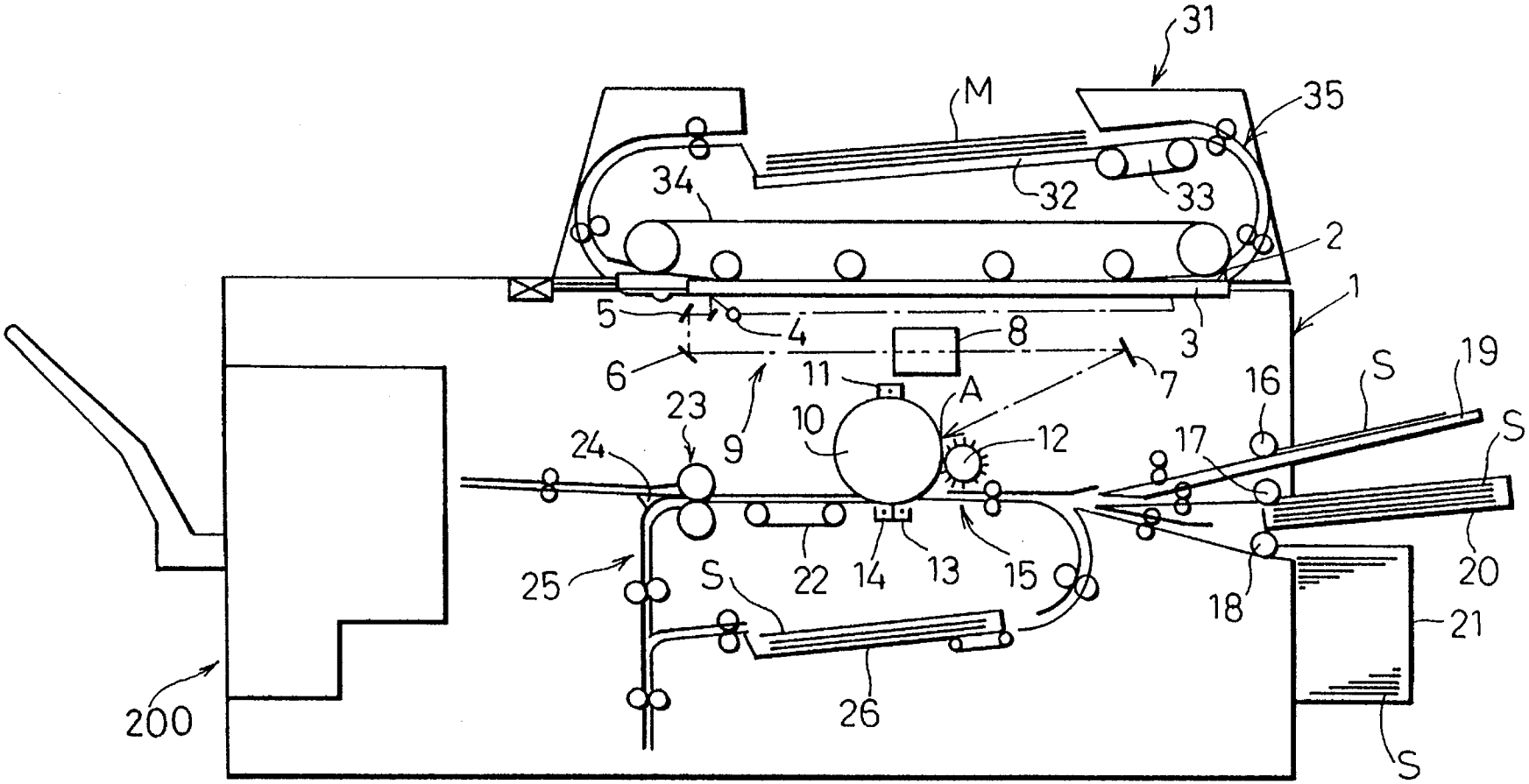

As shown in FIG. 3, a sheet post-processing apparatus 200 of the present embodiment is provided in a copying machine main body 1 as a main device. On the copying machine main body 1, provided is a RDH 31 (Recirculating Document Handler), which is a kind of automatic document feeder, for transporting a document M to a document glass platen 3.

The document glass platen 3 is placed on the upper side of the copying machine main body 1. Further, an optical system 9 and a photoreceptor drum 10 are placed under the document glass platen 3. The optical system 9 includes a light source lamp 4, mirrors 5, 6 and 7, and a lens 8. The optical system 9 is provided for scanning the document M using a light emitted from the light source 4, the document M being transported onto the document glass platen 3 by the RDH 31. Further, the reflected light from the document M is projected onto an exposure point A on the surface of the photoreceptor drum 10 through the mirrors 5, 6 and 7, and the lens 8. As a result, a static latent image corresponding to the image on the document M is formed on the surface of the photoreceptor drum 10 which is uniformly charged by a main charger 11.

The main charger unit 11, a developer unit 12, a transfer charger 13 and a separation charger 14 are provided along the circumference of the photoreceptor drum 10. The developer unit 12 develops the electrostatic latent image formed on the surface of the photoreceptor drum 10 to be a toner image. Then, the transfer charger 13 transfers the toner image onto the sheet S. Then, the separation charger 14 separates the sheet S from the photoreceptor drum 10.

A sheet transport path 15 is provided under the photoreceptor drum 10, for transporting the sheets S to the photoreceptor drum 10. Further, a feed board 19, a feed cassette 20 and a feed deck 21 for feeding the sheets S are placed respectively at the upstream of the sheet transport path 15. At the downstream of the sheet transport path 15, provided are a transport belt 22 and a fuser 23. The transfer belt 22 is provided for transporting the sheets S whereon the toner image has been transferred, and the fuser 23 is provided for making the toner image on the sheet S permanently affixed thereto.

At the downstream of the fuser 23, provided is a deflector 24 by which the feeding path for the sheets S is switched between a path connected to the sheet post-processing apparatus 200 and a re-transport path 25. The re-transport path 25 serves as a recirculation path through which the sheets S, whereon the toner image has been transferred from the photoreceptor drum 10, are transported again to the photoreceptor drum 10. Further, an intermediate tray 26 is provided along the path, which allows copying on both sides of the sheet S.

The RDH 31 includes a document tray 32 (located on top), a feed belt 33 (placed at one end of the document tray 32), and a feed belt 34 (placed on the document glass platen 34) which are all connected by a document platen feed path 35 serving as a recirculation path. The RDH 31 feeds the document M placed on the document tray 32 onto the document glass platen 3 by the feed belt 33. Further, the RDH 31 sets the document M to a predetermined position on the document glass platen 3 by the transport belt 34, and sends back the document M onto the document tray 32 after the document M has been scanned by the optical system 9.

Figure 4:
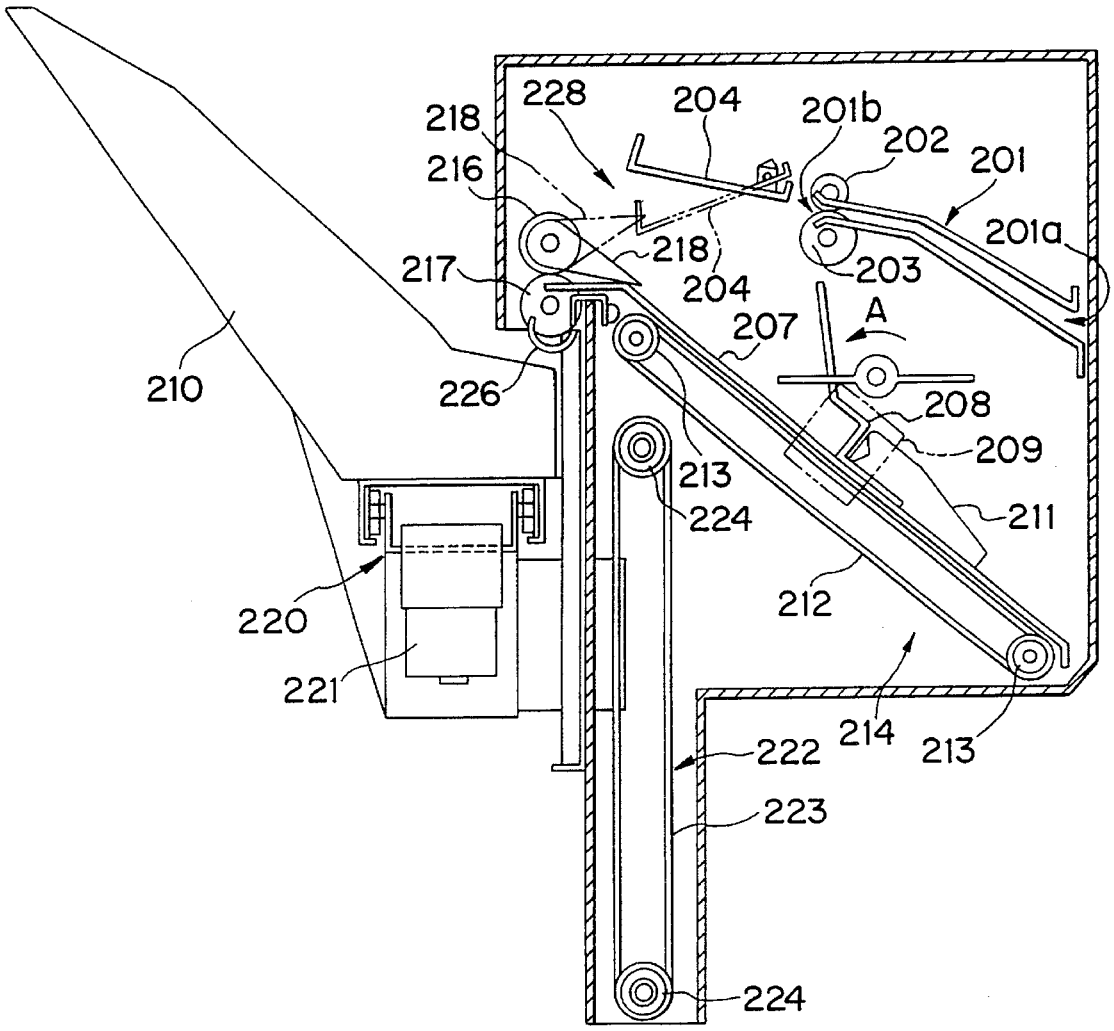

As shown in FIG. 4, the sheet post-processing apparatus 200 is provided with a post-processing transport path 201 for transporting the sheets S fed from the copying machine main body 1. The post-processing transport path 201 has an entry opening 201*a* formed on one end thereof on the side of the copying machine main body 1. On the other end of the post-processing transport path 201, provided is a discharge opening 201*b*. Furthermore, a pair of transport rollers 202 and 203 is formed at the end of the post-processing transport path 201 on the side where the discharge opening 201*b* is formed.

At the downstream with respect to the sheet transport direction of the post-processing transport path 201, provided is a movable sheet guide 204 for guiding the sheets transported by the transport rollers 202 and 203. The movable sheet guide 204 is rotated by a guide displacement motor 205 (to be described later) about a fulcrum located to the side of the post-processing transport path 201 so as to be selectively moved between a staple mode position shown by a solid line and an offset mode position shown by a two-dot long and two short dashes line in FIG. 4. Further, a guide position sensor 206 (to be described later) is provided for detecting whether the movable sheet guide 4 is set in the staple mode position or in the offset mode position.

Below the discharge opening 201*b* of the post-processing transport path 201, provided is a stapler plate 207 (processing tray) which is inclined so that the upper end thereof corresponds to the discharge opening 201*b*, and the lower end thereof corresponds to the entry opening 201*a*. The stapler plate 207 is provided with a stopper 208, stapler 209 and a pusher 211. The stopper 208 is provided for controlling the trailing edges of the sheets S stacked on the stapler plate 207. The stapler 209 is provided for stapling the sheets S stacked on the stapler plate 207. The pusher 211 is provided for pushing the sheets S from the stapler tray 207 onto a discharge tray 210.

The stapler 209 is driven by a stapler motor 229 (to be described later). Therefore, the stapler 209 and the stapler motor 229 constitute post-processing means. The pusher 211 is provided on a belt 212 provided below the stapler plate 207. The belt 212 is supported by belt support rollers 213. Either one of the belt support rollers 213 is driven by a motor (not shown) so as to move the belt 212, thereby moving the pusher 211 both in a pushing direction of the sheets S and an opposite direction of the sheets S. Therefore, the pusher 211, belt 212, belt support rollers 213 and the motor (not shown) constitute a push-out unit 214 (discharge means).

Above the stapler plate 207, provided is a rotary blade 215 made of, for example, a rubber which serves as sheet transportation auxiliary means. The rotary blade 215 is driven by a motor (not shown) in a direction A, and the sheets discharged onto the stapler plate 207 through the post-processing transport path 201 are moved to a position at which the trailing edges thereof come in contact with the stopper 208.

In a vicinity of the upper end of the stapler plate 207, i.e., the end on the side of the discharge tray 210, provided is a pair of upper and lower discharge rollers 216 and 217. The upper and lower discharge rollers 216 and 217 are driven by a motor (not shown). Therefore, the upper and lower discharge rollers 216 and 217 and the motor constitute another discharge means. A sheet discharge section (second discharge section) is formed between the upper and lower discharge rollers 216 and 217.

In a vicinity of the output of the stapler plate 207, i.e., the end on the side of the discharge tray 210, provided is a gate 218 which rotates about a shaft of the upper discharge roller 216. The gate 218 is driven by a gate switching motor 219 (to be described later), and is selectively moved between the staple mode position shown by a solid line and an offset mode position shown by a two-dot long and two short dashes line. The gate 218 in the staple mode position and the offset mode position is detected by a gate position sensor 230 (to be described later).

Below the upper and lower discharge rollers 216 and 217, provided in a discharge direction is a discharge tray 210. The discharge tray 210 is provided so that the upper surface thereof is inclined in the same direction as the stapler plate 207. The discharge tray 210 is driven by a shift mechanism 220 provided with a tray shift motor 221 in a direction orthogonal to the discharge direction and is raised and lowered by an elevator mechanism 222. The elevator mechanism 222 includes a belt 223, a pair of upper and lower belt support rollers 224 and a tray elevator motor 225 (to be described later) which drives either one of the belt support rollers 224. The belt 223 is connected to the discharge tray 210 via the shift mechanism 220, and the discharge tray 210 is raised and lowered with the movement of the belt 223. When the discharge tray 210 is raised to the upper limit position, it is detected by a tray upper limit sensor 226 (tray upper limit detection means) provided above the discharge tray 210.

Figure 5:
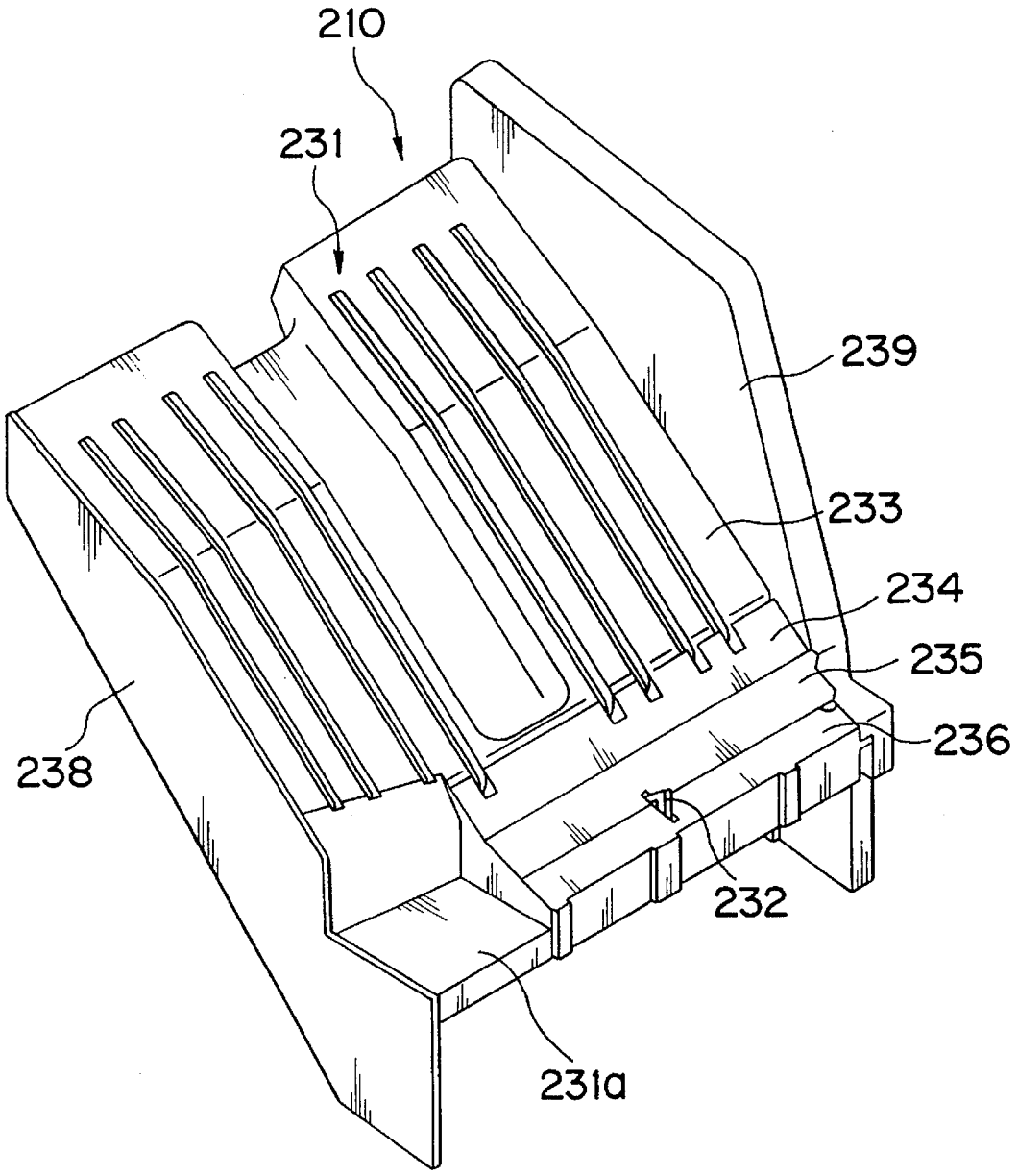
Figure 8A:
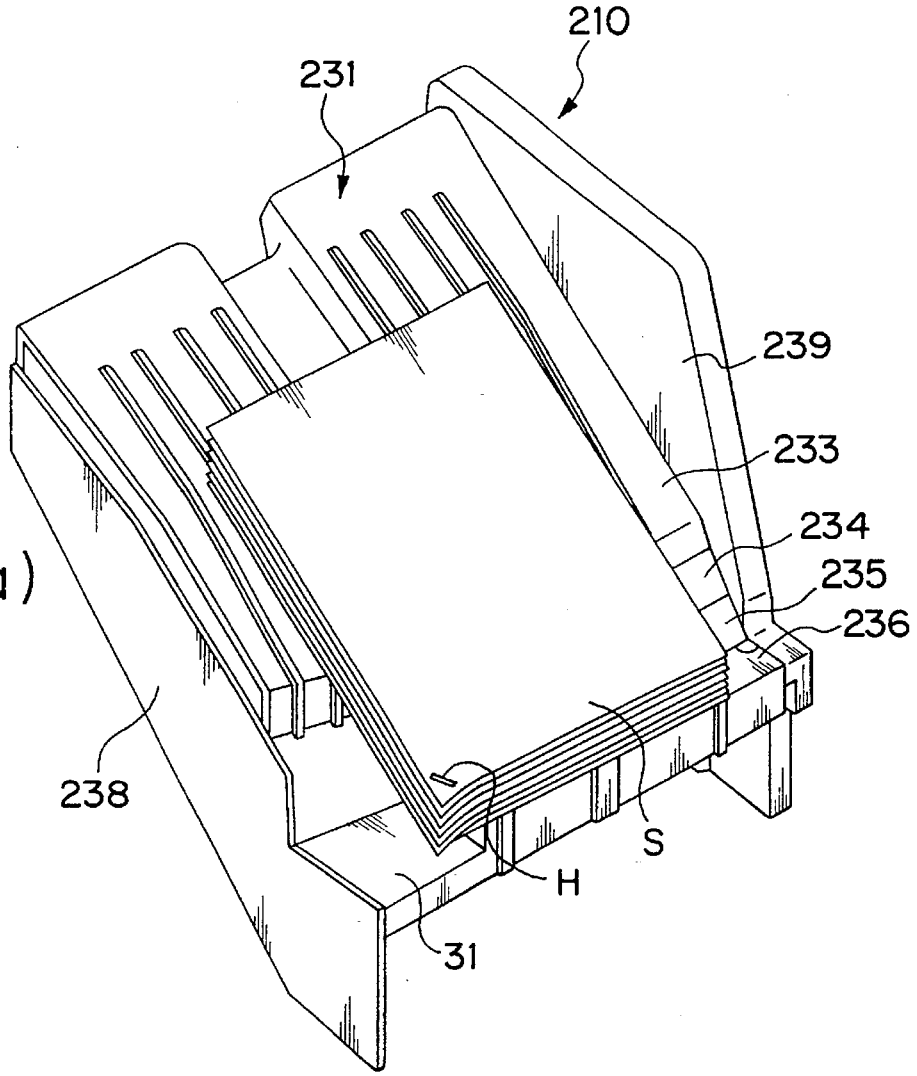
Figure 8B:
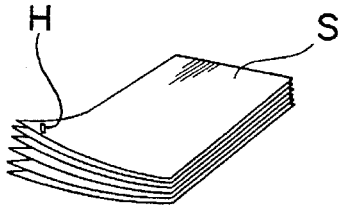

As shown in FIG. 5, the discharge tray 210 is provided with a sheet stacking section 231 for stacking thereon sheets S discharged from inside the apparatus. At a lower right or left corner of the sheet stacking section 231, which corresponds to a stapled corner, is formed a recessed portion 231*a*. Therefore, by ascending and descending movements of the discharge tray 210, the sheets S are stacked on the discharge tray 210 at a position shown in FIG. 7 in the offset mode, while in the staple mode, the sheets S are placed at a position at which the stapled section H is set at the recessed section 231*a* as shown in FIG. 8(*a*) in order to prevent the bulkiness of the stapled section H compared with the non-stapled section of the complete set S. At the lower end of the sheet stacking section, provided is a discharge tray sheet sensor 232 (see FIG. 5) which serves as sheet detection means for detecting discharged sheets S.

Figure 6:
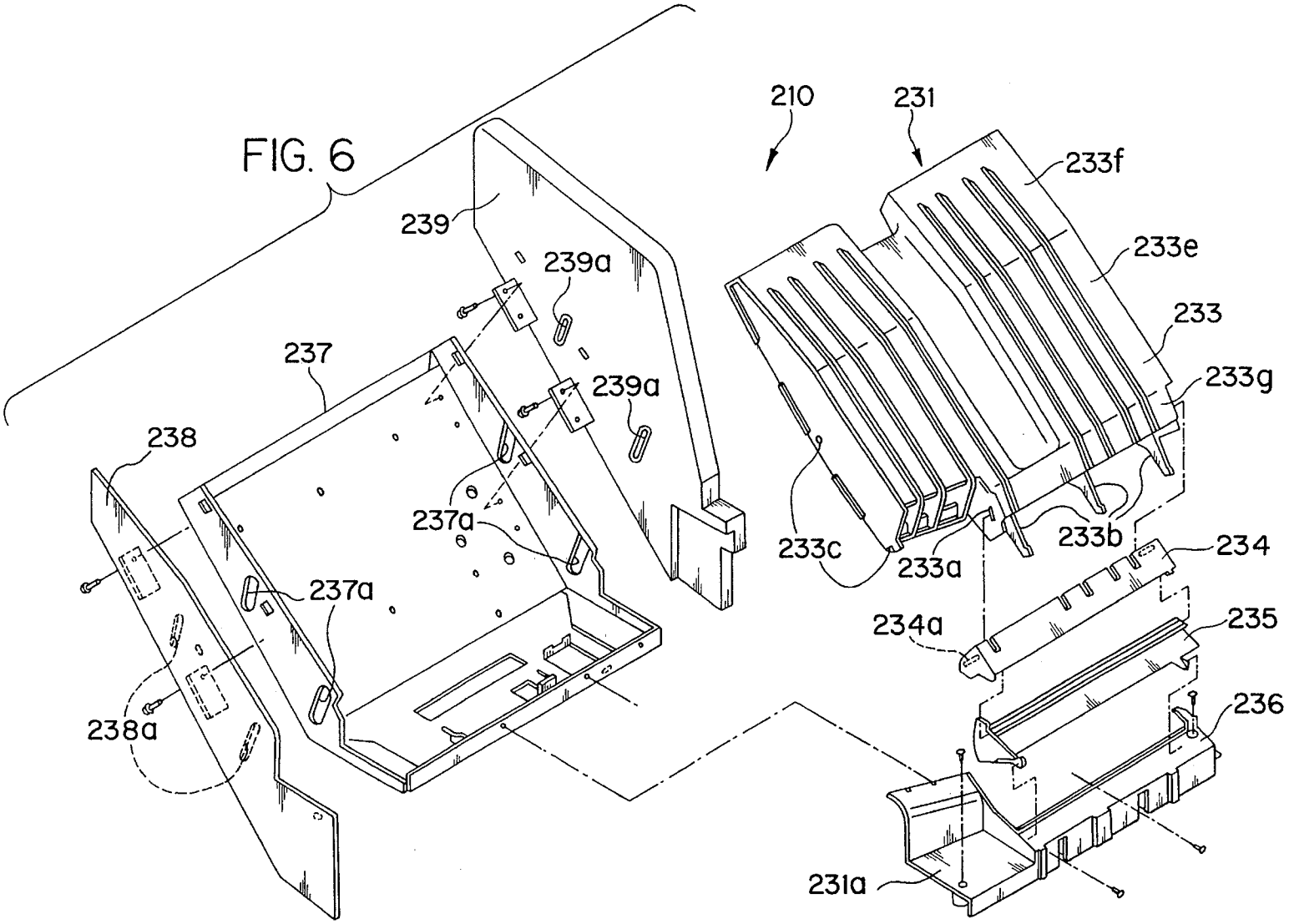
Figure 7:
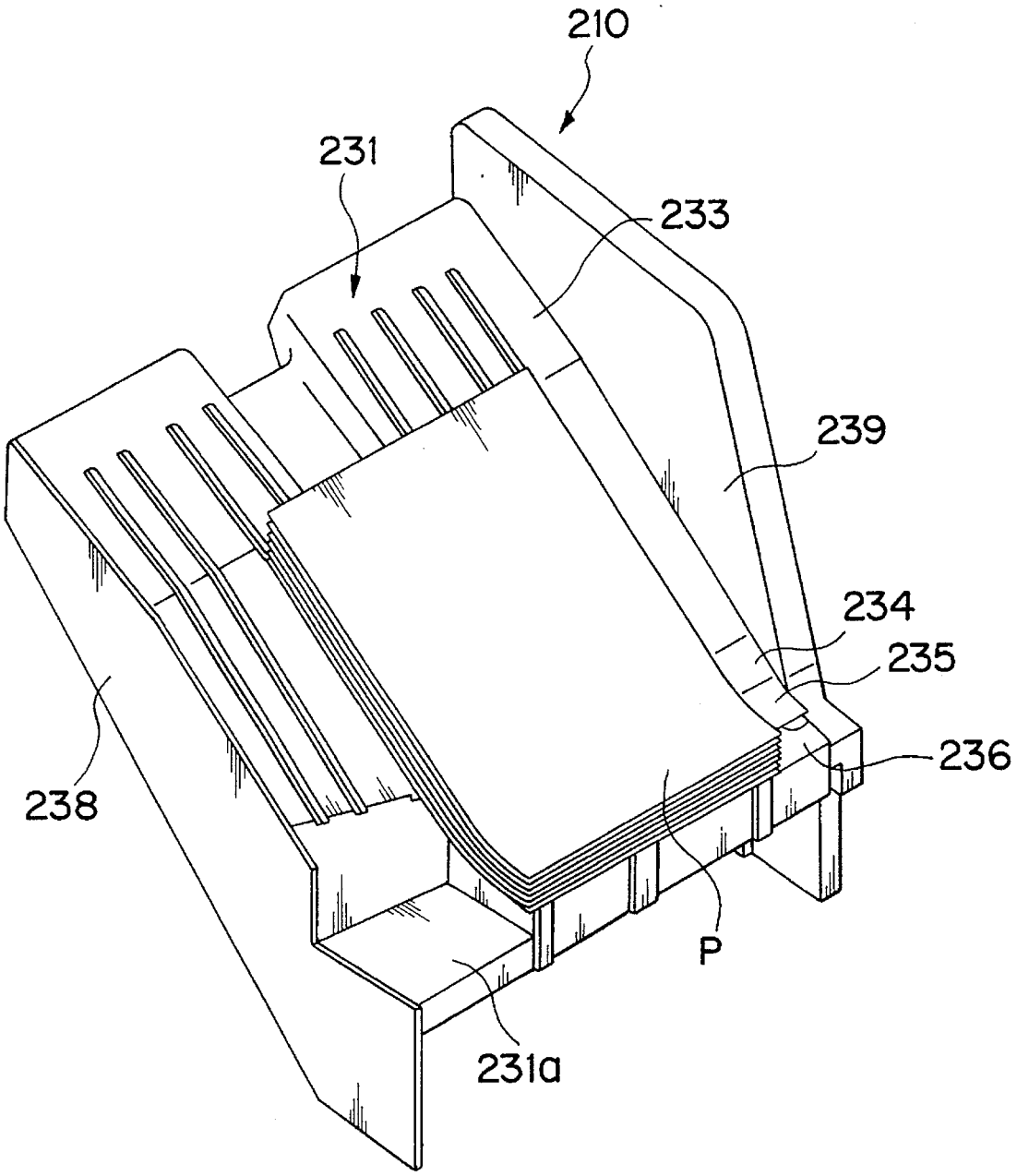

As shown in FIG. 6, the sheet stacking section 231 is divided into a movable main section 233 which is an essential part of the sheet stacking section 231, a fixed lower end section 236 which forms a lower portion of the sheet stacking section 231, a movable upper connecting section 234 and a movable lower connecting section 235 which are provided between the movable main section 233 and the fixed upper end section 236. The movable main section 233, the movable upper connecting section 234, the movable lower connecting section and the fixed lower end section 236 constitute the divisional section, and the movable main section 233, the movable upper connecting section 234 and the movable lower connecting section 235 constitute the movable divisional section.

Figure 1:
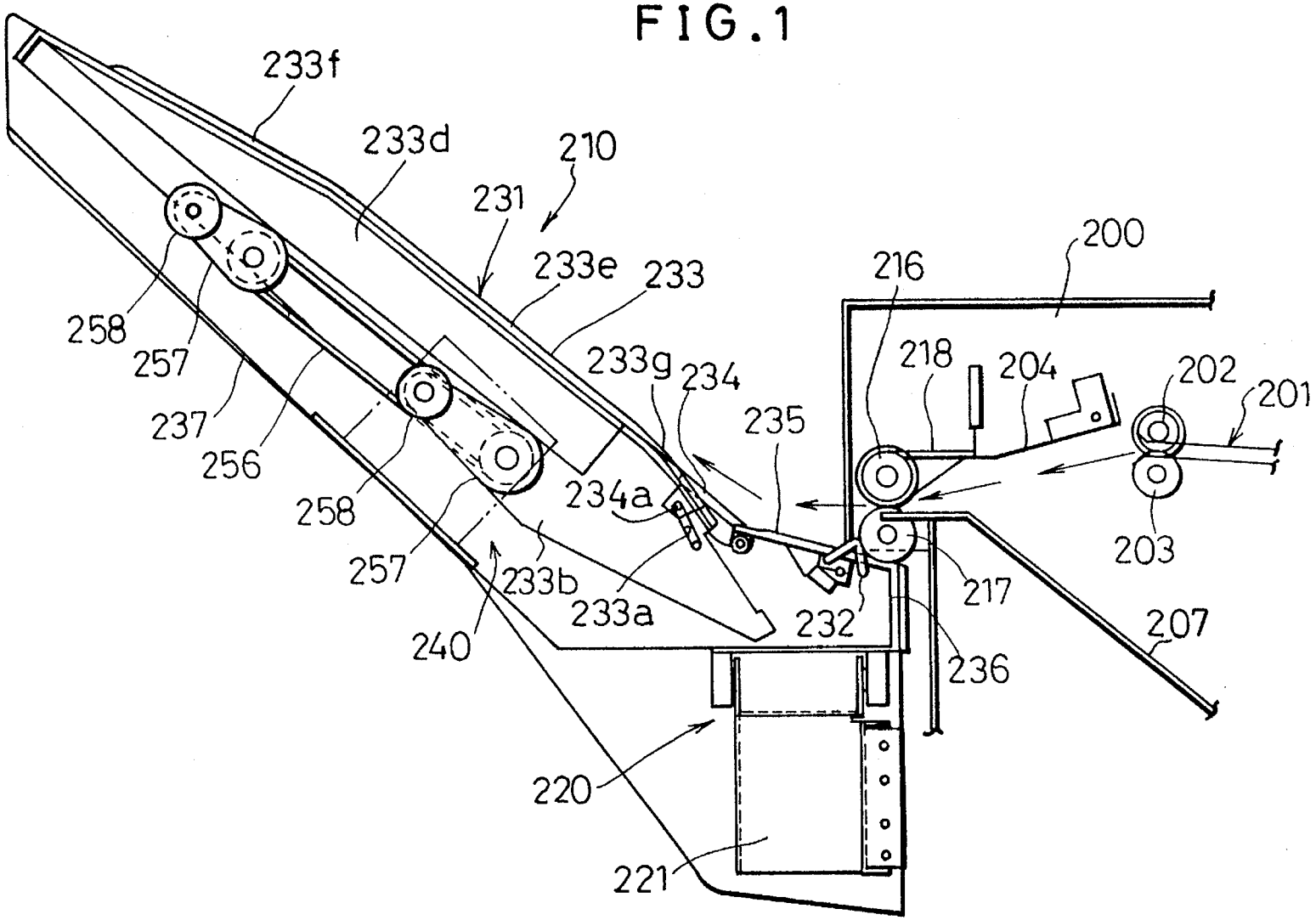
Figure 2:
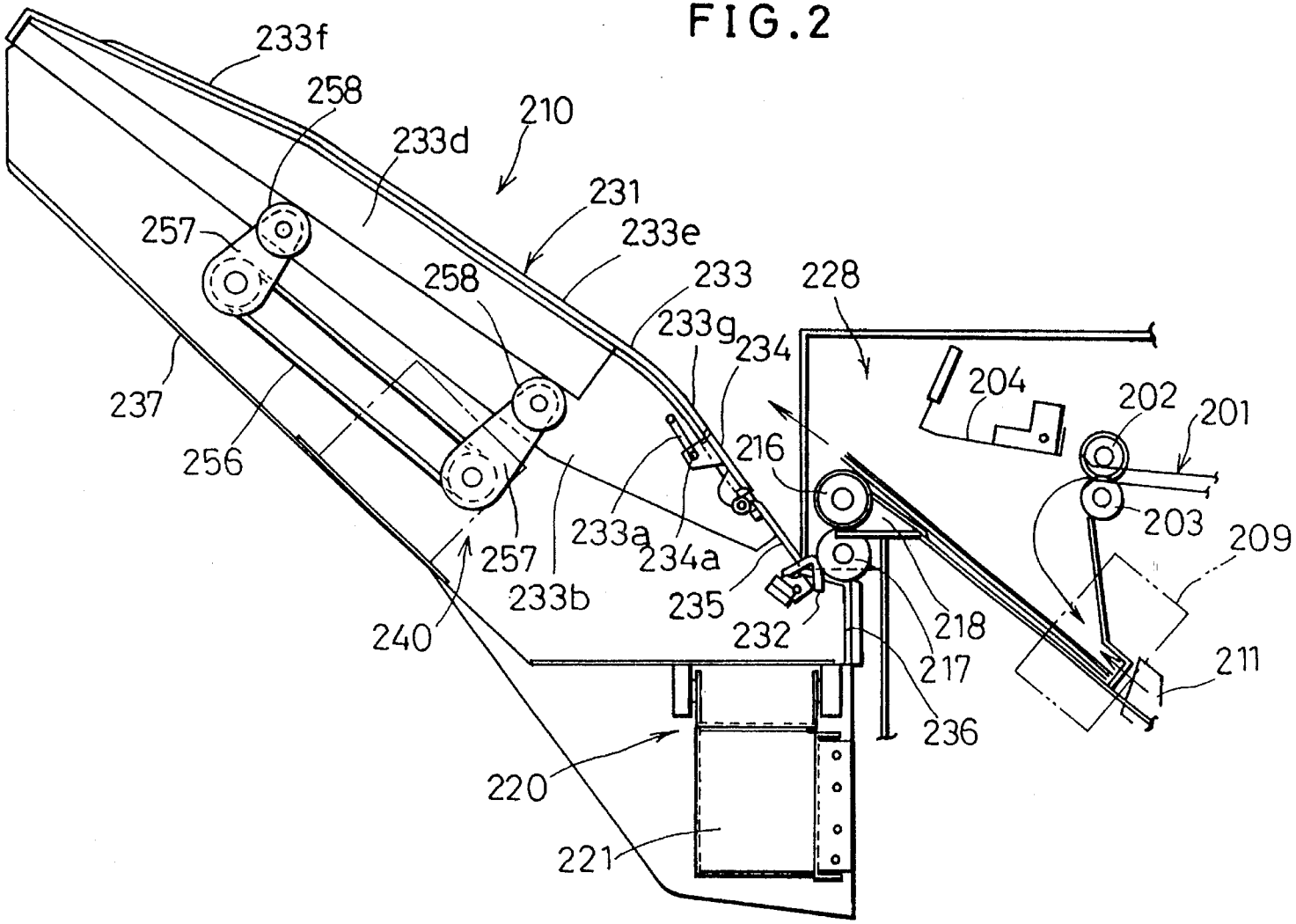

As also shown in FIG. 1 and FIG. 2, the lower end section 236 is fixed, the movable lower connecting section 235 is connected to the upper end of the fixed lower end section 236 so as to be freely rotatable, and the lower end of the movable upper connecting section 234 is connected to the upper end of the movable lower connecting section 235 so as to be freely rotatable.

The movable main section 233 includes a stacking main piece 233*e* located at the center, upper and lower bent pieces 233*f* and 233*g* which are bent downward with respect to the stacking main piece 233*e*. At the bottom end of the movable main section 233, two slots 223*a* are formed so as to be extended in an oblique upper and lower direction extending in an inclined direction of the movable main piece 233. The slots 233*a* are provided for inserting therein projected guide sections 234*a* of the movable upper connecting section 234 so as to be movable. With this arrangement, the movable main section 233 and the movable upper connecting section 234 are connected. At the back surface of the movable main section 233, formed are shape supporting sections 233*b*. As shown in FIG. 2, the shape support sections 233*b* support the movable upper connecting section 234 by the lower end thereof projected downward. Further, on both side faces of the movable main section 233, formed is a pair of projected guide sections 233*c*.

As shown in FIG. 6, the discharge tray 210 is provided with a back plate 237 provided at the back surface of the sheet stacking section 231, the front side plate 238 and the back side plate 239 provided on side faces of the sheet stacking section 231 and the back plate 237. The fixed lower end section 236 is fixed to the back side plates 238 and 239. On the inner faces of the front and back side plates 239, formed are recessed guide sections 238*a* and recessed guide sections 239*a* in a vertical direction, which correspond to the projected guide sections 233*c* of the movable main section 233. The projected guide sections 233*c* are inserted into the recessed guide sections 238*a* and 239*a* through an opening 237*a* of the back plate 237. With this arrangement, ascending and descending movements of the sheet stacking section 231 with respect to the front and back side plates 238 and 239 are guided.

The movable main section 233 is pushed downward by elastic means composed of, for example an extension spring (not shown). When the movable main section 233 is moved by being pushed by the elastic means, the projected guide section 233*c* reaches the bottom position of the recessed guide section 238*a*, while the projected guide section 234*a* of the movable upper connecting section 234 is moved to the top position of the slot 233*a* of the movable main section 233. At this position, as shown in FIG. 1, the movable main section 233, i.e, the sheet stacking section 231 is moved to the lower position, i.e., the offset mode position at which the angle of the movable main section 233 to the horizontal direction becomes greater.

Figure 9:
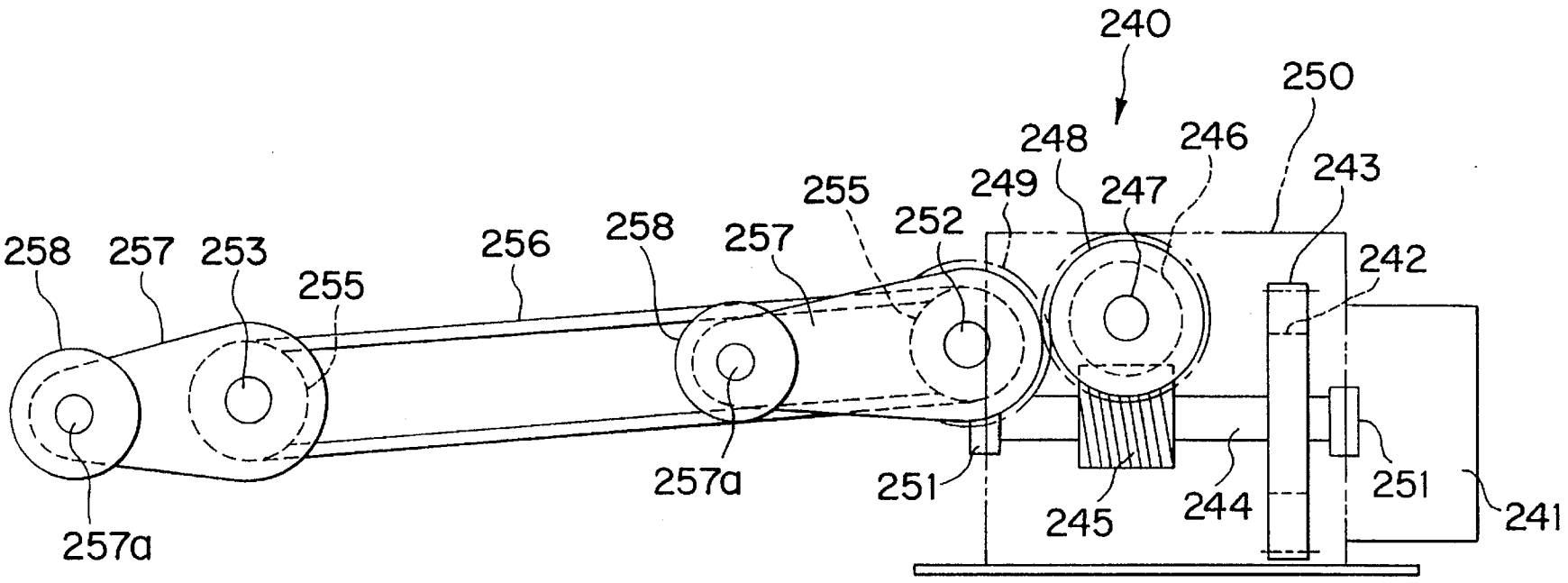
Figure 10:
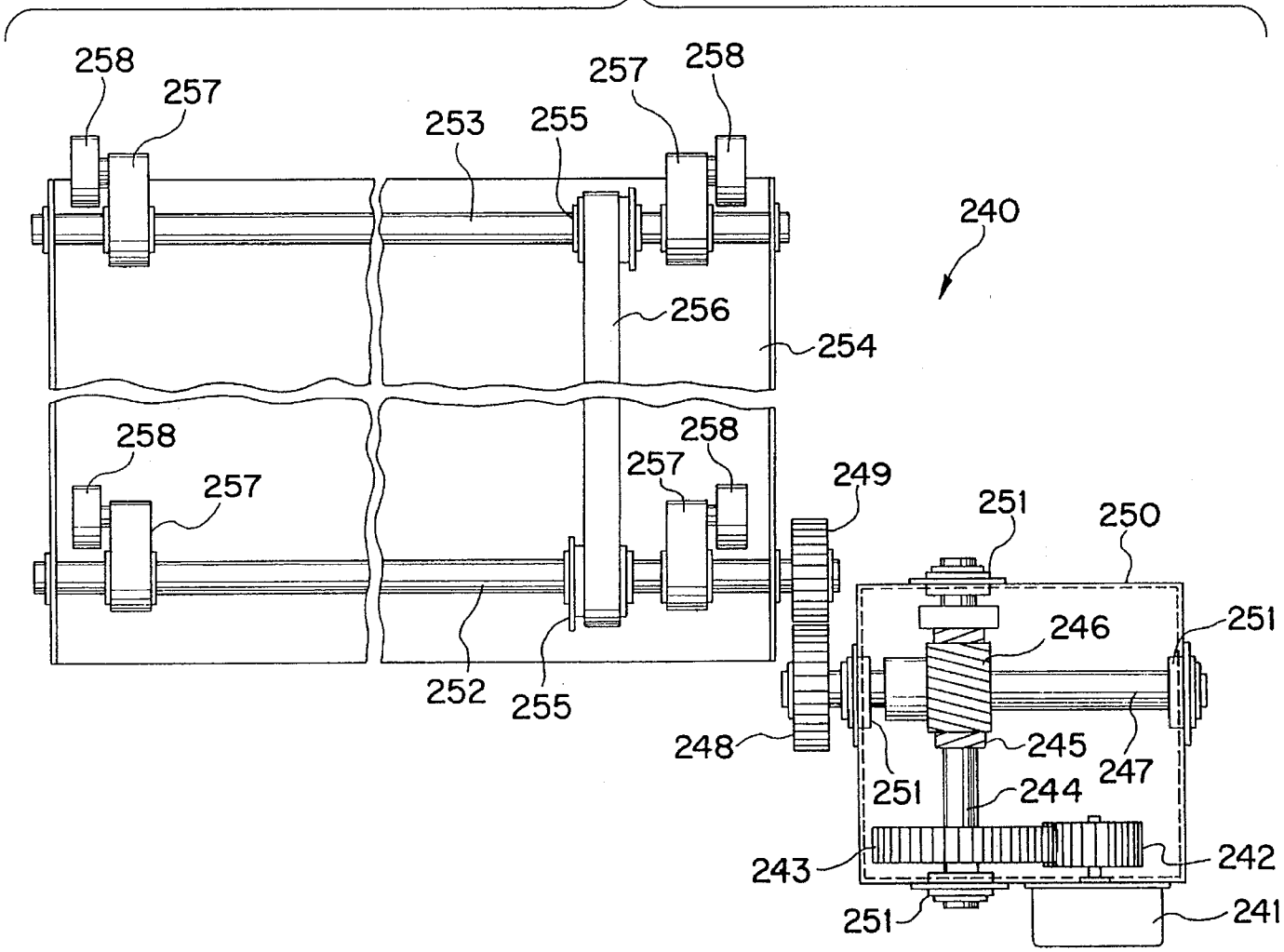

As shown in FIG. 1 and FIG. 2, a tray drive unit 240 (tray drive means) is provided between the sheet stacking section 231 and the back plate 237. As shown in FIG. 9 and FIG. 10, a driving force from a tray drive motor 241 is transmitted from a flat gear 242 provided on a rotation shaft of the motor 241 to a drive shaft 252 via a flat gear 243, a shaft 244, a worm wheel 245 and a helical gear 246, a shaft 247, a flat gear 248 and a flat gear 249. The flat gear 242, shaft 244, worm wheel 245, helical gear 246 and shaft 247 are all provided within a drive box 250. The shaft 244 and the shaft 247 are supported by the drive box 250 via a bearing 251.

The drive shaft 252 is provided in a widthwise direction of the discharge tray 210, the drive shaft 253 is provided parallel to the drive shaft 252. Both of the guide shafts 252 and 253 are supported by the shaft support member 254 so as to be freely rotatable and are respectively provided with pulleys 255. The guide shafts 252 and 253 are driven by a timing belt 256 provided so as to wind the pulleys 255. The drive shafts 252 and 253 are respectively provided with arms 257 (drive members) with different lengths in a vicinity of both ends. Further, a pressure roller 258 is provided so as to rotate the shaft 257*a* provided at the front end of each arm 257. Each arm 257 is selectively moved between a staple mode position substantially vertical to a plane including the drive shafts 252 and 253 and an offset mode position substantially parallel to the plane.

Figure 11:
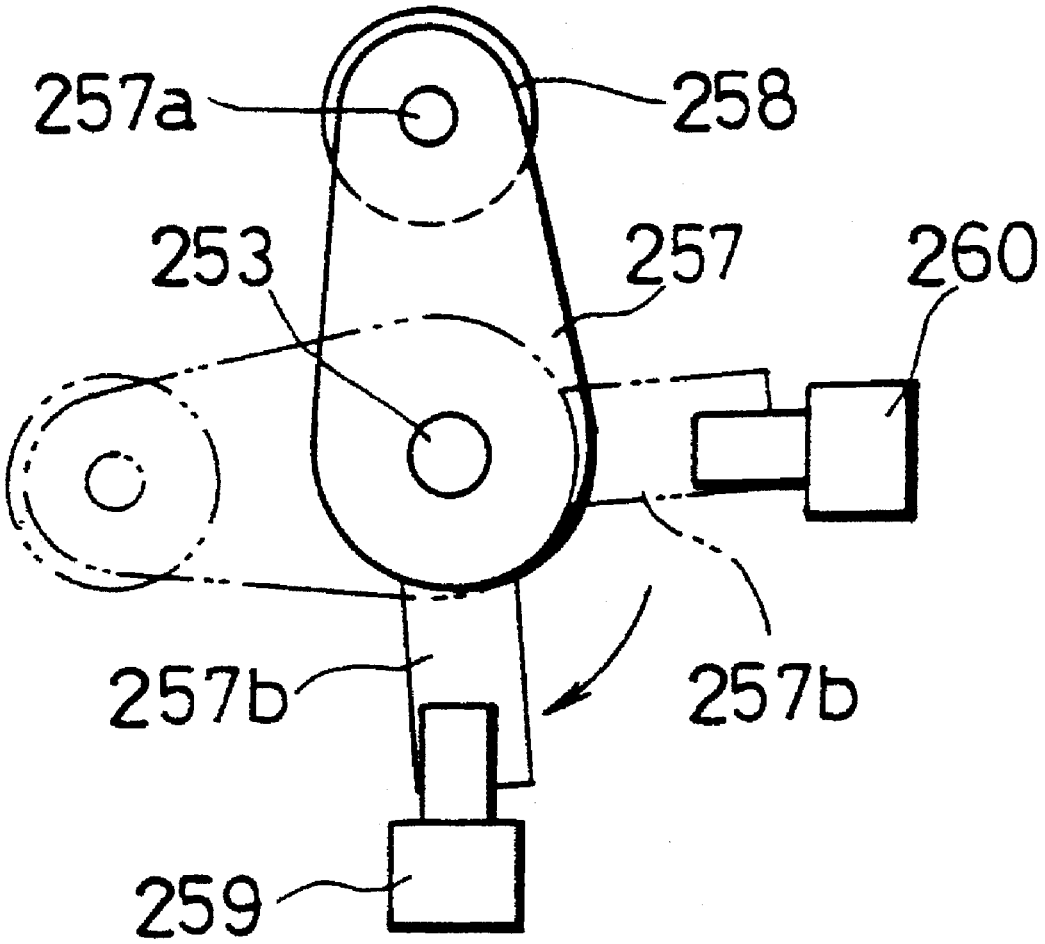

The respective arms 257 at the staple mode position and the offset mode position are detected by a tray staple mode position sensor 259 and a tray offset mode position sensor 260 (tray position detection means) by detecting a light-interrupting plate 257*b* provided on the arm 257 (see FIG. 11).

Here, by employing a stepping motor as the tray drive motor 241, the configuration of the tray drive unit 240 can be simplified. Additionally, with the tray drive unit 240 provided in an narrow space between the sheet stacking section 231 and the back plate 237, the sheet stacking section 231 can be desirably driven.

Namely, by employing the stepping motor, the discharge tray can be stopped at any position as desired, only one of the tray staple mode position sensor 259 and the tray offset mode position sensor 260 is required. For example, it may be arranged such that only the tray staple mode position sensor 259 is provided, and a rotation angle of a stepping motor is adjusted to a rotation angle θ of the arm 257 from the staple mode position and the offset mode position. In this arrangement, a drive speed can be altered as desired according to a load torque without a complicated circuit. On the other hand, in the case where a solenoid is employed as drive means, a sufficient drive stroke cannot be ensured at a narrow space between the sheet stacking section 231 and the back plate 237. Moreover, in the case of using a brush motor, a complicated circuit is required for controlling the speed, and two sensors are required for the position sensor.

As shown in FIG. 1, while the arm 257 is being moved to the offset mode position, a pressed section 233*d* provided on the back surface of the movable main section 233 of the sheet stacking section 231 is not pushed by the pressure roller 258, and the sheet stacking section 231 is placed in the offset mode position at which it forms a large angle to the horizontal direction. The discharge tray 210 is driven by the elevator mechanism 222 so as to be raised to a vicinity of the upper and lower discharge rollers 216 and 217.

On the other hand, when the arm 257 is moved to a staple mode position, as shown in FIG. 2, the pressed section 233*d* is pressed by the pressure roller 258, and the movable main section 233 is moved to the position where the projected guide section 233*c* of the movable main section 233 reaches the top position of the guide recessed section 238*a*, and the movable main section 233 is moved so that the projected guide section 234*a* of the movable upper connecting section 234 reaches the lowest position of the slots 233*a*. In this state, the sheet stacking section 231 is set such that the movable main section 233 is moved upward, and the movable main section 233 slightly rotates upward about an upper end, so that the movable lower connecting section 235, the movable upper connecting section 234 and the lower bent section 233*g* of the movable main section 233 form substantially straight line. Furthermore, the stacking main section 233*e* of the sheet stacking section 231 forms substantially the same angle as the upper surface of the stapler plate 207 and is positioned substantially on an extended line of the upper surface of the stapler plate 207. The described position is the staple mode position of the sheet stacking section 231 where the movable main section 233 forms a small angle to the horizontal line. In the present embodiment, the angle of the stacking main piece 233*e* of the movable main section 233 to the horizontal line is set to 37°.

Figure 12:
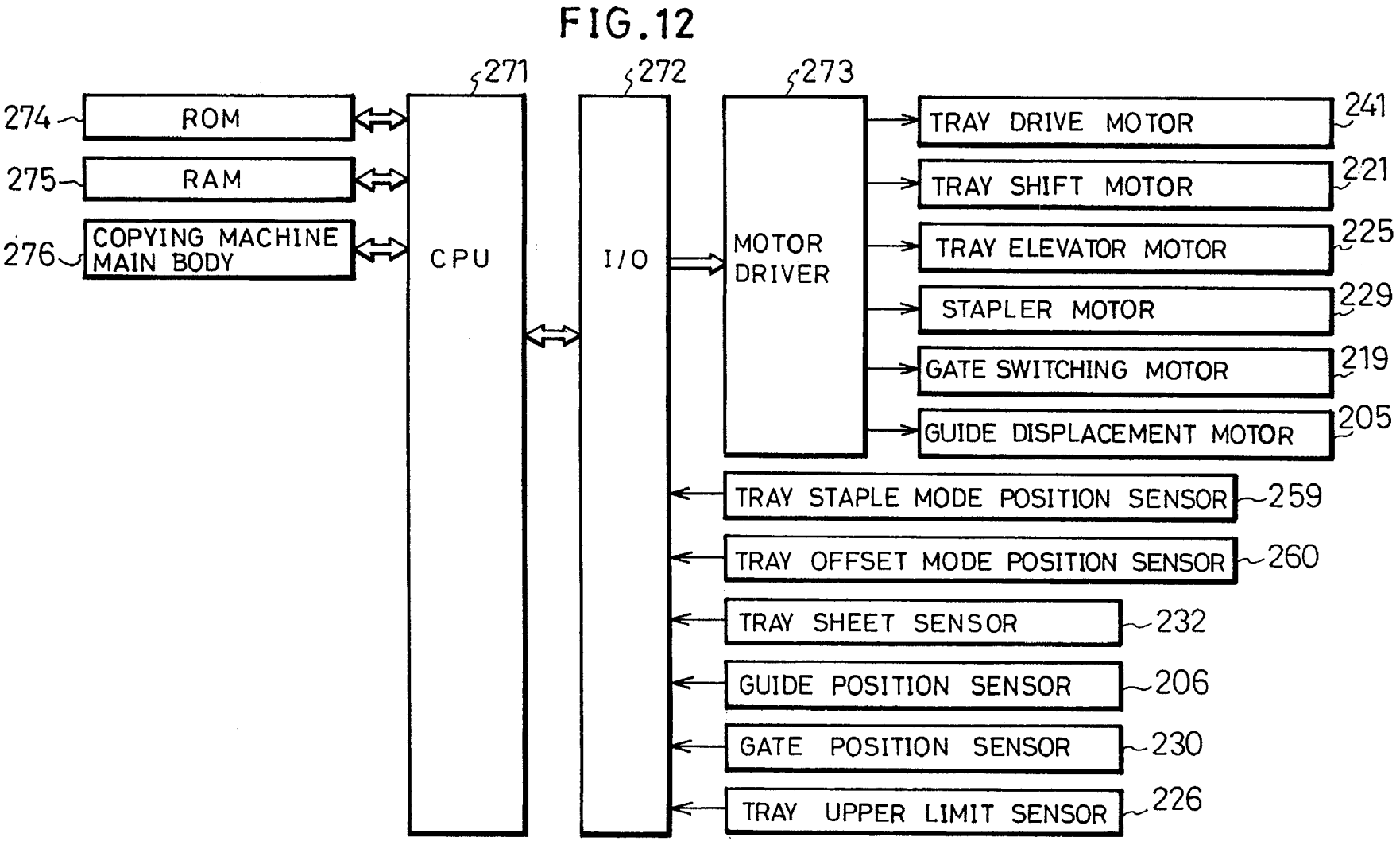

The sheet post-processing apparatus of the present embodiment is provided with a control device shown in FIG. 12. The control device includes a CPU 271 which composes control means, an input-output interface 272, a motor driver 273, a ROM 274 for storing therein operation programs of the CPU and a RAM 275 for temporarily storing various data. The CPU 271 is connected to a copying machine main body 276 so as to transmit and receive information, for example, indicative of whether or not the set mode is the staple mode or the offset mode with the copying machine main body 276. The CPU 271 controls each motor based on information thus obtained and information from each sensor.

To the motor driver 273, connected are a tray drive motor 241, a tray shift motor 221, a tray elevator motor 225, a stapler motor 229, a gate switching motor 219 for driving the date 218 and the guide displacement motor 205 for driving the movable sheet guide 204.

To the CPU 271, connected through the input-output interface are the tray staple mode position sensor 259 for detecting the sheet stacking section 231 on the discharge tray 210 in the staple mode position, i.e., the discharge tray 210 in the staple mode position, the tray offset mode position sensor 260 for detecting the sheet stacking section 231 in the offset mode position, i.e., the discharge tray 210 in the offset mode position, a tray sheet sensor 232 for detecting whether or not the sheet S exists on the discharge tray 210, a guide position sensor 206, a gate position sensor 230 and the tray upper limit sensor 226.

With the above arrangement, the basic operations of the sheet post-processing apparatus in the offset mode and the staple mode will be explained below with reference to FIGS. 1, 2 and 4.

In the offset mode, as shown by a two-dot long and two short dashes line in FIG. 4, the downstream side of the movable sheet guide 204 is lowered, while the gate 218 is raised so that the leading edge thereof contacts the downstream end of the movable sheet guide 204. Namely, the respective members are set in such positions that the sheet S pass between the upper discharge roller 216 and the lower discharge roller 217. In the discharge tray 210, as shown in FIG. 1, the arm 257 falls down to the offset mode position, and therefore, the sheet stacking section 231 is also set in the offset mode position. The described respective operations of the movable sheet guide 204, the gate 218 and the discharge tray 210 are carried out when the copy operation of the copying machine main body is started.

In this state, the sheets S transported through the post-processing transport path 201 by the transport rollers 202 and 203 are discharged onto the discharge tray 210 by the upper and lower discharge rollers 216 and 217. When discharging the sheets S onto the discharge tray 210, the sheet stacking section 231 on the discharge tray 210 is set in the offset mode position. Therefore, an alignment of the sheets S on the discharge tray 210 can be desirably carried out.

On the other hand, in the staple mode, as shown in a solid line in FIG. 4, the downstream side of the movable sheet guide 204 is raised, while the gate 218 is lowered so that the leading edge thereof comes in contact with the upper surface of the stapler plate 207. As a result, a discharge opening 228 (sheet discharge section and first discharge section) is formed between the upper and lower discharge roller 216 and 217. In the discharge tray 210, as shown in FIG. 2, the arms 257 are raised to the staple mode position, and thus the sheet stacking section 231 is also raised to the staple mode position.

In this state, the sheets S transported by the transport rollers 202 and 203 through the post-processing transport path 201 are dropped onto the stapler plate 207 by the dead weight, and are moved along the inclined face of the stapler plate 207 until the trailing edges thereof reach the stopper 208. The described movement of the sheets S is supported by the rotary blade 215 which rotates in a direction A.

As described, when a predetermined number of sheets S are stacked on the stapler plate 207, a stapling process is carried out by the stapler 209. Thereafter, the pusher 211 is moved in a sheet push-out direction, and by being pushed by the pusher 211, a complete set S on the stapler plate 207 is discharged onto the discharge tray 210 through the discharge opening 228.

In the described operations, when the complete set S is discharged onto the discharge tray 210, the sheet stacking section 231 of the discharge tray 210 is set in the staple mode position. Therefore, the complete set S can be desirably guided by the sheet stacking section 231, thereby achieving a desirable discharge operation.

The operations of the sheet post-processing apparatus 200 based on the control of the CPU 271 will be explained below in reference to the flowchart of FIG. 13. In the flowchart, the section surrounded by a two-dot long and two short dashes line shows a position change process for the discharge tray 210 of the sheet post-processing apparatus 200.

In the copying machine main body 276, either the staple mode or the offset mode is selected (S1). When an instruction for starting a copy operation is given (S2), if the selected mode is the staple mode (S3), it is determined whether or not the discharge tray 210 is set in the staple mode position based on the detection by the tray staple mode position sensor 259 (S4).

If so in S4, it is not necessary to change the position of the discharge tray 210, and therefore information indicating that the position of the discharge tray 210 has been changed is transmitted to the copying machine main body 276 so as to start a copy operation (S12).

On the other hand, if the discharge tray 210 is not set in the staple mode position, the tray drive motor 241 of the tray drive unit 240 is rotated so as to raise the sheet stacking section 231 of the discharge tray 210 until the tray staple mode position sensor 259 detects that the discharge tray 210 is set in the staple mode position. Namely, the tray drive motor 241 is rotated in a positive direction (S5 and S6). When the tray staple mode position sensor 259 detects the discharge tray is in the staple mode position, the tray drive motor 241 is stopped (S7). Then, information indicating that the position of the discharge tray 210 has been changed is transmitted to the copying machine main body 276. Then, the sequence moves to S12, and a copy operation is carried out.

In S3, if the selected mode is the offset mode, it is determined whether or not the discharge tray 210 is in the offset mode position based on the detection by the tray offset mode position sensor 260 (S8).

If so in S8, the sequence moves onto S12 where information indicating that the position change process for the discharge tray 210 position has been completed to the copying machine main body 276 so as to start the copy operation.

On the other hand, if the discharge tray 210 is not set in the offset mode position in S8, the tray drive motor 241 is rotated in a reversing direction so as to lower the sheet stacking section 231 until the tray offset mode position sensor 260 detects the discharge tray 210 is set in the offset mode position (S9 and S10). After the tray offset mode position sensor 260 detects the discharge tray 210 is in the offset mode position, the tray drive motor 241 is stopped (S11). Then, information indicating that the position change process for the discharge tray 210 has been completed is transmitted to the copying machine main body 276, and the sequence moves onto S12 where a copy operation is carried out.

In the described arrangement of the sheet post-processing apparatus 200 of the present embodiment, stapled sheets are discharged through the discharge opening 228 (first discharge section)onto the discharge tray 210, while non-stapled sheets are discharged by passing between the upper and lower discharge rollers 216 and 217 (second discharge section). Therefore, compared with the arrangement where the stapled sheets and non-stapled sheets are discharge through the same discharge section, the configuration of the discharge section can be simplified, thereby achieving a desirable discharge operation of sheets S onto the discharge tray 210.

More specifically, if it is arranged such that both stapled sheets and non-stapled sheets are discharged by passing between the upper and lower discharge rollers 216 and 217, in the offset mode, the upper and lower discharge rollers 216 and 217 are brought in contact with one another in order to discharge sheets one by one, while in the staple mode, the upper and lower discharge rollers 216 and 217 are separated from one another so as to form a discharge section through which the thick complete set S of a plurality of sheets can be discharged. Therefore, a mechanism is required for making the upper and lower discharge rollers 216 and 217 in contact with and separate from one another according to the selected mode between the offset mode and the staple mode. Thus, the configuration of the apparatus becomes complicated. Moreover, because the mechanism for making the upper and lower discharge rollers 216 and 217 separate from or in contact with one another is provided, a contact force of the rollers 216 and 217 becomes unstable in the offset mode, thereby presenting the problems that the sheets S may be slanted when being transported or a transport inferior occurs. In the arrangement of the present embodiment, where the discharge section for the complete set S and that for the non-stapled sheets are provided separately, the above problems can be prevented. Moreover, the configuration of each discharge section can be simplified, and the discharge operation of the sheets S onto the discharge tray 210 can be desirably carried out.

In the sheet post-processing apparatus of the present embodiment, when the position of discharge tray 210 is changed between the staple mode position and the offset mode position, the respective surfaces of the movable main section 233 of the sheet stacking section 231, the movable upper connecting section 234 and the movable lower connecting section 235 can be set at respective optimal angles for each mode. Therefore, in both modes, the discharged sheets S can be more desirably guided and the sheets S can be more desirably aligned in discharging the sheets S on to the discharge tray 210.

In the sheet post-processing apparatus of the present embodiment, when discharging a complete set S onto the sheet stacking section 231 of the discharge tray 210, the complete set S is placed on the discharge tray 210 in such a position that a stapled section H is set at the recessed section 231*a*. Therefore, the stapled section H is set at lower position than the non-stapled section of the sheets S. When the discharge tray 210 reaches the upper limit position for receiving the complete set S to be discharged next, and the next complete set S is discharged thereon, the stapled section H of the currently discharged complete set S is stacked on the stapled section H of the previously discharged complete set S. However, as the stapled section H is set at the lower position than the non-stapled section of the complete set S, the stapled section H can be prevented from being bulky than the not-stapled section of the complete set S. Therefore, the following sheets S can be desirably discharged onto the discharge tray 210 and are aligned.

As described, the sheet post-processing apparatus of the present invention is arranged so as to include: a processing tray being inclined; a discharge tray being inclined in the same direction as the processing tray, for stacking thereon discharged sheets, the discharge tray being capable of selectively moving between a processing mode position corresponding to a processing mode and a non-processing mode position corresponding to a non-processing mode by adjusting an inclined angle and a height position thereof; tray drive means for switching a position of the discharge tray between the processing mode position and the non-processing mode position by adjusting the inclined angle and the height position of the discharge tray; post-processing means for post-processing sheets stacked on the processing tray; discharge means for moving processed sheets along the processing tray to be discharged onto the discharge tray through a sheet discharge section and for discharging non-processed sheets onto the discharge tray through the sheet discharge section; and control means for controlling the tray drive means such that when the processing mode is selected in which the processed sheets are discharged by the discharge means, the discharge tray is set in the processing mode position, while when the non-processing mode is selected in which the non-processed sheets are discharged by the discharge means, the discharge tray is set in the non-processing mode position.

In the described arrangement, when the processing mode is selected in which the processed sheets are discharged, the discharge tray is set in the processing mode position by adjusting the inclined angle and the height position thereof, while when the non-processing mode is selected in which the non-processed sheets are discharged, the discharge tray position is set in the non-processing mode position by adjusting the inclined angle and the height position thereof. As a result, the desirable discharging ability of the processed sheets from the processing tray onto the discharge tray can be achieved in the processing mode, and a desirable aligning facility of sheets on the discharge tray can be achieved in the non-processing mode.

The sheet post-processing apparatus of the present invention may be arranged such that the sheet discharge section is composed of a first discharge section formed on a discharge end of the processing tray for discharging therethrough processed sheets and a second discharge section for discharging therethrough non-processed sheets.

In the above arrangement, the processed sheets and non-processed sheets are discharged respectively through separately provided discharge sections: the first discharge section and the second discharge section. Therefore, compared with the case where the processed sheets and the non-processed sheets are discharged through the same discharge section, the configuration of the discharge section can be simplified, and a desirable discharge operation of the sheets onto the discharge tray can be achieved. More specifically, for example, in the described arrangement where the processed sheets and non-processed sheets are discharged through the same discharge section, i.e., a pair of upper and lower discharge rollers, in the non-processing mode, the upper and lower discharge rollers are brought in contact with one another in order to discharge sheets one by one, while in the processing mode in which the processed sheets such as the stapled sheets are discharged, as a plurality of sheets are bound and discharged, the upper and lower discharge rollers are separated from one another so that the stapled sheets are discharged through a discharge opening formed between the upper and lower discharge rollers. Therefore, a mechanism is required for making the upper and lower discharge rollers in contact with or separate from one another according to the selected mode between the processing mode and the non-processing mode. Thus, the configuration of the apparatus becomes complicated. Moreover, because the mechanism for making the upper and lower discharge rollers in contact with or separate from one another is provided, a contact force of the rollers becomes unstable in the non-processing mode, thereby presenting the problems that the sheets are slanted when being transported or a transport inferior occurs. On the other hand, in the arrangement of the present invention where the discharge section for the processed sheets and that for the non-processed sheets are provided separately, the above problems can be prevented. Moreover, the configuration of each discharge section can be simplified, and the discharge operation of the sheets onto the discharge tray can be desirably carried out.

The sheet post-processing apparatus of the present invention having the previously described arrangement may be further arranged such that in the processing mode, an upper surface of the discharge tray is inclined substantially at the same angle as an upper surface of the processing tray and is placed on a virtual plane extended from the upper surface of the processing tray at which sheets discharged through the first discharge section can be stacked, while in the non-processing mode, the upper surface of the discharge tray is inclined at a greater angle than that in the processing mode position at which sheets discharged through the second discharge section can be stacked.

In the described arrangement, in the processing mode, the discharge tray is set in such a position that the upper surface thereof is inclined at the same angle as the upper surface of the processing tray, and is positioned on a virtual plane extended from the upper surface of the processing tray so that sheets discharged through the first discharge section can be desirably guided and stacked thereon. While in the non-processing mode, the discharge tray is set to such a position that the upper surface of the discharge tray is inclined at a greater angle than that in the processing mode position so that sheets discharged through the second discharge section can be stacked thereon. Therefore, a discharging efficiency of the processed sheets from the processing tray onto the discharge tray in the processing mode and an aligning facility of non-stapled discharged sheets on the discharge tray can be still improved.

The sheet post-processing apparatus of the present invention having the previously described arrangement may be further arranged such that in the processing mode, an upper surface of the discharge tray is inclined substantially at a same angle as an upper surface of the processing tray and is placed on a virtual plane extended from the upper surface of the processing tray at which sheets discharged through the first discharge section can be stacked, while in the non-processing mode, the upper surface of the discharge tray is inclined at a greater angle than that in the processing mode position at which sheets discharged through the second discharge section can be stacked.

In the above arrangement, by switching the position of the discharge tray between the processing mode position and the non-processing mode position, the respective surface angles of the movable divisional sections of the sheet stacking section can be set to an optimal angle for each mode. Therefore, in both modes, sheets can be discharged desirably onto the discharge tray, thereby achieving a still improved guiding efficiency of the discharged sheets and aligning efficiency of the sheets on the discharge tray.

The sheet post-processing apparatus of the present invention having the previously described arrangement may be arranged so as to further include: discharge tray elevator means for raising and lowering the discharge tray; and tray upper limit detection means for detecting a state where either an upper surface of the discharge tray or an upper surface of a top sheet placed on the discharge tray reaches an upper limit position for receiving discharged sheets, wherein a recessed section is formed in the sheet stacking section of the discharge tray at a portion corresponding to a processed section of processed sheets discharged onto the sheet stacking section, and the control means drives the discharge tray elevator means such that the discharge tray is moved to a tray upper limit position to be detected by the tray upper limit detection means when discharging sheets onto the discharge tray.

In this arrangement, when the processed sheets are discharged onto the sheet stacking section of the discharge tray, the processed sheets are placed in such a position that the processed portion is set in the recessed section. Therefore, the processed portion of the processed sheets on the discharge tray is set at the lower position than the non-processed portion of the processed sheets. Moreover, in discharging the processed sheets, the discharge tray is driven by the tray elevator means which is controlled by the control means, and the upper surface of the discharge tray (when no sheets exist on the discharge tray) or the upper surface of the top sheet (when a sheet exists on the discharge tray) is set to the upper limit position for receiving the processed sheets to be discharged. In the state where the processed sheets, for example, the stapled sheets are discharged onto the discharge tray, when a stapled portion of currently discharged stapled sheets is stacked on a stapled portion of the previously discharged stapled sheets, the stapled portions thus stacked become more bulky than the non-processed portion of the sheets. However, as the processed portion is set at the lower position than the non-processed portion, the processed portion thus stacked can be prevented from being higher than the non-processed portions. As a result, the following sheets can be desirably discharged onto the discharge tray and aligned on the discharge tray.

The sheet post-processing apparatus of the present invention having the previously described arrangement may be further arranged such that the tray drive means includes: a tray drive motor; a drive member which is selectively moved between a processing mode position for moving a sheet stacking section of the discharge tray to a processing mode position and a non-processing mode position for moving the sheet stacking section of the discharge tray to the non-processing mode position by the tray drive motor; and tray position detection means for detecting a position to which the drive member is moved.

In this arrangement, the tray drive means moves the sheet stacking section of the discharge tray between the processing mode position and the non-processing mode position by the tray drive motor. Therefore, compared with the case where a solenoid is used as a drive source, the sheet stacking section can be appropriately driven in a narrower space.

[EMBODIMENT 2]

Figure 14:
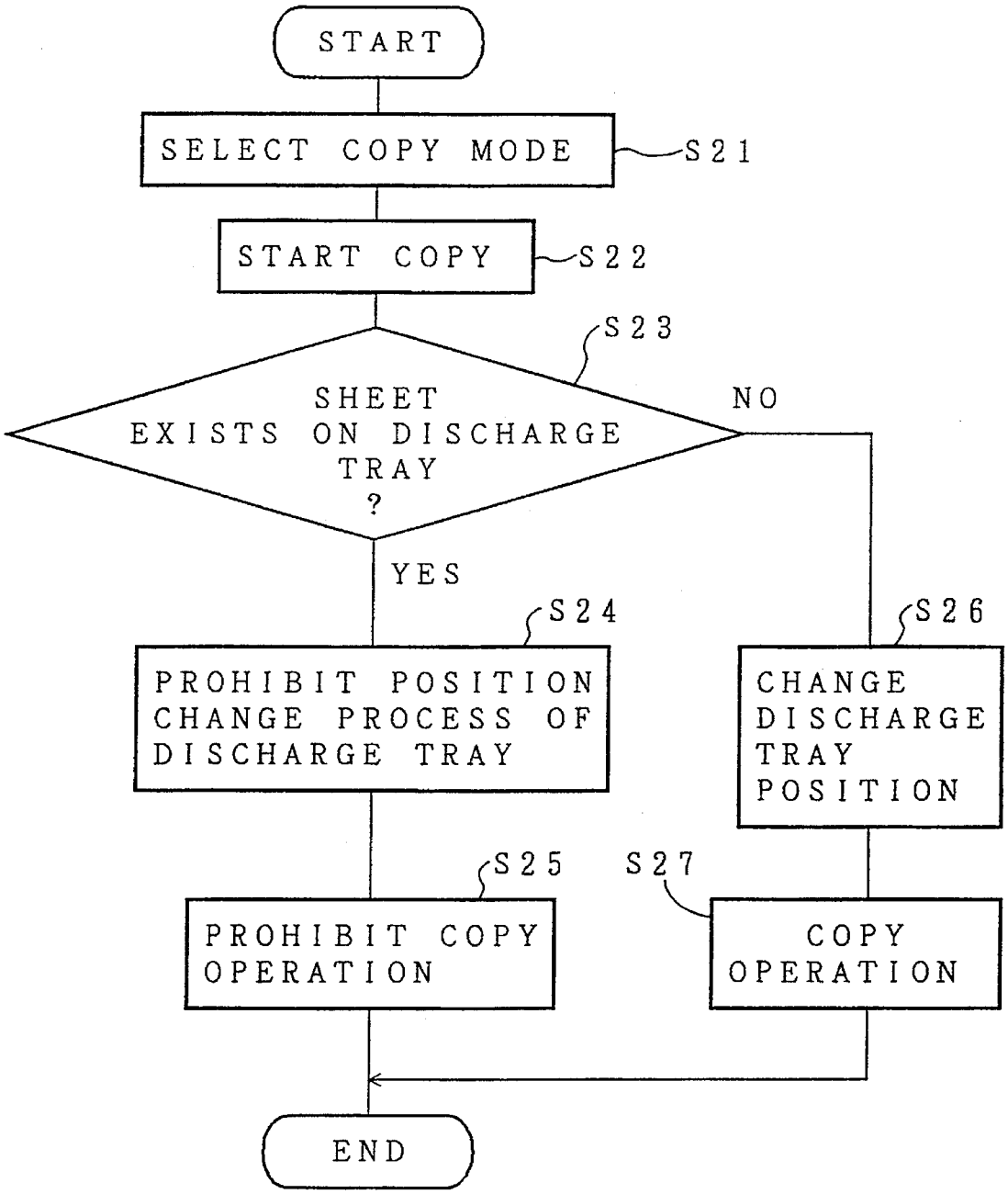

The following description will discuss another embodiment of the present invention in reference to FIG. 12 and FIG. 14. For convenience, members having the same function as in the previous embodiment will be designated by the same codes and the descriptions thereof shall be omitted here.

In a sheet post-processing apparatus of the present embodiment, a CPU 271 shown in FIG. 12 controls as shown in the flowchart of FIG. 14 based on a detection for determining whether or not a sheet exists on the discharge tray 210 as explained below.

In a copying machine main body 276, either a staple mode or an offset mode is selected (S21). Then, an instruction for starting a copy operation is given (S22). Then, based on a detection by a tray sheet sensor 232, it is determined whether or not a sheet exists on the discharge tray 210 (S23).

If so in S23, a position change process of the discharge tray 210 is prohibited (S24), and information indicating that a sheet exists on the discharge tray 210 is transmitted to the copying machine main body 276. Then, the copying machine main body 276 temporarily stops a copy operation (S25), and using a display section (not shown), an alarm is given so as to take out the sheet from the display tray 210.

Figure 13:
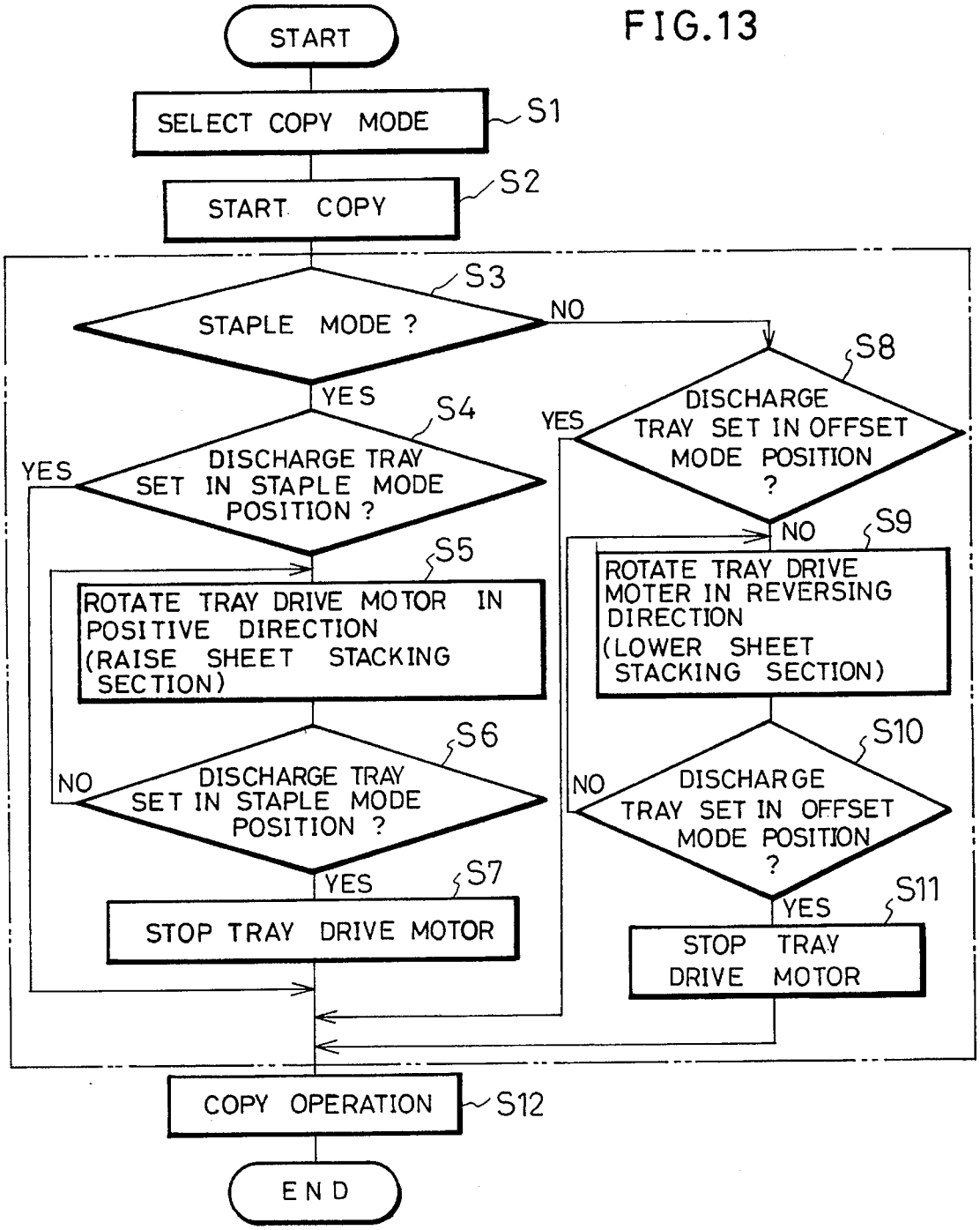

On the other hand, if it is determined that no sheet exist on the discharge tray 210 in S 23, the position change process of the discharge tray 210 is carried out, which corresponds to the operations shown in the section surrounded by the two-dot long and two short dashes line in FIG. 13 (S26), and a copy operation is carried out (S27).

As described, the sheet post-processing apparatus of the present invention is arranged such that the position change process of the discharge tray 210 is prohibited when a sheet exists thereon. Therefore, in switching a mode, i.e., in changing the position of the discharge tray 210, an operation inferior of the tray drive unit 240 due to the weight of the sheets are not likely to occur, and the tray drive unit 240 can be prevented from being damaged easily. Moreover, as the tray drive motor 241 of a small driving force can be used, an enlargement of the apparatus and an increase in the cost can be avoided.

As described, the sheet post-processing apparatus of the present invention is arranged so as to include: a processing tray being inclined; a discharge tray being inclined in the same direction as the processing tray, for stacking thereon discharged sheets, the discharge tray being capable of selectively moving between a processing mode position corresponding to a processing mode and a non-processing mode position corresponding to a non-processing mode by adjusting an inclined angle and a height position thereof; tray drive means for switching a position of the discharge tray between the processing mode position and the non-processing mode position by adjusting the inclined angle and the height position of the discharge tray; post-processing means for post-processing sheets stacked on the processing tray; discharge means for moving processed sheets along the processing tray to be discharged onto the discharge tray through a sheet discharge section and for discharging non-processed sheets onto the discharge tray through the sheet discharge section; control means for controlling the tray drive means such that when the processing mode is selected in which the processed sheets are discharged by the discharge means, the discharge tray is set in the processing mode position, while when the non-processing mode is selected in which the non-processed sheets are discharged by the discharge means, the discharge tray is set in the non-processing mode position; and sheet detection means for detecting whether or not a sheet exists on the discharge tray, wherein the control means prohibits a mode switching operation for the discharge tray by the tray drive means when the sheet detection means detects that a sheet exists on the discharge tray.

In the above arrangement, when a sheet is already placed on the discharge tray, a mode switching operation for the discharge tray by the tray drive means is prohibited. Therefore, while the mode switching operation is being carried out, the tray drive means can be prevented from causing an operation inferior or being damaged due to a weight of the sheets. Moreover, as the tray drive means of a small driving force can be employed, an enlargement of the apparatus and an increase in the cost can be avoided.

[EMBODIMENT 3]

The following description will discuss still another embodiment of the present invention in reference to FIG. 12 and FIG. 15. For convenience, members having the same function as in the previous embodiment will be designated by the same codes and the descriptions thereof shall be omitted here.

In a sheet post-processing apparatus of the present embodiment, a CPU 271 shown in FIG. 12 controls as shown in the flowchart of FIG. 15 based on a detection determining whether or not a sheet exists on a discharge tray 210 and according to a selected mode as explained below.

In a copying machine main body 276, either a staple mode or an offset mode is selected (S31). Then, an instruction for starting a copy operation is given (S32). Then, based on the detection by a tray sheet sensor 232, it is determined whether or not a sheet exists on the discharge tray 210 (S33).

If it is determined that a sheet exists on the discharge tray 210 (S33), and the selected mode is the staple mode (S34), based on a detection by a tray staple mode position sensor 259, it is determined whether or not the discharge tray 210 is in a staple mode position (S35).

If so in S35, the sequence moves onto S36, and a copy operation is carried out. On the other hand, if it is determined that the discharge tray 210 is set in the offset mode position, the position change process for the discharge tray 210 is prohibited (S37), and information indicating that a sheet exists on the discharge tray 210 is transmitted to the copying machine main body 276. As a result, the copying machine main body 276 temporarily stops the copy operation (S38), and using a display section (not shown), an alarm is given so as to take out sheets from the discharge tray 210.

In S34, if the selected mode is the offset mode, based on the detection by the tray offset mode position sensor 260, it is determined whether or not the discharge tray 210 is set in the offset mode position (S39).

If so in S39, the sequence moves back to S36, and a copy operation is carried out. On the other hand, if it is determined that the discharge tray 210 is not set in the offset mode position, a tray drive motor 241 is rotated in a reversing direction so as to lower a sheet stacking section 231 until a tray offset mode position sensor 260 detects that the discharge tray 210 is set in the offset mode position (S40, S41). Thereafter, the tray drive motor 241 is stopped (S42). Then, information indicating that the position of the discharge tray 210 has been changed to the copying machine main body 276, and a sequence moves to S36 and a copy operation is carried out.

In S33, if it is determined that no sheet exist on the discharge tray 210, the previously described position change process for the discharge tray 210 is carried out (S43), and thereafter, the sequence moves onto S36 and a copy operation is carried out.

As described, the sheet post-processing apparatus of the present invention is arranged such that when a sheet is placed on the discharge tray 210, a position change process for the discharge tray 210 to the staple mode position is prohibited. Namely, the position change process for raising the sheet stacking section 231 on the discharge tray 210 to the staple mode position, which requires a large load of the tray drive unit 240 is prohibited, while the position change process for lowering the sheet stacking section 231 to the offset mode position which requires small load of the tray drive unit 240 is permitted. Therefore, in the position change process for the discharge tray 210, an operation inferior of the tray drive unit 240 due to the weight of the sheets are not likely to occur, and the tray drive unit 240 can be prevented from being damaged easily. Moreover, as the tray drive motor 241 of relatively small driving force may be used, an enlargement of the apparatus and an increase in the cost can be avoided. Additionally, the problem that a sheet is sandwiched between the discharge tray 210 and the lower discharge roller 217 provided above the discharge tray 210 can be prevented.

Compared with the sheet post-processing apparatus of the embodiment 2 where a position change process is prohibited whenever a sheet exists on the discharge tray 210, the sheet post-processing apparatus of the present embodiment gives an improved operation efficiency of the apparatus. For example, in the arrangement where the position change process is prohibited whenever a sheet exists on the discharge tray, if an interrupt operation which requires the position of the discharge tray 210 to be changed is set in the copying machine main body 276 provided with the sheet post-processing apparatus, the problem is presented in that all the sheets on the discharge tray 210 must be taken out even in the middle of the operation. On the other hand, in the arrangement of the present invention, when an interrupt operation is set which requires the position change process for lowering the discharge tray 210, the described processes are not required.

As described, the sheet post-processing apparatus of the present embodiment includes: a processing tray being inclined; a discharge tray being inclined in the same direction as the processing tray, for stacking thereon discharged sheets, the discharge tray being capable of selectively moving between a processing mode position corresponding to a processing mode and a non-processing mode position corresponding to a non-processing mode by adjusting an inclined angle and a height position thereof; tray drive means for switching a position of the discharge tray between the processing mode position and the non-processing mode position by adjusting the inclined angle and the height position of the discharge tray; post-processing means for post-processing sheets stacked on the processing tray; discharge means for moving processed sheets along the processing tray to be discharged onto the discharge tray through a sheet discharge section and for discharging non-processed sheets onto the discharge tray through the sheet discharge section; control means for controlling the tray drive means such that when the processing mode is selected in which the processed sheets are discharged by the discharge means, the discharge tray is set in the processing mode position, while when the non-processing mode is selected in which the non-processed sheets are discharged by the discharge means, the discharge tray is set in the non-processing mode position; and sheet detection means for detecting whether or not, a sheet exists on the discharge tray, wherein the control means prohibits a mode switching operation for raising the discharge tray by the tray drive means when the sheet detection means detects that a sheet exists on the discharge tray.

Therefore, when a sheet is already placed on the discharge tray, the mode switching operation for raising the discharge tray by the tray drive means is prohibited. Namely, the position change process for raising the discharge tray which requires a large load of the tray drive means is prohibited, while the position change process for lowering the discharge tray which requires a small load of the tray drive means is permitted. Therefore, in switching a mode, an operation inferior of the tray drive means due to the weight of the sheets are not likely to occur, or the tray drive means can be prevented from being damaged. Moreover, as the tray drive means of relatively small driving force may be used, an enlargement of the apparatus and an increase in the cost can be avoided. Additionally, the problem that a sheet is sandwiched between the discharge tray and a member provided above the discharge tray can be prevented. Furthermore, compared with the case where the mode switching operation is prohibited whenever a sheet exists on the discharge tray, an operation efficiency of the apparatus can be improved. In the arrangement where a mode switching operation is prohibited whenever a sheet exists on the discharge tray, for example, if an interrupt operation which requires a mode switching operation of the discharge tray is set in the copying machine main body, the problem is presented in that all the sheets must be taken out even in the middle of the operation. On the other hand, in the sheet post-processing apparatus of the present invention, when an interrupt operation is set which requires the mode switching operation for lowering the discharge tray, the described process is not required.

[EMBODIMENT 4]

Figure 16:
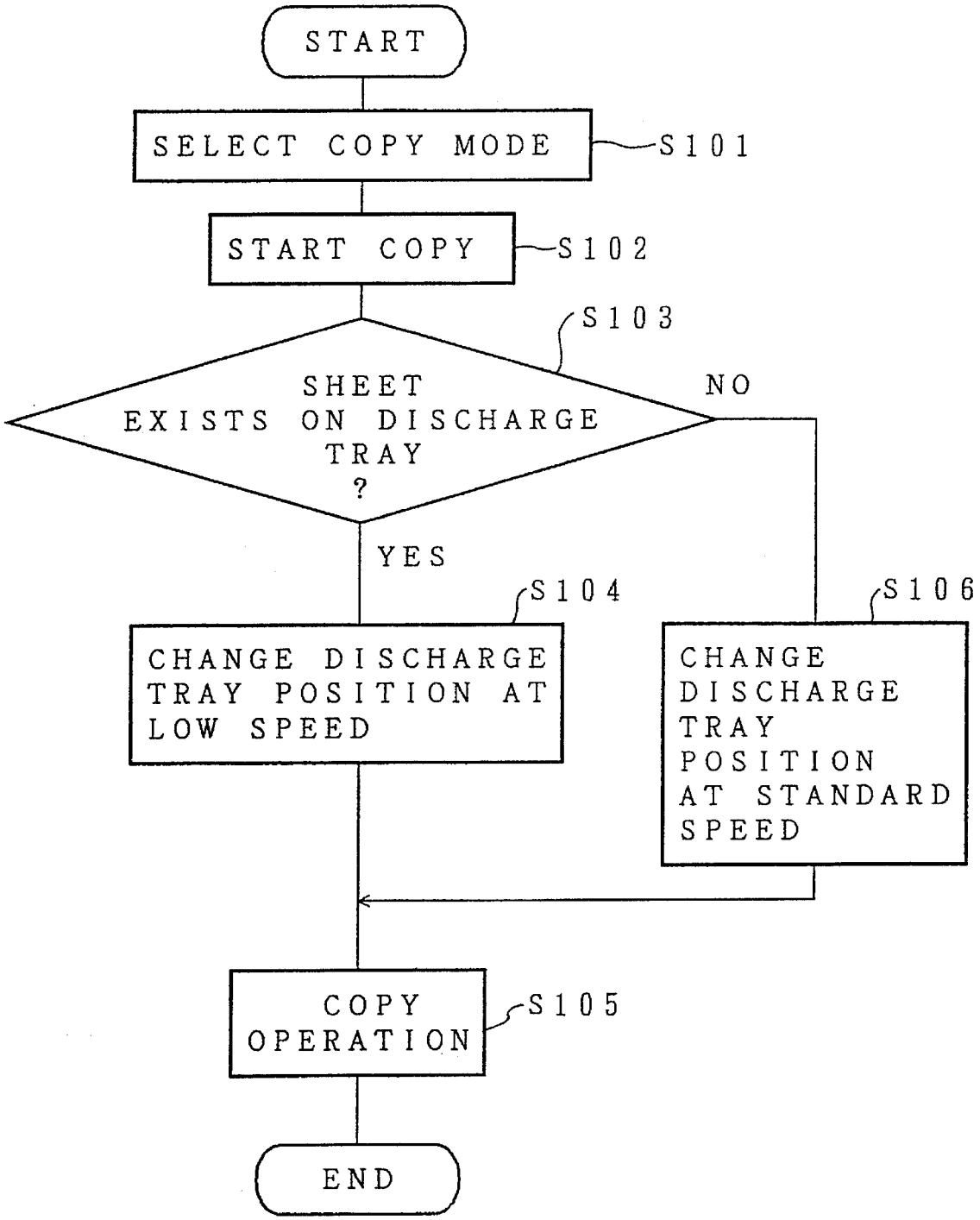

The following description will discuss still another embodiment of the present invention in reference to FIG. 12 and FIG. 16. For convenience, members having the same function as in the previous embodiment will be designated by the same codes and the descriptions thereof shall be omitted here.

In a sheet post-processing apparatus of the present embodiment, a CPU 271 shown in FIG. 12 controls as shown in the flowchart of FIG. 16 based on a detection determining whether or not a sheet exists on the discharge tray 210 as explained below.

In a copying machine main body 276, either a staple mode or an offset mode is selected (S101). Then, an instruction for starting a copy operation is given (S102). Then, based on a detection by a tray sheet sensor 232, it is determined whether or not a sheet exists on the discharge tray 210 (S103). If it is determined that a sheet exists on the discharge tray 210 in S103, a position change process for the discharge tray 210 is carried out at a lower speed than the standard speed (S104). Then, a copy operation is carried out (S105).

On the other hand, if it is determined in S103 that no sheet exist on the discharge tray 210, a position change process for the discharge tray 210 is carried out at the standard speed (S106). Then, a sequence moves to S105.

According to the arrangement of the sheet post-processing apparatus of the present embodiment, when no sheets exist on the discharge tray 210, the position change process for the discharge tray 210 is carried out with a standard rotation of the tray drive motor 241, while when a sheet exists on the discharge tray 210, the position change process for the discharge tray 210 is carried out at a lower speed than the reference speed. Therefore, a tray drive unit 240 and members to be driven by the tray drive unit 240 can be prevented from being damaged due to a sudden change in the load.

As described, the sheet post-processing apparatus of the present invention includes: a processing tray being inclined; a discharge tray being inclined in the same direction as the processing tray for stacking thereon discharged sheets, the discharge tray being capable of selectively moving between a processing mode position corresponding to a processing mode and a non-processing mode position corresponding to a non-processing mode by adjusting an inclined angle and a height position thereof; tray drive means for switching a position of the discharge tray between the processing mode position and the non-processing mode position by adjusting the inclined angle and the height position of the discharge tray; post-processing means for post-processing sheets stacked on the processing tray; discharge means for moving processed sheets along the processing tray to be discharged onto the discharge tray through a sheet discharge section and for discharging non-processed sheets onto the discharge tray through the sheet discharge section; control means for controlling the tray drive means such that when the processing mode is selected in which the processed sheets are discharged by the discharge means, the discharge tray is set in the processing mode position, while when the non-processing mode is selected in which the non-processed sheets are discharged by the discharge means, the discharge tray is set in the non-processing mode position; and sheet detection means for detecting whether or not a sheet exists on the discharge tray, wherein the control means controls the tray drive means such that when the sheet detection means detects that a sheet exists on the discharge tray, a mode switching operation for the discharge tray is carried out at a lower speed than when the sheet detection means detects that no sheets exist on the discharge tray.

According to the above arrangement, when a sheet is placed on the discharge tray, a mode switching operation of the discharge tray is carried out at a lower speed than when no sheet exists on the discharge tray. Therefore, tray drive means and members to be driven by the tray drive means can be prevented from being damaged due to a sudden change in the load.

[EMBODIMENT 5]

The following description will discuss still another embodiment of the present invention in reference to FIG. 12 and FIG. 17. For convenience, members having the same function as in the previous embodiment will be designated by the same codes and the descriptions thereof shall be omitted here.

In a sheet post-processing apparatus of the present embodiment, a CPU 271 shown in FIG. 12 controls as shown in the flowchart of FIG. 17 based on a detection determining whether or not a sheet exists on the discharge tray 210 and according to the selected mode as explained below.

In a copying machine main body 276, either a staple mode or an offset mode is selected (S51). When an instruction for starting a copy operation is given (S52), it is determined whether or not a sheet exists on the discharge tray 210 based on a detection by a tray sheet sensor 232 (S53).

If it is determined in S53 that a sheet exists on the discharge tray 210, and the selected mode is the staple mode (S54), it is determined whether or not the discharge tray 210 is set in the staple mode based on the detection by a tray staple mode position sensor 259 (S55).

If so in S55, the sequence moves onto S56, and a copy operation is carried out. If it is determined that the discharge tray 210 is not set in the staple mode in S55, i.e., when the discharge tray 210 is set in the offset mode, the tray drive motor 241 is rotated so as to raise the sheet discharge section 231 on the discharge tray 210 at a lower speed than the standard speed until the tray staple mode position sensor 259 detects that the discharge tray 210 is set in the staple mode position. Namely, the tray drive motor 241 is positively rotated at a reduced speed (S57, S58).

Thereafter, the tray drive motor 241 is stopped (S59), and a sequence moves back to S56 and a copy operation is carried out.

On the other hand, if the selected mode is not the staple mode in S54, the operations in S60 through S63 are carried out, and thereafter the sequence moves back to S56. Here, the operations in S60 through S63 are the same as the operations in S8 through S11 of FIG. 13. Therefore, in S61, the tray drive motor is rotated in a reversing direction at standard speed.

If it is determined in S53 that no sheets exist on the discharge tray 210, the position change process for the discharge tray 210 is carried out (S64), and then a sequence moves back to S56.

According to the arrangement of the sheet post-processing apparatus of the present invention, when a sheet is placed on the discharge tray 210, a position change process for the discharge tray 210 to the offset mode position is carried out by rotating the tray drive motor 241 at a standard speed, while the position change process for the discharge tray 210 to the staple mode position is carried out by rotating the tray drive motor 241 at a lower speed than the standard speed. Therefore, the tray drive unit 240 and the members to be driven by the tray drive unit 240 can be prevented from being damaged due to a sudden change in the load. Additionally, although a load of the tray drive motor 241 is large during the position change process of the discharge tray to the staple mode position, as the rotation speed of the tray drive motor 241 is reduced, a drive torque becomes larger, thereby preventing the problem of an insufficient driving force. Moreover, compared with the case where the position change process is prohibited whenever a sheet exists on the discharge tray 210, an efficiency of the apparatus can be improved. Furthermore, when no sheets exist on the discharge tray, the position change process is carried out at a higher speed than when a sheet is placed on the discharge tray 210. Therefore, it is not necessary to always slow down the operation speed.

As described, the sheet post-processing apparatus of the present invention includes: a processing tray being inclined; a discharge tray being inclined in the same direction as the processing tray, for stacking thereon discharged sheets, the discharge tray being capable of selectively moving between a processing mode position corresponding to a processing mode and a non-processing mode position corresponding to a non-processing mode by adjusting an inclined angle and a height position thereof; tray drive means for switching a position of the discharge tray between the processing mode position and the non-processing mode position by adjusting the inclined angle and the height position of the discharge tray; post-processing means for post-processing sheets stacked on the processing tray; discharge means for moving processed sheets along the processing tray to be discharged onto the discharge tray through a sheet discharge section and for discharging non-processed sheets onto the discharge tray through the sheet discharge section; control means for controlling the tray drive means such that when the processing mode is selected in which the processed sheets are discharged by the discharge means, the discharge tray is set in the processing mode position, while when the non-processing mode is selected in which the non-processed sheets are discharged by the discharge means, the discharge tray is set in the non-processing mode position; and sheet detection means for detecting whether or not a sheet exists on the discharge tray, wherein the control means controls the tray drive means such that when the sheet detection means detects that a sheet exists on the discharge tray, a mode switching operation for raising the discharge tray is carried out at a lower speed than a mode switching operation for lowering the discharge tray.

According to the above arrangement, when a sheet is placed on the discharge tray, as the mode switching operation for raising the discharge tray is carried out at a lower speed than the mode switching operation for lowering the discharge tray, the tray drive means and members to be driven by the tray drive means can be prevented from being damaged due to a sudden change in the load. Moreover, compared with the arrangement where a mode switching operation is prohibited whenever a sheet exists on the discharge tray, an operation efficiency of the apparatus can be improved. Furthermore, when a sheet does not exist on the discharge tray, a mode switching operation can be carried out at a relatively higher speed. Thus, it is not necessary to always slow down an operation speed.

[EMBODIMENT 6]

Figure 18:
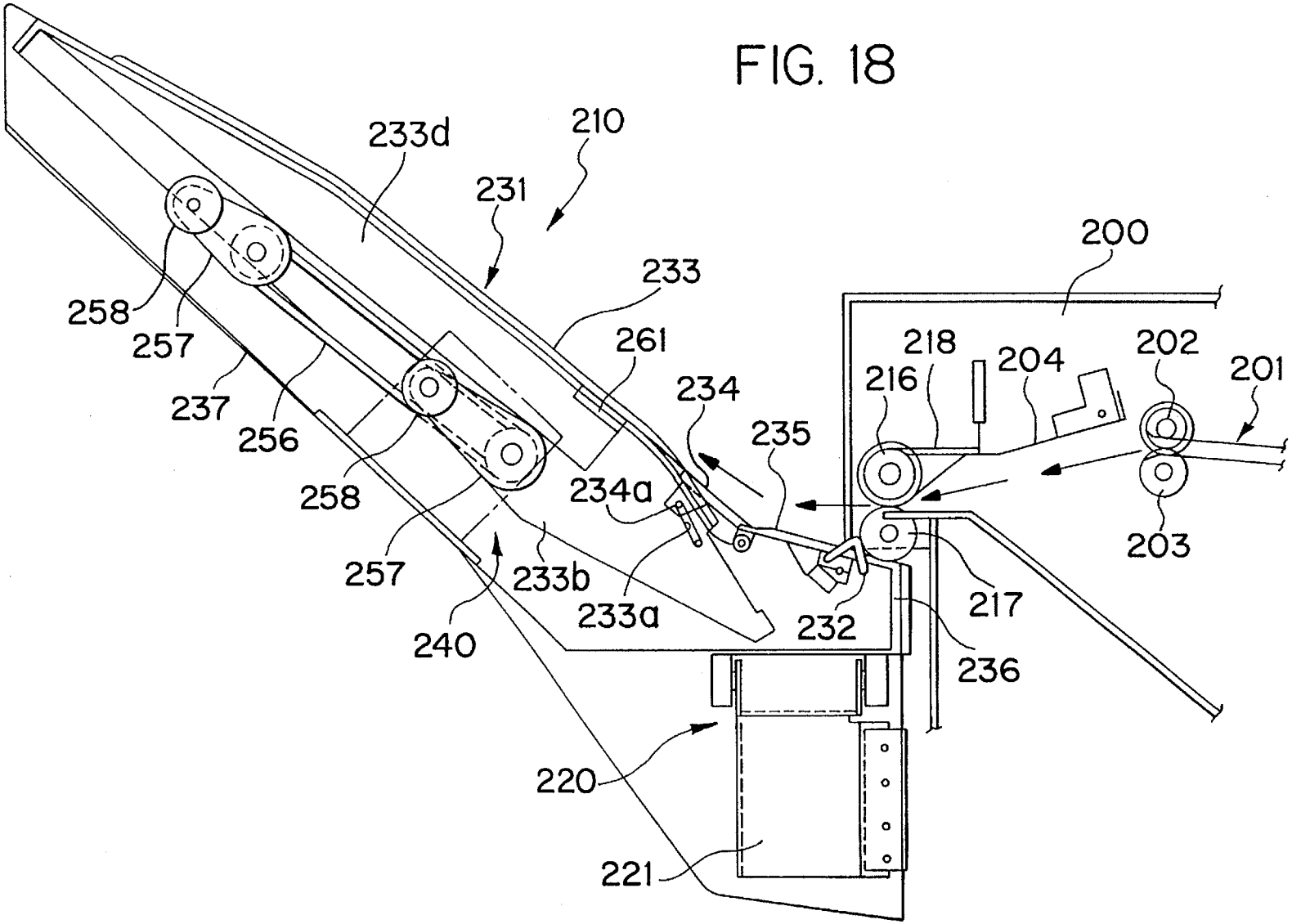
Figure 19:
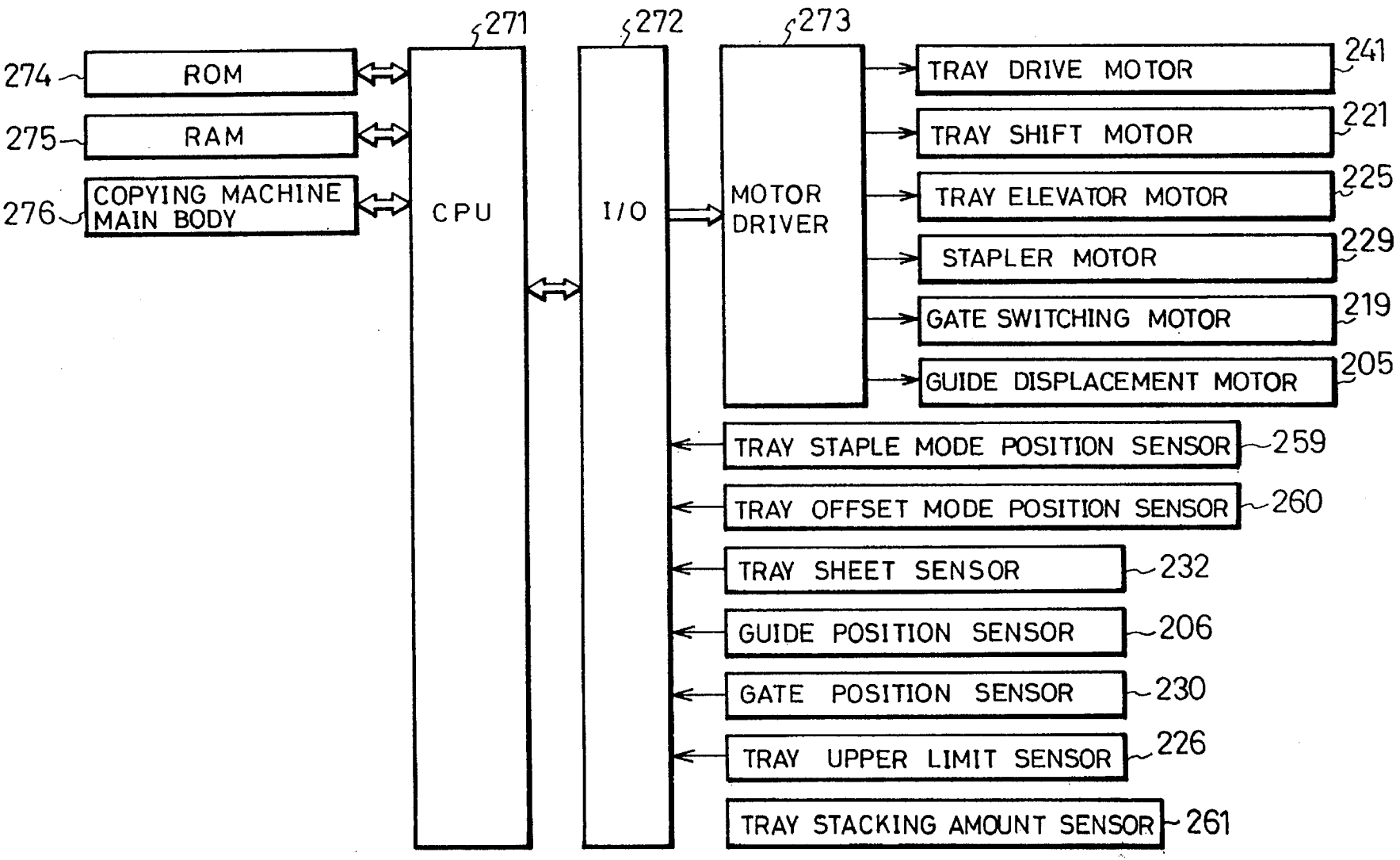
Figure 20:
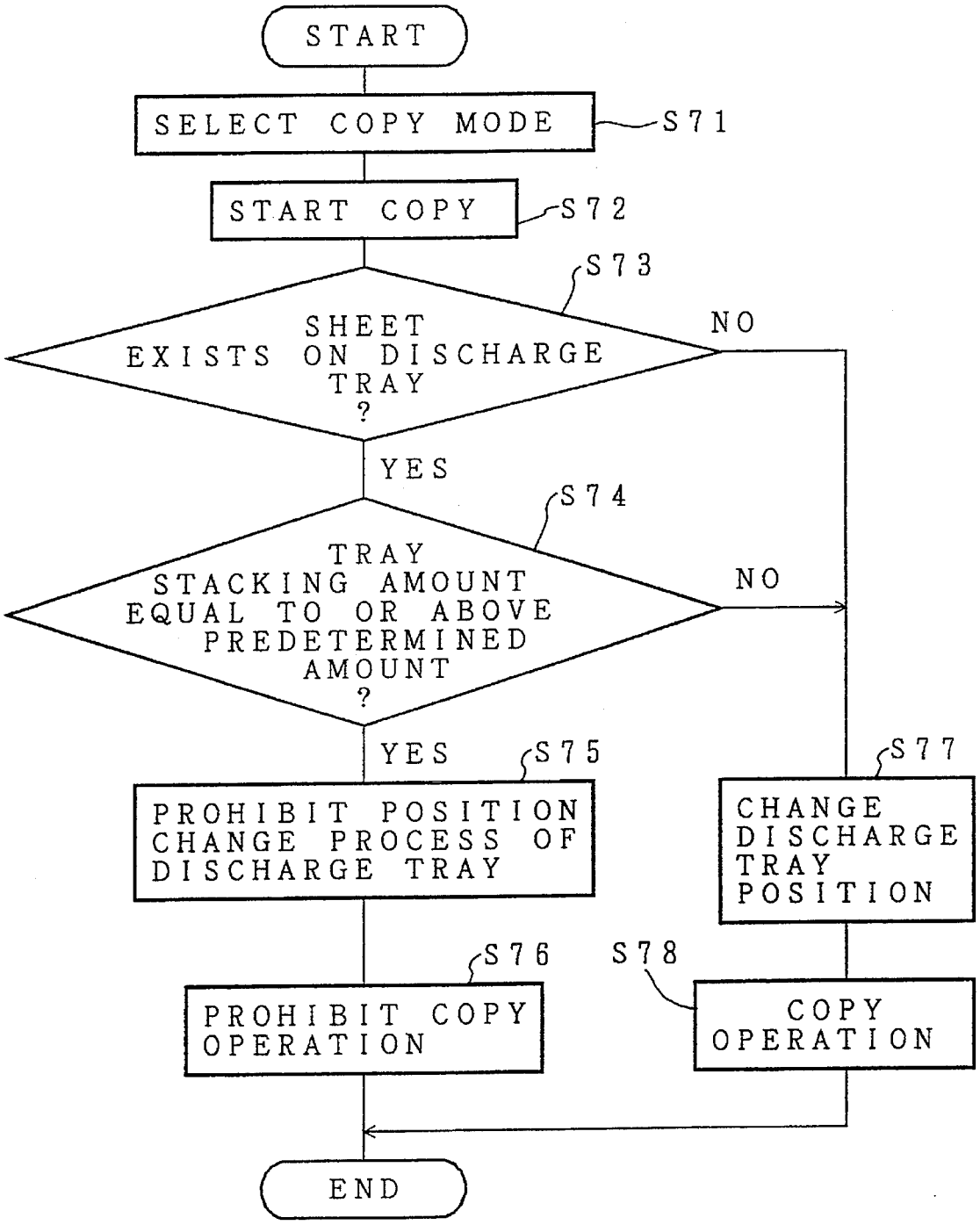

The following description will discuss still another embodiment of the present invention in reference to FIG. 18 through FIG. 20. For convenience, members having the same function as in the previous embodiments will be designated by the same codes and the descriptions thereof shall be omitted here.

In a sheet post-processing apparatus of the present embodiment, a CPU shown in FIG. 19 controls as shown in the flowchart of FIG. 20 based on a detection determining whether or not a sheet exists on the discharge tray 210 and a detection determining an amount of sheets stacked on a discharge tray 210. Therefore, as shown in FIG. 18, a movable main section 233 of the sheet stacking section 231 on the discharge tray 210 is provided with a tray stacking amount sensor 261 (sheet amount detection means) for detecting an amount of sheets stacked on the sheet stacking section 231. The tray stacking amount sensor 261 is, for example, composed of a pressure sensitive resistance element. Moreover, as shown in FIG. 19, the tray stacking amount sensor 261 is connected to the CPU 271 through an input-output interface 272.

Other than the pressure sensitive resistance element, the tray stacking amount detection sensor 261 may be arranged such that the height of the sheets stacked on the discharge tray 210 is detected so as to detect the amount of sheets stacked on the discharge tray 210 based on the detected height as generally used. Moreover, the height of the sheets may be detected by detecting a change in the position or in an amount of movement of the discharge tray 210 according to the height of the sheets, by means of a combination of a slit disc and a photo sensor or only by means of a position sensor.

The processes shown in the flowchart of FIG. 20 include a process in S74 between the processes in S23 and in S24 of the previously described flowchart of FIG. 14. Here, the processes in S71 through S73 and the processes in S75 through S78 are the same as the processes in S21 through S23 and the processes in S24 through S27 of FIG. 14. Therefore, in the apparatus of the present embodiment, when it is determined in S73 that a sheet exists on the discharge tray 210 and determined in S74 that an amount of sheets, i.e., a weight of the sheets on the discharge tray 210 is below a predetermined weight, a position change process of the discharge tray 210 is carried out in S77. On the other hand, if the amount of sheets stacked on the discharge tray 210 is equal to or above a predetermined amount, the position change process for the discharge tray 210 is prohibited in S75.

According to the above arrangement, in the position change process for the discharge tray 210, an operation inferior of the tray drive unit 240 due to the weight of the sheets are not likely to occur, and the tray drive unit 240 can be prevented from being damaged easily. Moreover, as the tray drive motor 241 of relatively small driving force may be employed, an enlargement of the apparatus and an increase in the cost can be avoided. Moreover, if the sheets stacked on the discharge tray 210 has a weight which does not affect the position change operation, the position change process is not prohibited. Therefore, compared with the case where the position change process is prohibited whenever a sheet exists on the discharge tray 210, an operation efficiency of the apparatus can be improved.

As described, the sheet post-processing apparatus of the present invention includes: a processing tray being inclined; a discharge tray being inclined in the same direction as the processing tray, for stacking thereon discharged sheets, the discharge tray being capable of selectively moving between a processing mode position corresponding to a processing mode and a non-processing mode position corresponding to a non-processing mode by adjusting an inclined angle and a height position thereof; tray drive means for switching a position of the discharge tray between the processing mode position and the non-processing mode position by adjusting the inclined angle and the height position of the discharge tray; post-processing means for post-processing sheets stacked on the processing tray; discharge means for moving the processed sheets along the processing tray to be discharged onto the discharge tray through a sheet discharge section and for discharging the non-processed sheets onto the discharge tray through the sheet discharge section; control means for controlling the tray drive means such that when the processing mode is selected in which the processed sheets are discharged by the discharge means, the discharge tray is set in the processing mode position, while when the non-processing mode is selected in which the non-processed sheets are discharged by the discharge means, the discharge tray is set in the non-processing mode position; and sheet amount detection means for detecting an amount of sheets stacked on the discharge tray, wherein the control means prohibits a mode switching operation for the discharge tray by the tray drive means when the sheet amount detection means detects that more than a predetermined amount of sheets is stacked on the discharge tray.

According to the above arrangement, when an amount of sheets stacked on the discharge tray is equal to or above a predetermined amount, the mode switching operation for the discharge tray by the tray drive means is prohibited. Therefore, in the mode switching process, due to the weight of the sheets, an operation inferior of the tray drive means are not likely to occur, and the tray drive means can be prevented from being damaged easily. Moreover, as the tray drive means of relatively small driving force may be used, an enlargement of the apparatus and an increase in the cost can be avoided. Compared with the arrangement where the mode switching process is prohibited whenever a sheet exists on the discharge tray, an operation efficiency of the apparatus can be improved.

[EMBODIMENT 7]

Figure 21:
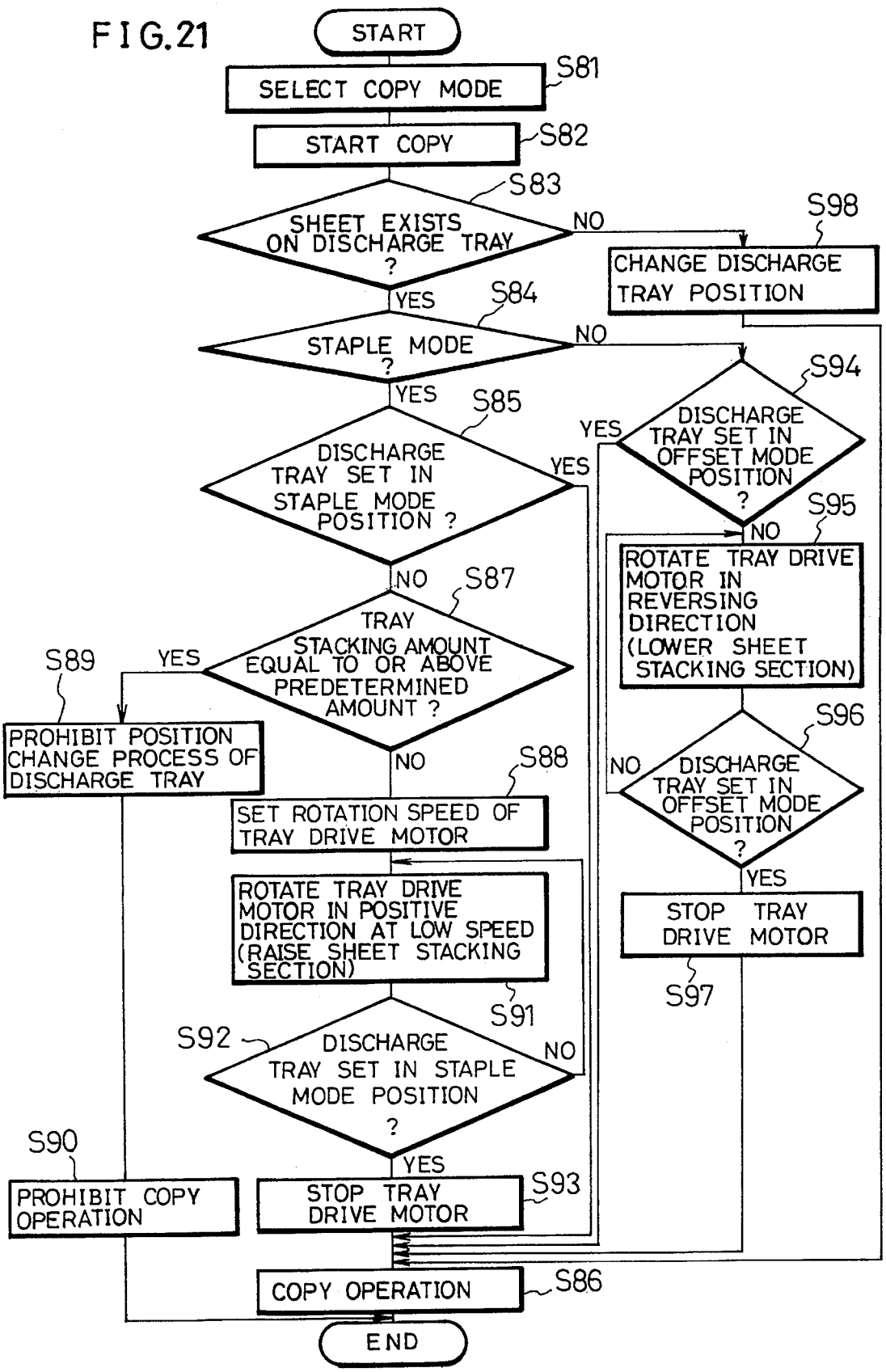

The following description will discuss still another embodiment of the present invention in reference to FIG. 18, FIG. 19 and FIG. 21. For convenience, members having the same function as in the previous embodiment will be designated by the same codes and the descriptions thereof shall be omitted here.

In a sheet post-processing apparatus of the present embodiment, a CPU 271 shown in FIG. 19 controls as shown in the flowchart of FIG. 21 based on a detection determining whether or not a sheet exists on the discharge tray 210, and a detection determining an amount of sheets stacked on the discharge tray 210 by a tray stacking amount detection sensor 261 shown in FIG. 18 and according to the selected mode as explained below.

First, a mode is selected (S81). Then, when an instruction for starting a copy operation is given (S82), if a sheet exists on the discharge tray 210 (S83), the selected mode is the staple mode (S84), the discharge tray 210 is not set in the staple mode (S85), and an amount of sheets stacked on the discharge tray 210 is less than a predetermined amount (S87), based on a detected amount of sheets by the tray stacking amount detection sensor 261, the rotation speed of the tray drive motor 241 is set (S88). Then, the tray drive motor 241 is rotated at the rotation speed set in S88. Namely, the tray drive motor 241 is positively rotated at a speed lower than the standard speed (S91) so as to set the discharge tray 210 in the staple mode position (S92).

On the other hand, if an amount of sheets stacked on the discharge tray 210 is equal to or above a predetermined amount in S87, a position change process for the discharge tray 210 is prohibited (S89), and a copy operation is prohibited (S90).

Here, processes in S81 through S86, and processes in S91 through S98 are the same as the processes in S51 through S56 and in S57 through S64 shown in FIG. 17.

As described, the sheet post-processing apparatus of the present invention is arranged such that when sheets are stacked on the discharge tray 210, if an amount of the sheets is less than a predetermined amount, a position change process for the discharge tray 210 to the staple mode position is permitted, while if an amount of the sheets is equal to or above the predetermined amount, the position change process for the discharge tray 210 is prohibited. Therefore, in the position change process for the discharge tray 210, due to the weight of the sheets, an operation inferior of the tray drive unit 240 will not likely to occur, and the tray drive unit 240 can be prevented from being damaged easily. As the tray drive motor 241 of relatively small driving force may be used, an enlargement of the apparatus and an increase in the cost can be avoided. Additionally, the problem that a sheet on the discharge tray 210 is sandwiched between the discharge tray 210 and the lower discharge roller 217 can be prevented. Furthermore, compared with the arrangement where a position change process is prohibited whenever a sheet exists on the discharge tray 210, an operation efficiency of the apparatus can be improved.

In the sheet post-processing apparatus of the present embodiment, when a sheet exists on the discharge tray 210, a position change process for the discharge tray 210 is carried out by controlling the rotation speed of the tray drive motor 241 according to the amount of sheets stacked on the discharge tray 210. Namely, the rotation speed is controlled such that as the number of sheets stacked on the discharge tray 210 increases, the rotation speed of the tray drive motor 241 is lowered. Therefore, the tray drive unit 240 and the members to be driven by the tray drive unit 240 can be prevented from being damaged due to a sudden change in the load. Moreover, compared with the arrangement where a position change process is prohibited whenever a sheets exists on the discharge tray 210, an operation efficiency of the apparatus can be improved. Moreover, when a detected amount of sheets is less than a predetermined amount, a position change process can be carried out at a relatively higher speed than when a detected amount is equal to or above the predetermined amount. Therefore, it is not necessary to always slow down the operation speed.

The sheet post-processing apparatus of the present invention includes: a processing tray being inclined; a discharge tray being inclined in the same direction as the processing tray, for stacking thereon discharged sheets, the discharge tray being capable of selectively moving between a processing mode position corresponding to a processing mode and a non-processing mode position corresponding to a non-processing mode by adjusting an inclined angle and a height position thereof; tray drive means for switching a position of the discharge tray between the processing mode position and the non-processing mode position by adjusting the inclined angle and the height position of the discharge tray; post-processing means for post-processing sheets stacked on the processing tray; discharge means for moving processed sheets along the processing tray to be discharged onto the discharge tray through a sheet discharge section and for discharging non-processed sheets onto the discharge tray through the sheet discharge section; control means for controlling the tray drive means such that when the processing mode is selected in which the processed sheets are discharged by the discharge means, the discharge tray is set in the processing mode position, while when the non-processing mode is selected in which the non-processed sheets are discharged by the discharge means, the discharge tray is set in the non-processing mode position; and sheet amount detection means for detecting an amount of sheets stacked on the discharge tray, wherein the control means controls the tray drive means such that a mode switching operation for the discharge tray is carried out at a speed according to an amount of sheets detected by the sheet amount detection means.

According to the above arrangement, the mode switching operation of the discharge tray is carried out at a speed according to the amount of sheets stacked on the discharge tray. Therefore, the tray drive means and the members to be driven by the tray drive means can be prevented from being damaged due to a sudden change in the load. Moreover, when it is not necessary to slow down a mode switching operation, for example, when an amount of sheets stacked on the discharge tray is small, it is not necessary to slow down the operation speed throughout the operation.

[EMBODIMENT 8]

The following description will discuss still another embodiment of the present invention in reference to FIG. 22 through FIG. 26. For convenience, members having the same function as in the previous embodiment will be designated by the same codes and the descriptions thereof shall be omitted here.

Figure 22:
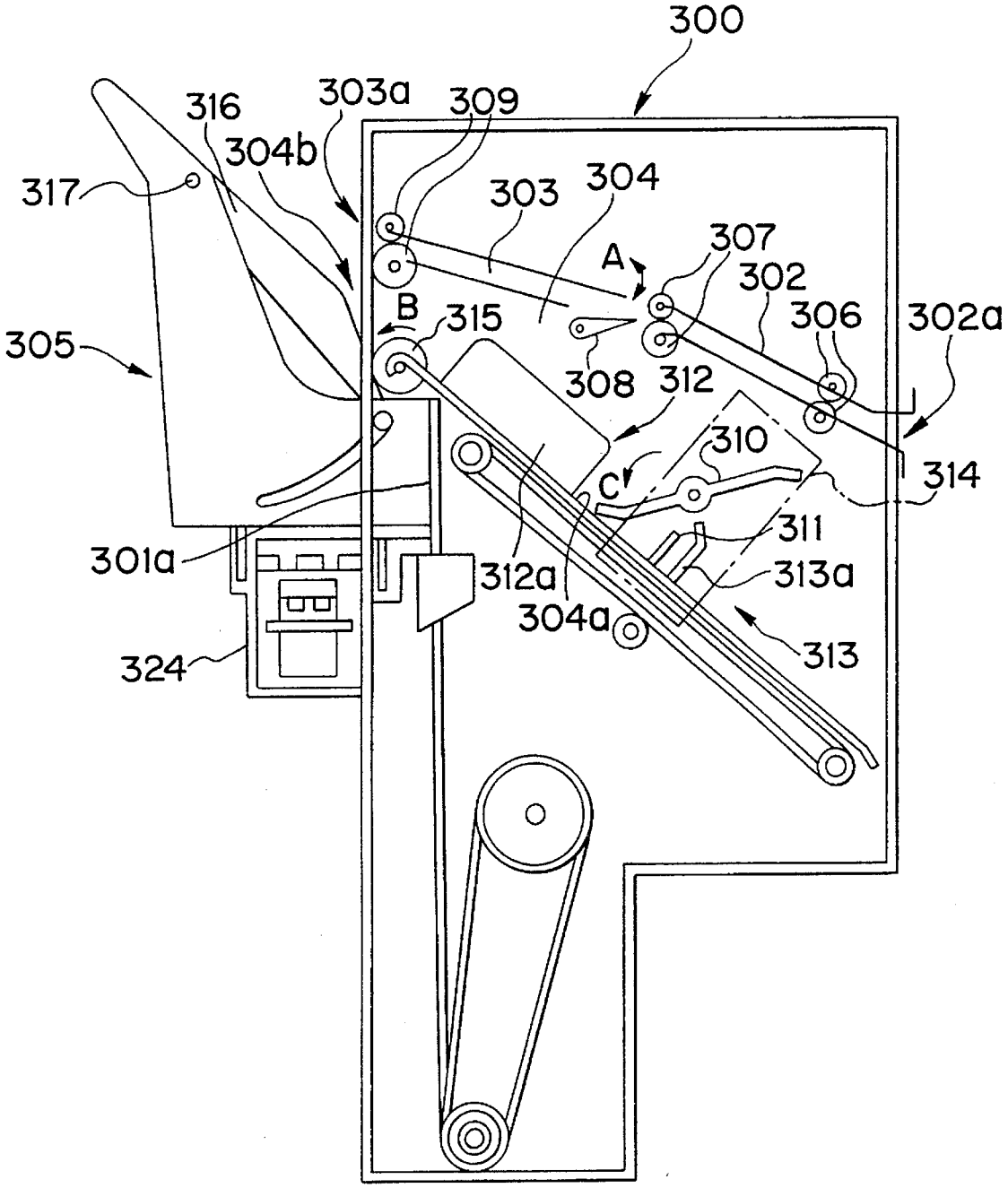

As shown in FIG. 22, a sheet post-processing apparatus 300 of the present embodiment is provided with a transport path 302 for transporting sheets S from a copying machine main body 1 within the apparatus 300. At the output of the transport path 302, provided are a non-processing path 303 for discharging the sheets S through the transport path 302 without being processed onto a discharge tray 305, and a processing discharge path 304 for discharging processed sheets S, i.e., stapled sheets S transported through the processing transport path 302 onto the discharge tray 305.

At the input of the transport path 302, an entry opening 302*a* through which the sheets S are fed from the copying machine main body 1 and a pair of transport rollers 306 for transporting the sheets S are provided. At the output of the transport path 302, provided are a pair of transport rollers 307 for transporting the sheets S either to the non-processing discharge path 303 or to the processing discharge path 304, and a deflector 308 for switching a transport direction of the sheets S between the non-processing discharge path 303 and the processing discharge path 304.

The deflector 308 is provided so as to be freely rotatable, and normally, it is set in the stand-by position for transporting the sheets S from the transport path 302 to the non-processing path 303. When a processing mode, i.e., a staple mode is selected by the copying machine main body 1, the deflector 308 is rotated in a direction of an arrow A, so that the sheets S transported through the transport path 302 are fed into the processing discharge path 304.

The non-processing discharge path 303 is provided with a pair of discharge rollers 309 for discharging the sheets S from inside the sheet post-processing apparatus 300 to the discharge tray 305 and a discharge opening 303*a* for discharging the non-processed sheets S.

The processing discharge path 304 is provided with a stapler plate 304*a* (processing tray) for stacking thereon sheets S in order to carry out a predetermined post-process on the sheets S transported through the transport path 302, such as binding (stapling) the sheets S. The stapler plate 304*a* is inclined in a direction where the leading edge thereof is placed at a higher position than the trailing edge thereof in the transport direction of the sheets S so that the leading edge is placed in the vicinity of a discharge opening 304*b* for the processed sheets S.

The leading edges of the sheets S transported through the transport path 302 are temporarily discharged onto the discharge tray 305 through the discharge opening 304*b*. Thereafter, when the sheets S are entirely transported out of the transport path 302, the sheets S are dropped onto a stopper 311 provided on the stapler plate 304*a* by the dead weight of the sheets S. Then, the sheets S dropped to the stopper 311 are placed over the discharge tray 305 and the stapler plate 304*a*.

On the stapler plate 304*a*, provided is a paddler 310. The paddler 310 is rotated in a direction of C while the lower end of a blade section thereof is being in contact with an upper surface of the stapler plate 304*a* so as to move the sheets S backward until the trailing edges of the sheets S come in contact with the stopper 311 and the paddler 308 also supports the sheets S being dropped to the stopper 311.

Above the stapler plate 304*a*, provided is a side aligner unit 312 for aligning the sheets S stacked on the stapler plate 304*a* in a widthwise direction of the sheets S. The side aligner unit 312 is provided with a positioning plate (not shown) which is fixed on one side of the stapler plate 304*a* in a widthwise direction and a side aligning plate 312*a* which is driven in a widthwise direction of the stapler plate 304*a*. More specifically, the side aligning plate 312*a* is moved toward the positioning plate by the side aligner unit 312 so as to align the sheets S placed on the stapler plate 304*a* in a widthwise direction. The side aligner unit 312 drives and controls the side aligning plate 312*a* according to the width of the sheets S placed on the stapler plate 304*a* by a control device 330 (to be described later).

At the back of the side aligning unit 312, a stapler 314 (post-processing means) for binding a corner of the sheets S aligned in both transport and widthwise directions.

At the back of the stapler plate 304*a*, a push-out unit 313 is provided for pushing out the sheets S toward the discharge tray 305. The push-out unit 313 is provided with a pusher 313*a* (sheet push-out member) for pushing out the sheets S onto the stapler plate 304*a* to the discharge tray 305. The pusher 313*a* is movable between a position in the vicinity of the discharge opening 304*b* and a retreat position, i.e, a standby position while the sheets are being processed by the stapler 314. Namely, the pusher 313*a* can be moved to the upstream of the stapler plate 304*a* in a sheet discharge direction, and is driven and controlled by a control device 330 (to be described later).

In the vicinity of the discharge opening 304*b* of the stapler plate 304*a*, provided is a aligning roller 315. The aligning roller 315 is rotated in a direction of an arrow B so as to transport the sheets S discharged onto the discharge tray 305 toward an aligner plate 301*a* formed on a contact face between the discharge tray 305 and the sheet post-processing unit 300, thereby aligning the edges of the sheets S.

Figure 23:
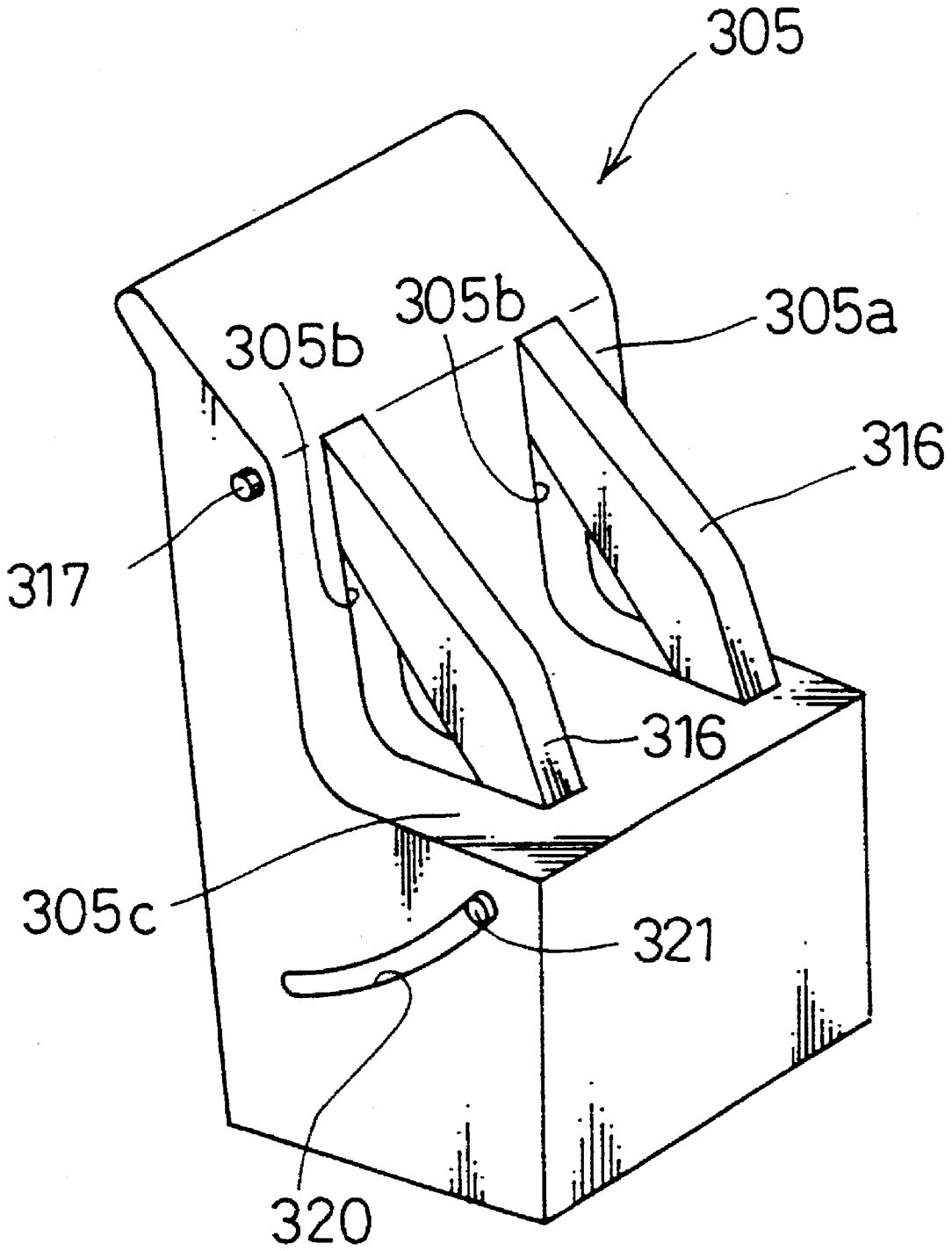
Figure 24:
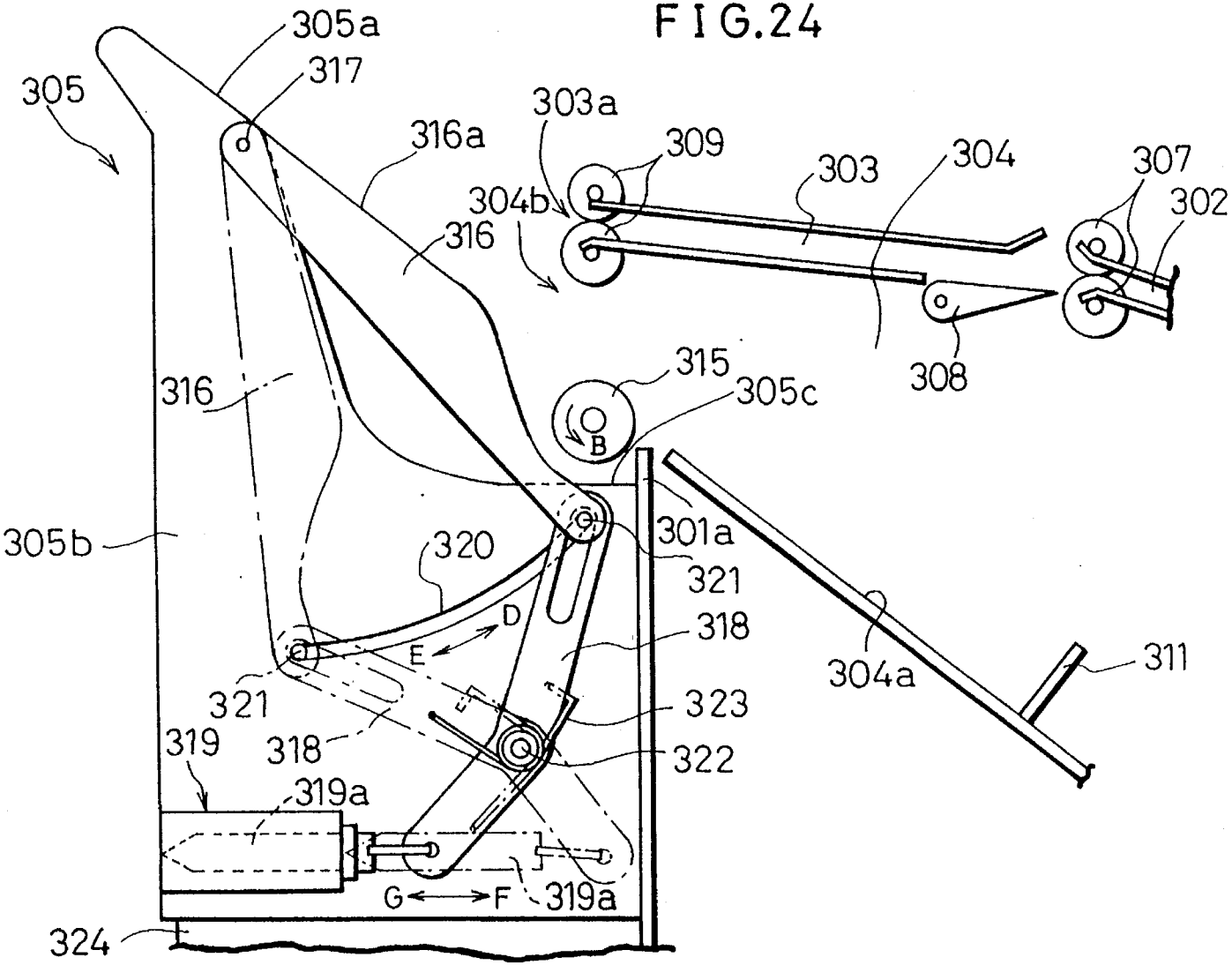
Figure 25:
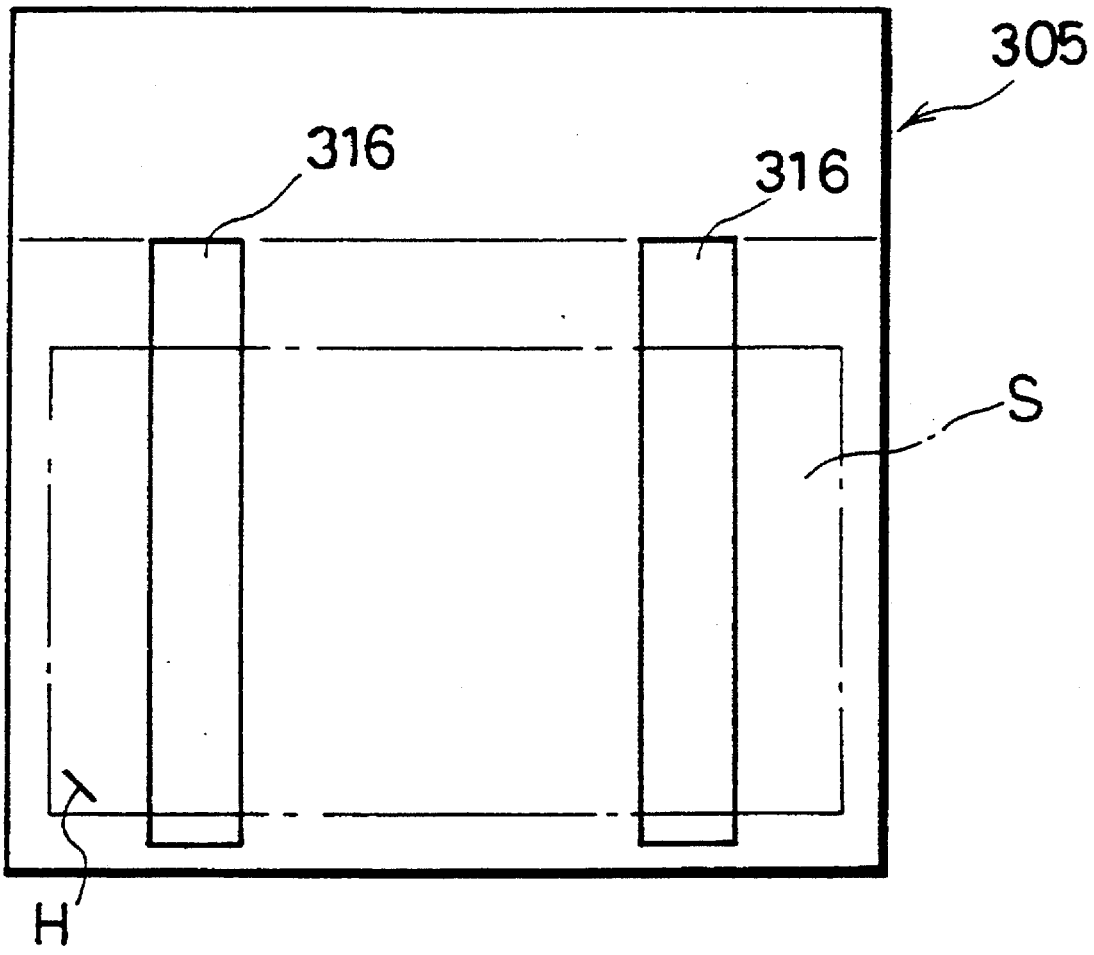

As shown in FIG. 23 and FIG. 24, the discharge tray 305 is provided with a sheet receiving face 305*a* which is recessed from a virtual surface extended from the upper surface, and a horizontal face 305*c* formed on the sheet receiving face 305*a* on the side of the aligner plate 301*a*.

As shown in FIG. 23, in the discharge tray 305, slots 305*b* are formed on the side of the sheet receiving face 305*a* and auxiliary trays 316 are formed so as to be freely come in and out of the respective slots 305*b*. As shown in FIG. 24, one end of each auxiliary tray 316 is connected to the discharge tray 305 by a support shaft 317 so as to be swingable and the other end of the auxiliary tray 316 is connected to one end of a connecting member 318. At a connecting section between the auxiliary tray 316 and the connecting member 318, provided is a pin 321 which is slidable along the slot 320 formed in the side face 305*b* of the discharge tray 305. With the sliding movement of the pin 321 along the slot 320, the auxiliary tray 315 is controlled so as to come into the lower limit position to come out to the upper limit position. Namely, a movement of an upper face 316*a* of the auxiliary tray 316 from position on the virtual plane extended from the upper surface of the stapler plate 304*a* to a position on the sheet receiving face 305*a* of the discharge tray 305 is controlled.

The connecting member 318 is provided so as to be freely rotatable about a shaft 322, and a torsion spring 323 is provided on the shaft 322 so that the connecting member 318 is held at a position on a virtual plane extended from the upper surface of the stapler plate 304*a*. To the other end of the connecting member 318, connected is a solenoid 319, and the connecting member 318 which is pushed by driving the solenoid 319 is rotated in a direction of an arrow E.

Namely, when the solenoid 319 is set ON, a movable iron core 319*a* is moved in a direction of an arrow F, and the connecting member 318 is rotated in a direction of an arrow E against the force exerted from the torsion spring 322.

Therefore, when the discharge tray 305 is set in the staple mode position, the solenoid 319 is set OFF so as to hold the upper face 316*a* on the auxiliary tray 316 on a virtual plane extended from the upper surface of the stapler plate 304*a* by the torsion spring 322. On the other hand, when the discharge tray 305 is set in the offset mode position, the solenoid 319 is set ON so as to move the upper face 316*a* of the auxiliary tray 316 to a position coming in the sheet receiving face 305*a* of the discharge tray 305 by moving the movable iron core 319*a* in a direction of an arrow F and to uniformly align the trailing edges of the sheets to the aligner plate 301*a* by a horizontal section 305*c* formed at the lower portion of the discharge tray 305.

The discharge tray 305 is raised by the tray elevator unit 324 so that the sheets S stacked on the discharge tray 305 are in an appropriate contact with the aligning roller 315. In this arrangement, the discharge tray 305 appropriately supports the processed sheets S to be discharged thereto through the discharge opening 304*b* and non-processed sheets S to be discharged thereto through the discharge opening 303*a*.

In the discharge tray 305, the auxiliary trays 316 are placed at a position slightly displaced from a stapled section H of the complete set S so that the stapled section H is not in contact with the auxiliary tray 316 as shown in FIG . 25. Therefore, even when a predetermined number of complete sets S are stacked on the discharge tray 305, the stapled sections H can be prevented from being more bulky than the non-stapled section of the complete sets S, and the upper surface of the sheets S can be always maintained flat.

Figure 26:
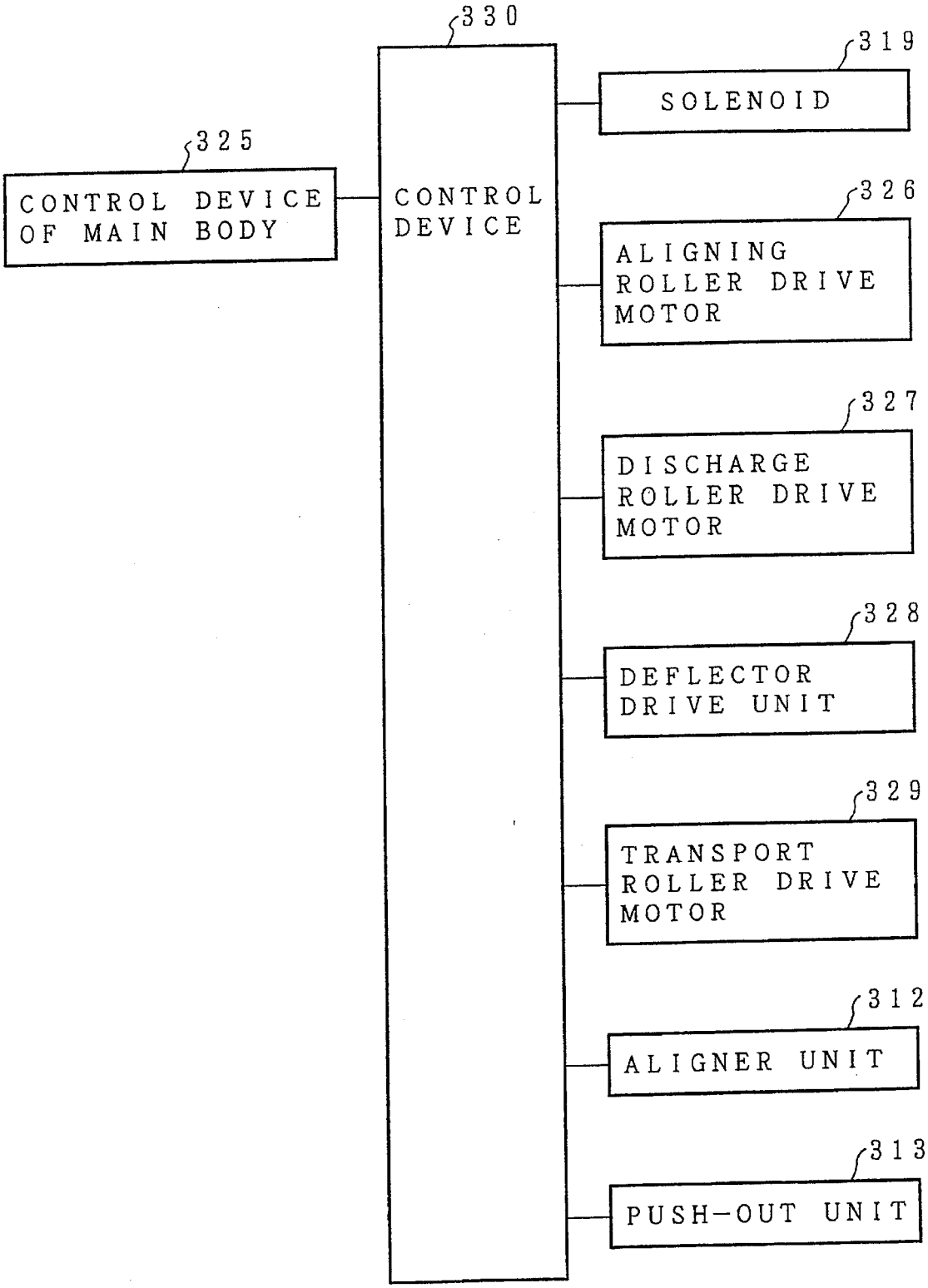

As shown in FIG. 26, the sheet post-processing apparatus 300 of the present embodiment is provided with the control device 330 for controlling the solenoid 319, the aligning roller drive motor 326, the discharge roller drive motor 327, the deflector drive unit 328 for driving the deflector 308, the transport roller drive motor 329, the aligner unit 312, the push-out member 313, etc., based on an input signal, etc., from the control device 325 of the copying machine main body 1. The control device 330 is composed of a memory device, and a micro computer provided with a counter, timer, etc. The control device 330 controls each of the above members according to the mode selected among the offset mode, staple single mode, the staple multiple mode, etc., in manners to be described later.

In the above arrangement, the operation of the discharge tray 305 of the sheet post-processing apparatus 300 will be explained below in reference to FIG. 24.

If an offset mode is selected in the copying machine main body 1, the solenoid 319 is set ON by the control device 300, and the movable iron core 319*a* is driven in a direction of an arrow F. With the above operation, the connecting member 318 which is pushed in an direction of an arrow E is rotated in a direction of an arrow E, and the auxiliary tray 316 is moved until the upper surface 316*a* thereof is on the sheet receiving face 305*a* of the discharge tray 305.

Then, the sheets S discharged through the discharge opening 303*a* in order are aligned on the sheet receiving face 305*a* of the discharge tray 305 by making the trailing edges thereof in contact with the aligner plate 301*a* by the aligning roller 315. Then, after discharging a predetermined number of sheets S, the apparatus is set in the standby state for the copy operation.

Next, when the mode is switched from the offset mode to the staple single mode or to the staple multiple mode, the solenoid 319 is set OFF by the control device 330, and the movable iron core 319*a* is moved in an direction of an arrow G by being pushed by the torsion spring 323. With this movement of the movable iron core 319*a*, the connecting member 318 is rotated in a direction of an arrow D, and the auxiliary tray 316 is moved until the upper surface 316*a* thereof is set on a virtual plane extended from the stapler plate 304*a*, i.e., the auxiliary tray 316 is moved to the position shown by an alternate long and shaft dash line in FIG. 25, and the auxiliary tray 316 is held at the position.

Then, the sheets S discharged through the transport path 302 are placed over the auxiliary tray 316 and the stapler plate 304*a*, and when a predetermined number of sheets S is placed, a stapling process is carried out by the stapler 314. Then, stapled sheets are discharged onto the discharge tray 305 by the push-out unit 313. Here, if the selected mode is the single staple mode, the apparatus is set in the standby position for the copy operation, and if the selected mode is the multiple staple mode, the apparatus is set in the standby state for the copy operation after a predetermined complete sets S are discharged.

As described, the sheet post-processing apparatus 300 of the present embodiment is arranged so as to change the shape of the sheet receiving face 305*a* of the discharge tray 305 according to the mode selected between the offset mode and the staple mode.

As shown in FIG. 24, in the offset mode, the upper face 316*a* of the auxiliary tray 316 is moved to the sheet receiving face 305*a* of the discharge tray 305. Therefore, the sheet receiving face 305*a* includes the horizontal section 305*c*. With the above arrangement, as the trailing edges of the sheets S can be aligned irrespectively of the rigidity of the sheets S, the sheets S can be more desirably stacked on the discharge tray 305.

Additionally, in the staple mode, the upper surface 316*a* of the auxiliary tray 316 is held on a virtual plane extended from the stapler plate 304*a*, and the stapler plate 304*a* is inclined at the same angle as the sheet receiving face 305*a* of the discharge tray 305. Moreover, the sheets S transported through the sheet transport path 302 can be surely dropped to the stopper 311 without having the leading edges of the sheets S transported through the processing path dangled on the discharge tray 305.

As a result, an undesirable alignment of the sheets S on the stapler plate 304*a* can be reduced, and a post-processing can be carried out without the necessity of repeating the aligning process due to the undesirable alignment of the sheets S, thereby more efficiently processing the sheets S. Moreover, irrespectively of the mode selected between non-processing mode and processing mode, a thin sheet (60 g/m$^2$) or a thick sheet (85 g/m$^2$) can be processed without problem.

In the present embodiment, the solenoid 319 is used as means for driving the auxiliary tray 316. However, the present invention is not limited to this. For example, drive means which is a combination of a generally used motor and a drive gear may be used as well.

As described, the sheet post-processing apparatus of the present invention includes: a processing tray being inclined; post-processing means for post-processing sheets stacked on the processing tray; a discharge tray being provided with a sheet receiving face which is inclined at a same angle as the processing tray, for placing thereon discharged sheets, and is recessed from a virtual plane extended from an upper surface of the processing tray; a horizontal section formed on a trailing edge of the sheet receiving face on a side of the processing tray; an auxiliary tray provided so as to be freely coming in and out of the sheet receiving face, the auxiliary tray being selectively moved between a position at which an upper surface thereof is on the virtual plane and a position at which the upper surface thereof is connected to and is on a plane extended from the sheet receiving face, and an auxiliary tray drive means for driving the auxiliary tray; and control means for controlling the auxiliary tray drive means such that in the processing mode the upper surface of the auxiliary tray is on the virtual plane, while in the non-processing mode, the upper surface of the auxiliary tray is on the sheet receiving face.

According to the above arrangement, in the processing mode, as the sheet receiving face of the discharge tray is inclined at the same angle as the processing tray, sheets transported through the processing path can be surely dropped onto an output of the processing tray in a sheet discharge direction, thereby reducing a time required for aligning the sheets. As a result, sheets can be post-processed more efficiently. Moreover, in the non-processing mode, as the sheet receiving face of the discharge tray includes a horizontal section on the side of the processing tray, irrespectively of the rigidity of the sheets discharged onto the discharge tray, the trailing edges of the sheets can be easily aligned. As a result, the sheets can be more desirably stacked on the discharge tray. Moreover, as the user can take out the discharged sheets without the necessity of realignment of the sheets, an operation efficiency of a post-processing of the sheets can be improved. Furthermore, irrespectively of the mode selected between non-processing mode and the processing mode, a thin sheet (60 g/m$^2$) and a thick sheet (85 g/m$^2$) can be processed, which cannot be processed in the conventional post-processing apparatus.

[EMBODIMENT 9]

The following description will discuss still another embodiment of the present invention in reference to FIG. 27 through FIG. 32. For convenience, members having the same function as in the previous embodiments will be designated by the same codes and the descriptions thereof shall be omitted here.

Figure 27:
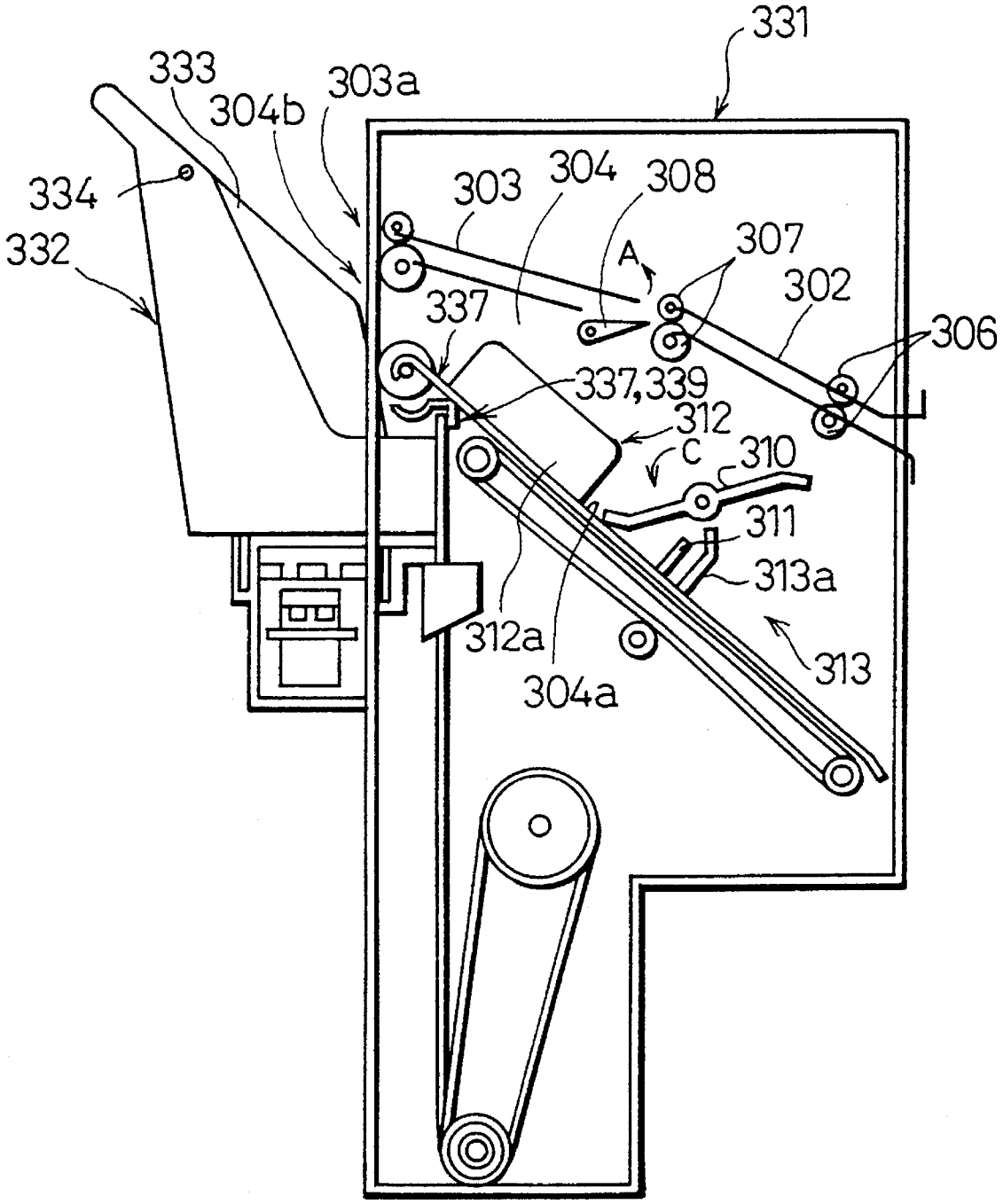

As shown in FIG. 27, a sheet post-processing apparatus 331 of the present embodiment is provided with a discharge tray 332 in replace of the discharge tray 315 of the sheet post-processing apparatus 300 of FIG. 22. Other than the above, the sheet post-processing apparatus 331 of the present embodiment has the same configuration as that of the described embodiment 8.

Figure 28:
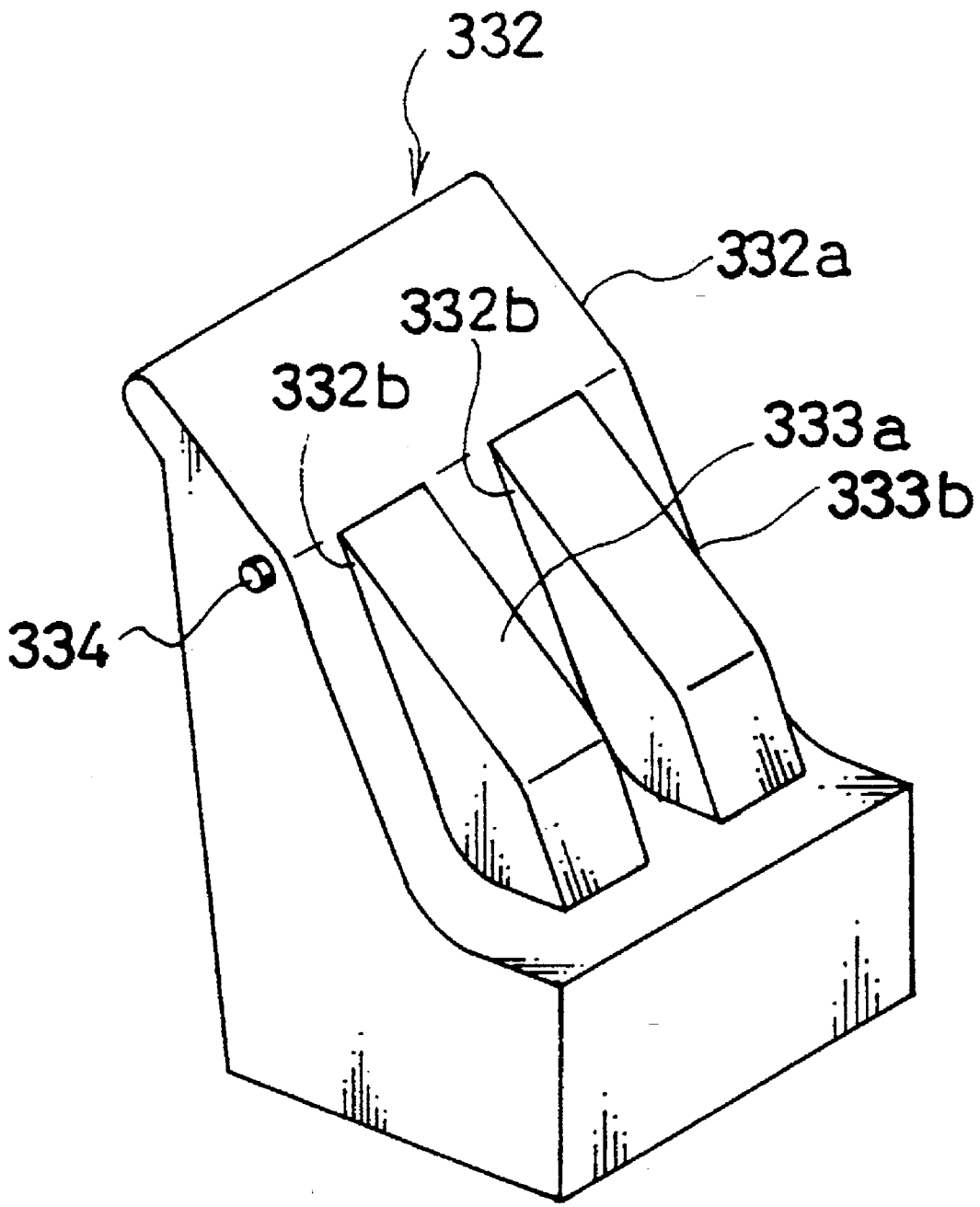
Figure 29:
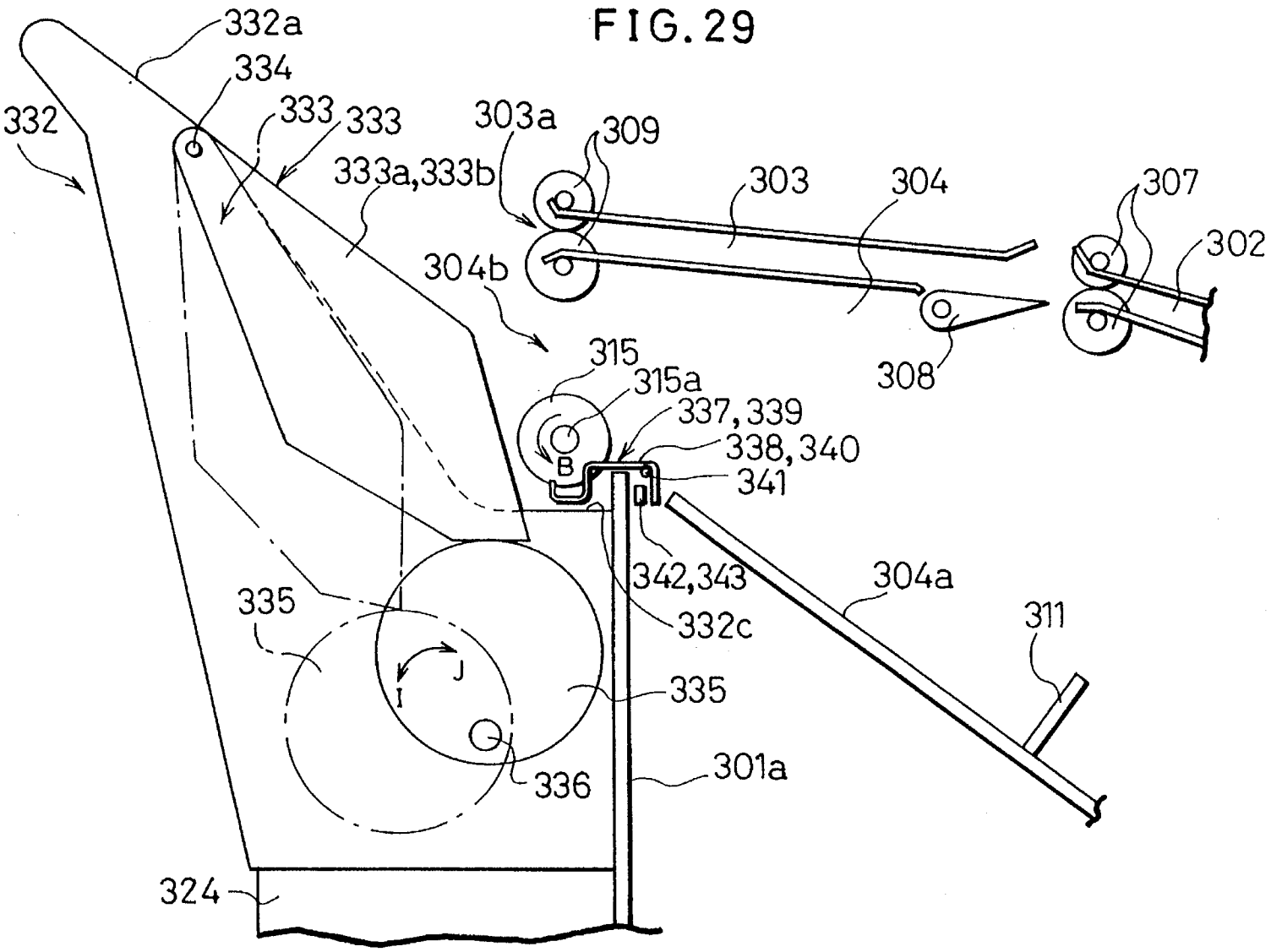

As shown in FIG. 28 and FIG. 29, the discharge tray 332 includes a sheet receiving face 332*a* formed so as to be recessed from a virtual plane extended from an upper surface of a stapler plate 304*a*, and a horizontal section 332*c* formed on an aligner plate 301*a* side of the sheet receiving face 332*a*.

As shown in FIG. 28, the discharge tray 332 is provided with an auxiliary tray 333 composed of first and second auxiliary trays 333*a* and 333*b* which can be freely coming in and out of slots 332*b* formed on the sheet receiving face 332*a*. As shown in FIG. 29, the auxiliary tray 333 is arranged such that one end thereof is supported by the discharge tray 332 so as to freely swing, and the other end thereof is in contact with an eccentric cam 335.

The auxiliary tray 333 is moved between a position at which an upper surface thereof is on the virtual plane extended from the upper surface of the stapler plate 304*a* and a position at which the upper surface thereof is on the upper surface of the sheet receiving face 332*a* of the discharge tray 332 by rotating the eccentric cam 335.

Figure 32:
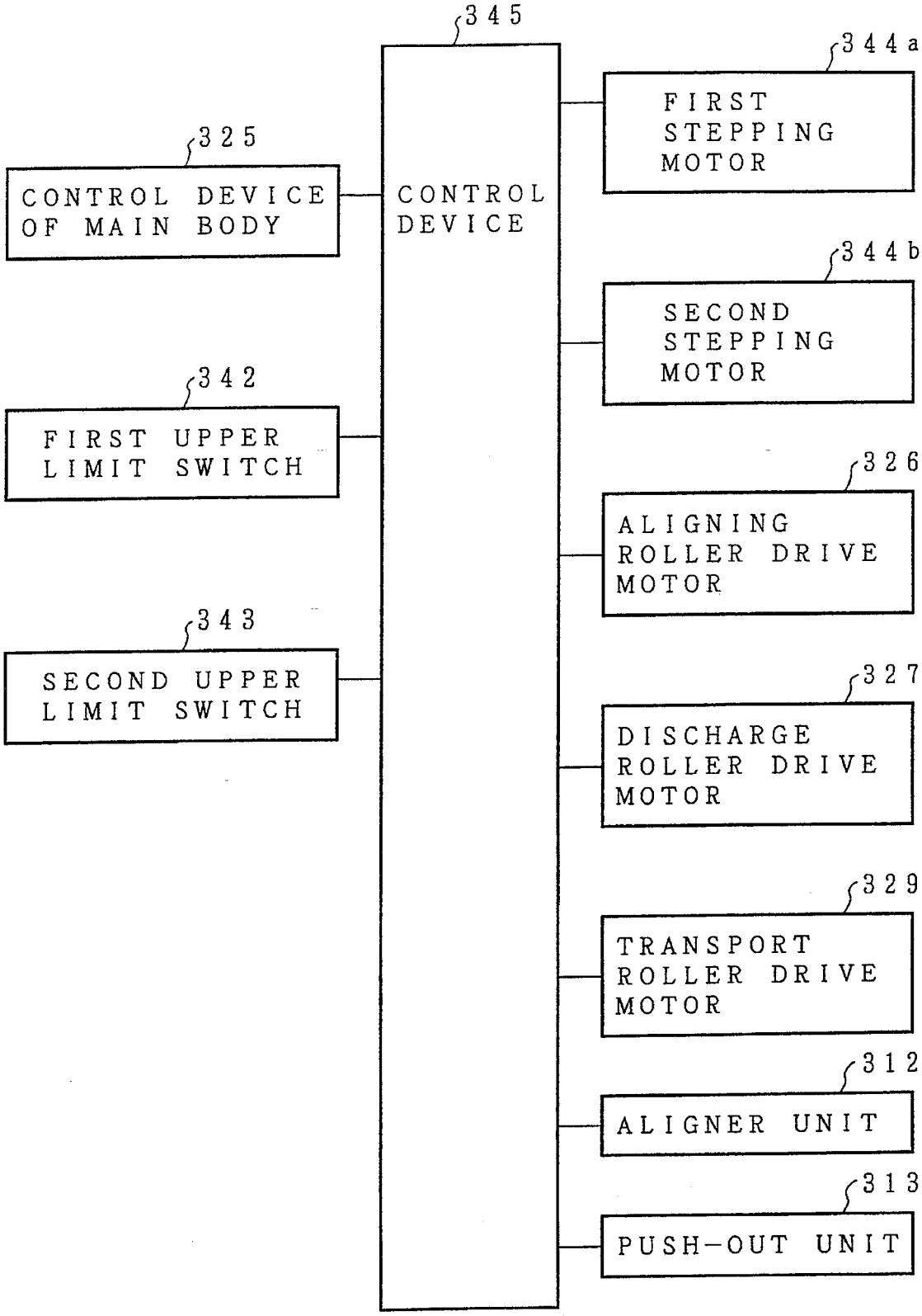
Figure 33:
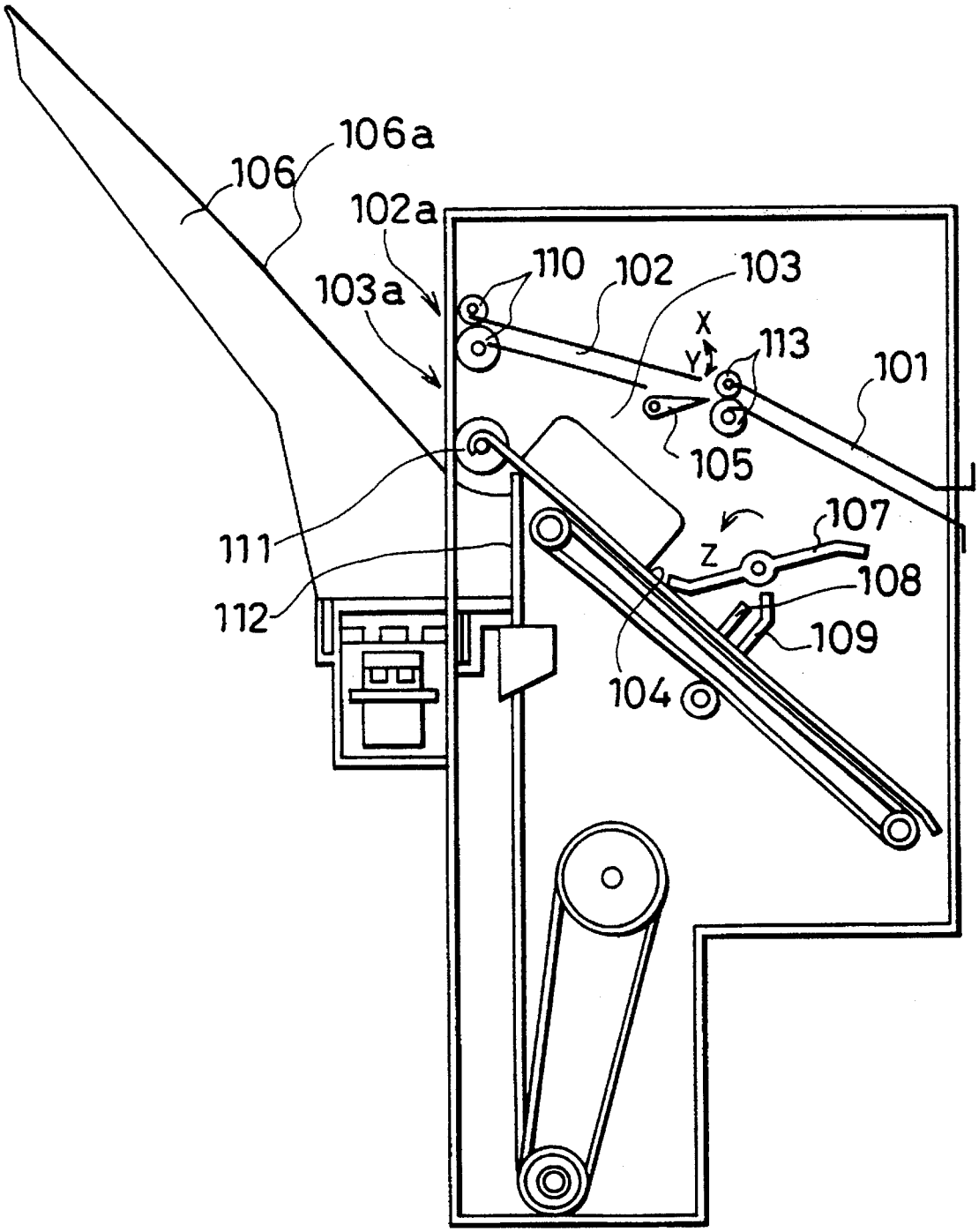
FIG.33 PRIOR ART
FIG. 33 through FIG. 35 show prior art.
Figure 34A:
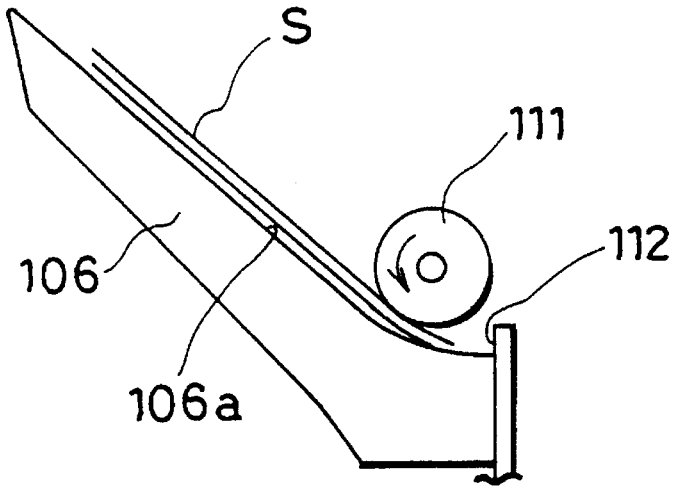
FIG.34(a) PRIOR ART
Figure 34B:
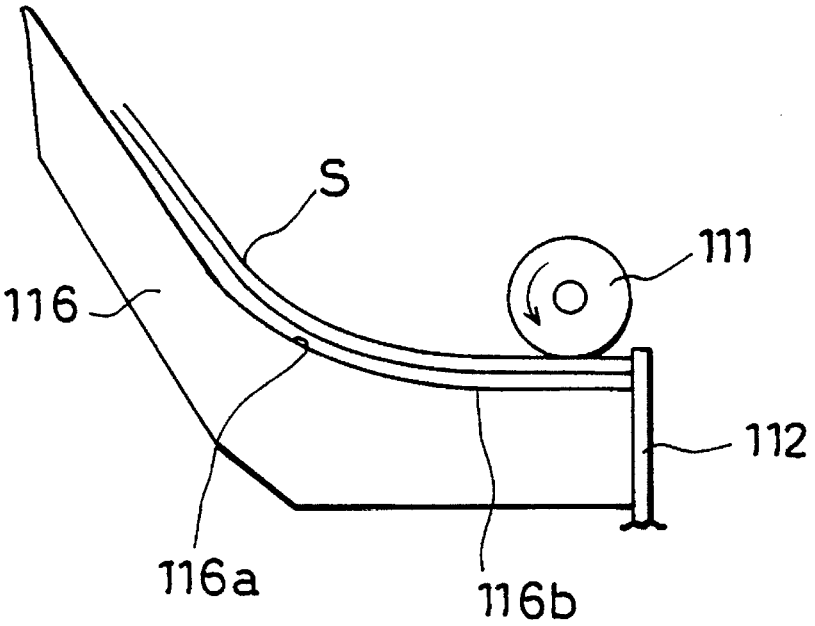
FIG.34(b) PRIOR ART
Figure 35:
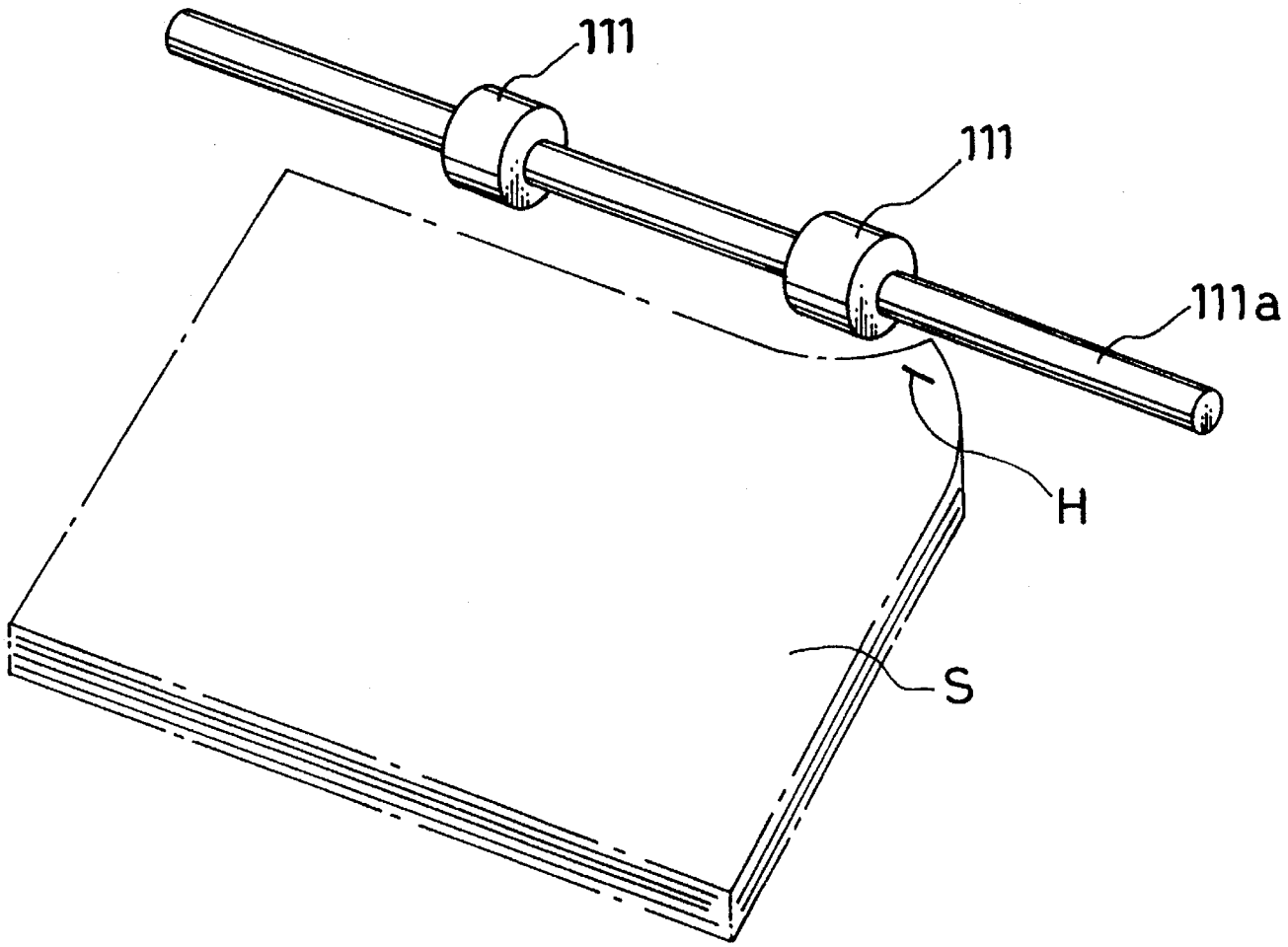
FIG. 35 PRIOR ART

The eccentric cam 335 is supported by a driving axis 336 connected to a stepping motor 344 (driving means) shown in FIG. 32 so that the rotation of the eccentric cam 335 can be controlled by a number of steps. Therefore, an amount of movement of the auxiliary tray 333 can be controlled by a number of steps stored in a control device 345 (to be described later) beforehand. Namely, an movement of the auxiliary tray 333 from a position at which the upper surface thereof is on the virtual plane extended from the upper surface of the stapler plate 304*a* to a position at which the upper surface thereof is on the upper surface of the sheet receiving face 332*a* of the discharge tray 332 can be controlled by the number of steps.

The eccentric cam 335 and the stepping motor 344 are provided separately so as to drive and control the first and second auxiliary trays 333*a* and 333*b* of the auxiliary tray 333 separately.

As shown in FIG. 29, in a vicinity of the support shaft 315*a* for supporting the aligner roller 315, provided are first and second tray upper limit detectors 337 and 339 (tray upper limit detection means) for detecting the discharge tray 332 raised to the upper limit position, i.e., for detecting a position at which the aligner roller 315 is in appropriate contact with either the upper surface of the discharge tray 332 or a sheet S placed on the discharge tray 332.

The first tray upper limit detector 337 is provided with a first actuator 338 which can freely swing about a support pin 341 (fulcrum) and a first upper limit switch 342, for example, of an optical system, which is to be switched ON/OFF by one end of the swingable first actuator 338. Similarly, the second tray upper limit detector 339 is provided with the second actuator 340 which is swingable about the support pin 341, and the second upper limit switch 343.

Figure 30:
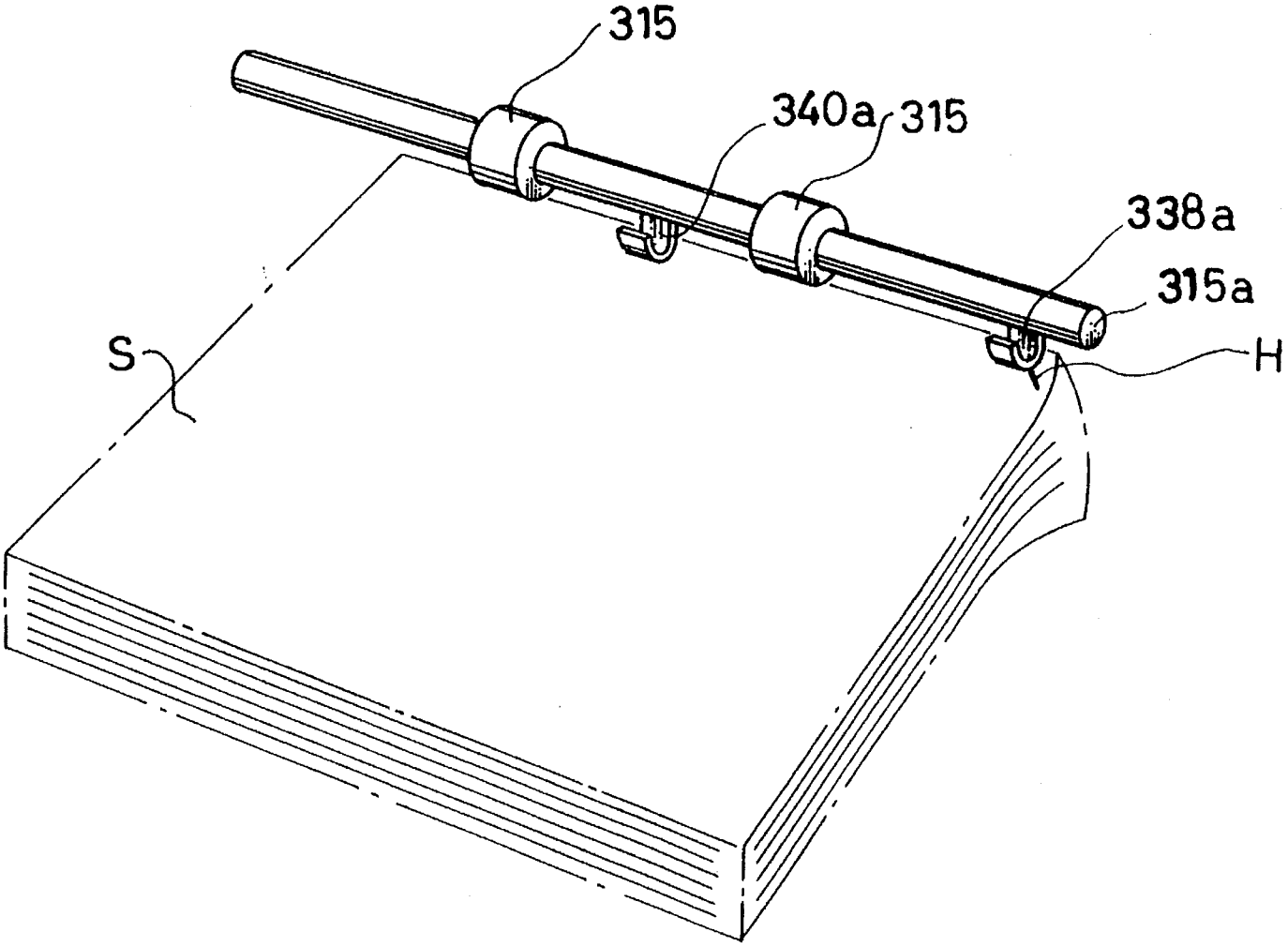

The other ends of the first and second actuators 338 and 340, provided are semicircular first and second contact sections 338*a* and 340*a* along a circumference of the support shaft 315*a*. As shown in FIG. 30, the first contact section 338*a* is placed at a position in contact with a vicinity of a stapled section H of discharged sheets S, and the second contact section 340*a* is in contact with the non-stapled section of sheets S. Additionally, the respective contact faces of the first and second contact sections 338*a* and 340*a* are set at the same height from the horizontal section 332*c* of the discharge tray 332. In this state, the first and second upper limit switches 342 and 343 are set ON.

Figure 31:
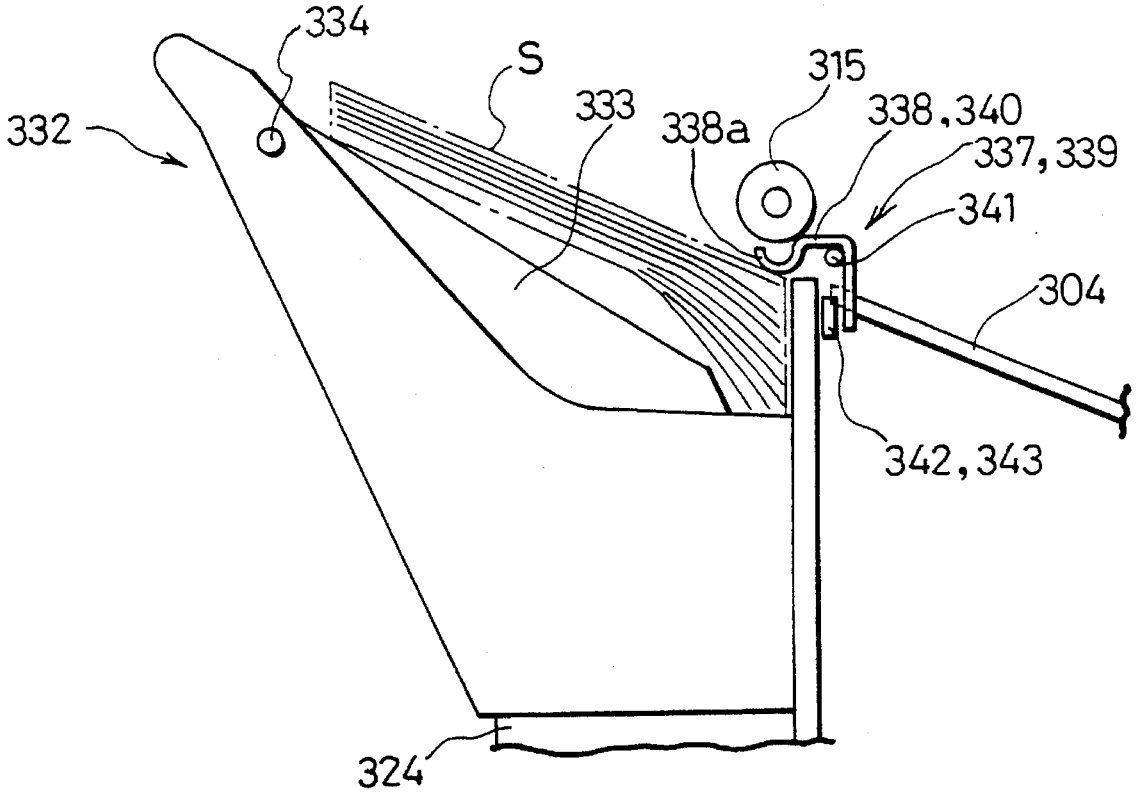

In the above arrangement, the first upper switch 342 is activated in connection with the first auxiliary tray 333*a*, and the second upper limit switch 343 is activated in connection with the second auxiliary tray 333*b*. Therefore, the first and second auxiliary trays 333*a* and 333*b* are driven by the stepping motor 344 so as to switch ON the first and second upper limit switches 342 and 343 respectively. Namely, the first and second auxiliary trays 333*a* and 333*b* are driven until the first and second upper limit switches 342 and 343 are switched ON, thereby maintaining an upper surface of the sheets S placed on the discharge tray 322 flat as shown in FIG. 31.

As shown in FIG. 32, the sheet post-processing apparatus 331 of the present embodiment is provided with a control device 345 for controlling respective operations of the first stepping motor 344*a*, the second stepping motor 344*b*, the aligning roller drive motor 326, the discharge roller drive motor 327, etc., based on input signals from the first upper limit switch 342, the second upper limit switch 343, the control device 325 of the copying machine main body, etc. The control device 345 is composed of a microcomputer provided with a memory device, counter, timer, etc., and controls each of the above members according to the mode selected among the offset mode, staple single mode, staple multiple mode, etc., in the copying machine main body.

In the above arrangement, operations of the discharge tray 332 of the sheet post-processing apparatus 311 will be explained below in reference to FIG. 29 through FIG. 31.

If the offset mode is selected in the copying machine main body, the control device 345 drives the first and second stepping motors 344*a* by a number of steps stored therein beforehand, and drives the first and second eccentric cams 335*a* and 335*b* in a direction of an arrow I, and then move the first and second auxiliary trays 333*a* and 333*b* to a position at which the upper surfaces thereof coincide with the sheet receiving face 332*a* of the discharge tray 332.

Then, the sheets S discharged through the non-processed sheet discharge opening 303*a* are stacked on the discharge tray 332. Here, the discharge tray 332 is moved by the tray elevator unit 324 until both the first and second upper limit switches 342 and 343 are set ON, thereby maintaining the upper surface of the sheets S in an appropriate contact with the aligning roller 315. Then, the sheets S are moved until the trailing edge of each sheet S comes in contact with the aligner plate 301*a* by the aligning roller 315, thereby aligning the trailing edges of the sheets S.

On the other hand, when a staple single mode or a staple multiple mode is selected in the copying machine main body 1, the control device 345 drives the first and second stepping motor 344*a* and 344*b* by a number of steps stored therein beforehand, and drives the first and second eccentric cam 335*a* and 335*b* in a direction of an arrow J, and then move the first and second auxiliary trays 333*a* and 333*b* to a position at which the upper surfaces thereof coincide with the virtual plate extended from the upper face of the stapler plate 304*a*.

Thereafter, the sheets S transported through the transport path 302 are placed over the auxiliary tray 333 and the stapler plate 304*a*, and after a predetermined number of sheets are placed, a stapling process is carried out by the stapler 314. Then, the sheets S are pushed out by the push-out unit 313 onto the discharge tray 332.

In the case of the staple single mode, after one complete set S is discharged, the apparatus is set in a standby state for the next copy operation. In the case of the staple multiple mode, the described processes are repeated until a predetermined number of complete sets S is discharged onto the discharge tray 332. As shown in FIG. 31, in the discharge operation of the complete sheets S, the upper surface of the discharged complete set S is detected by the first and second upper limit detection switches 342, 343, and the first and second auxiliary trays 333*a* and 333*b* are raised until both the upper limit switches 342 and 343 are switched ON. Then, while maintaining the upper surface of the complete set S flat, the discharge tray 332 is lowered until a predetermined number of complete sheets S is discharged by the tray elevator unit 324.

As described, in the arrangement of the sheet post-processing apparatus 331, the shape of the sheet receiving face 332*a* of the discharge tray 332 is changed according to the mode selected between the offset mode and the staple mode.

Therefore, in the offset mode, since the auxiliary tray 333 is held at the position where the upper surface thereof is connected to and on a plane extended from the sheet receiving face 332*a* of the discharge tray 332, the sheet receiving face 332*a* has a horizontal section 332*c*. As a result, irrespectively of the qualities of the sheets S including rigidity, thickness, etc., the trailing edges of the sheets S can be more desirably aligned and stacked on the discharge tray 332.

In the staple single mode and the staple multiple mode, the auxiliary tray 333 is held at the position where the upper surface thereof is on the virtual plane extended from the upper surface of the stapler plate 304*a*. Therefore, the sheets S transported through the transport path 302 can be surely dropped to the stopper 311 without dangling to the side of the discharge tray 332. In the above arrangement, an undesirable alignment of the sheets S on the stapler plate 304*a* can be eliminated, and post-processes can be carried out without realigning the sheets S due to the above problem of undesirable alignment. As a result, the operation efficiency of the sheet post-processing can improved.

As shown in FIG. 30 and FIG. 31, in the staple multiple mode, the auxiliary tray 333 is driven so that both the first and second upper limit switches 342 and 343 are set ON, thereby maintaining the upper surface of the complete set S flat.

In the above arrangement, as the complete set S can be prevented from contacting or being caught by the aligning roller 315 or the support shaft 315*a* thereof due to the bulkiness, a greater number of complete sets S can be stacked, thereby increasing an amount of sheets to be stacked. As a result, sheets S can be post-processed more efficiently.

For example, in the sheet post-processing apparatus of the present embodiment, up to 500 complete sets of two sheets can be stacked, whereas in the conventional sheet post-processing apparatus, only up to 100 complete sets can be stacked.

Moreover, since the upper surface of the complete set S stacked on the discharge tray 332 is always on a virtual plane extended from the upper surface of the stapler plate 304*a*, the sheets S discharged through the transport path 302 can be surely dropped to the stopper 311 provided the stapler plate 304*a*. As a result, the sheets S can be post-processed more efficiently.

As described, in the sheet post-processing apparatus of the present invention, the auxiliary tray is provided in such a position that it is not in contact with the processed section of the processed sheets discharged on the auxiliary tray.

Therefore, when a staple mode is selected as a processing mode, as the stapled section of the processed sheets discharged on the discharge tray can be prevented from being more bulky than the non stapled section of the processed sheets, a discharge process of the sheets and an alignment of the trailing edges of the discharged sheets can be carried out more easily, thereby achieving a desirable alignment of sheets, etc.

As described, the sheet post-processing apparatus of the present invention includes: a processing tray being inclined; post-processing means for post-processing sheets stacked on the processing tray; discharge tray having formed thereon a sheet receiving face, a horizontal section, an auxiliary tray and auxiliary tray drive means, the sheet receiving face being inclined at the same direction as the processing tray, for stacking thereon discharged sheets and being recessed from a virtual plane extended from an upper surface of the processing tray, the horizontal section being formed on a trailing edge of the sheet receiving face on a side of the processing tray, the auxiliary tray being provided so as to be freely coming in and out of the sheet receiving face and the auxiliary tray being selectively moved between a position at which an upper surface thereof is on the virtual plane and a position at which the upper surface thereof is on the sheet receiving face; first tray upper limit detection means for detecting an upper limit position of the discharge tray where the processed section of the upper surface of the top sheet placed on the sheet receiving face is set in a vicinity of a virtual plane including the sheet receiving face; second tray upper limit detection means for detecting an upper limit position of the discharge tray where a non-processed section of the upper surface of the top sheet placed on the sheet receiving face is set on a vicinity of a virtual plane including the sheet receiving face; and second control means for controlling the auxiliary tray drive means so as to drive the auxiliary tray such that detection signals from the first and second upper limit detection means are identical.

According to the above arrangement, in the processing mode, such as the staple mode, by controlling the auxiliary tray drive means such that the same detection signals are outputted from the first and second tray upper limit detection means, the surface of the top sheet on the discharge tray can be always maintained flat. Therefore, problems such as the sheets get stuck due to the bulkiness of the stapled section are not likely to occur. As a result, the post-process of sheets can be more efficiently carried out.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. A sheet post-processing apparatus, comprising:

a processing tray for stacking thereon sheets to be post-processed;

post-processing means for carrying out a predetermined post-process on sheets stacked on said processing tray;

a discharge tray capable of selectively moving between a first discharge position at which processed sheets can be smoothly discharged and a second discharge position at which discharged non-processed sheets can be desirably aligned;

control means for controlling said discharge tray so as to be set in the first discharge position in a processing mode; and discharge means for moving the processed sheets along said processing tray to be discharged onto said discharge tray through a sheet discharge section and for discharging the non-processed sheets onto said discharge tray through the sheet discharge section wherein:

said sheet discharge section is composed of a first discharge section formed on a discharge end of said processing tray for discharging therethrough processed sheets and a second discharge section for discharging therethrough non-processed sheets.

2. A sheet post-processing apparatus comprising:

a processing tray being included;

a discharge tray being inclined in the same direction as said processing tray, for stacking thereon discharged sheets, said discharge tray being capable of selectively moving between a processing mode position corresponding to a processing mode and a non-processing mode position corresponding to a non-processing mode by adjusting an inclined angle and a height position thereof;

tray drive means for switching a position of said discharge tray between the processing mode position and the non-processing mode position by adjusting the inclined angle and the height position of said discharge tray;

post-processing means for post-processing sheets stacked on said processing tray;

discharge means for moving the processed sheets along said processing tray to be discharged onto said discharge tray through a sheet discharge section and for discharging the non-processed sheets onto said discharge tray through the sheet discharge section; and control means for controlling said tray drive means such that when the processing mode is selected in which the processed sheets are discharged by said discharge means, said discharge tray is set in the processing mode position, while when the non-processing mode is selected in which the non-processed sheets are discharged by said discharge means, said discharge tray is set in the non-processing mode position, wherein:

said sheet discharge section is composed of a first discharge section formed on a discharge end of said processing tray for discharging therethrough processed sheets and a second discharge section for discharging therethrough non-processed sheets.

3. The sheet post-processing apparatus as set forth in claim 2, wherein:

the processing mode position of said discharge tray in which sheets discharged through said first discharge section can be stacked is set such that an upper surface of said discharge tray is inclined substantially at a same angle as an upper surface of said processing tray and is placed on a virtual plane extended from the upper surface of said processing tray, while the non-processing mode position of said discharge tray in which sheets discharged through said second discharge section can be stacked is set such that the upper surface of said discharge tray is inclined at a greater angle than that in the processing mode position.

4. The sheet post-processing apparatus as set forth in claim 3, further comprising:

discharge tray elevator means for raising and lowering said discharge tray; and tray upper limit detection means for detecting a state where either an upper surface of said discharge tray or an upper surface of a top sheet placed on said discharge tray reaches an upper limit position for receiving discharged sheets, wherein said discharge tray includes a sheet stacking section for stacking thereof sheets, a recessed section is formed in a sheet stacking section of said discharge tray at a portion corresponding to a processed section of processed sheets discharged onto said sheet stacking section, and said control means drives said discharge tray elevator means such that said discharge tray is moved to a tray upper limit position to be detected by said tray upper limit detection means when discharging sheets onto said discharge tray.

5. A sheet post-processing apparatus comprising:

a processing tray being inclined;

a discharge tray being inclined in the same direction as said processing tray, for stacking thereon discharged sheets, said discharge tray being capable of selectively moving between a processing mode position corresponding to a processing mode and a non-processing mode position corresponding to a non-processing mode by adjusting an inclined angle and a height position thereof;

tray drive means for switching a position of said discharge tray between the processing mode position and the non-processing mode position by adjusting the inclined angle and the height position of said discharge tray;

post-processing means for post-processing sheets stacked on said processing tray;

discharge means for moving the processed sheets along said processing tray to be discharged onto said discharge tray through a sheet discharge section and for discharging the non-processed sheets onto said discharge tray through the sheet discharge section; and control means for controlling said tray drive means such that when the processing mode is selected in which the processed sheets are discharged by said discharge means, said discharge tray is set in the processing mode position, while when the non-processing mode is selected in which the non-processed sheets are discharged by said discharge means, said discharge tray is set in the non-processing mode position, wherein:

said discharge tray includes a sheet stacking section composed of a divisional section to be divided into a plurality of pieces in a sheet discharge direction wherein at least two of said plurality of pieces, whose surface angles can be adjusted, form a movable divisional section, and said drive means drives the movable divisional section.

6. The sheet post-processing apparatus as set forth in claim 5, wherein:

said sheet stacking section of said discharge tray is composed of:

a movable main section which constitutes an essential part of said sheet stacking section;

a fixed lower end section which constitutes a lower end portion of said sheet stacking section; and a movable upper connecting section and a movable lower connecting section which are provided between said movable main section and said fixed lower end section, and said movable main section, said movable upper connecting section and said movable lower connecting section constitute said movable divisional section.

7. The sheet post-processing apparatus as set forth in claim 6, wherein:

said movable main section includes a stacking main section provided at a center, and upper and lower bent pieces which are bent downward to said stacking main section.

8. The sheet post-processing apparatus as set forth in claim 7, wherein:

said movable main section is connected to said movable upper connecting section so as to be freely movable by inserting projected guide sections formed on said movable upper connecting section into two slots formed so as to be inclined in the same direction as said movable main section and to be extended in an oblique lifting direction, a lower end of said movable upper connecting section is connected to an upper end of said movable lower connecting section so as to be freely rotatable, and a lower end of said movable lower connecting section is connected to an upper end of said fixed lower end section so as to be freely rotatable.

9. The sheet post-processing apparatus as set forth in claim 8, wherein:

a plate-like supporting section is formed on a back surface of said movable main section, for supporting said movable upper connecting section by a lower end section of said plate-like supporting section, the lower end section being projected below said plate-like shape supporting section.

10. The sheet post-processing apparatus as set forth in claim 9, wherein said discharge tray includes:

a back plate provided on a side of a back surface of said sheet stacking tray, and a front side plate and a back side plate which are provided on the respective sides of said sheet stacking section and said back plate, and said fixed lower end section is fixed to said back side plate.

11. The sheet post-processing apparatus as set forth in claim 10, wherein:

two projected guide sections are formed on both sides of said movable main section, recessed guide sections are formed on respective inner faces of the front side plate and the back side plate in a lifting direction, opening sections are formed on the back plate, and said projected guide sections are respectively inserted into said recessed guide sections through the opening sections so as to be freely movable.

12. The sheet post-processing apparatus as set forth in claim 11, wherein:

in the non-processing mode, said projected guide sections of said movable main section are moved to the respective bottom ends of the recessed guide sections of said front side plate and said back side plate through the opening sections formed on said back plate, the projected guide sections of said movable upper connecting section are moved to the top ends of the slots of said movable main section, said sheet stacking section is lowered so that said discharge tray is set in the non-processing mode position, and said movable main section is inclined at a greater angle with respect to a horizontal direction than that in the processing mode position.

13. The sheet post-processing apparatus as set forth in claim 11, wherein:

in the processing mode, the projected guide sections of said movable main section are moved to top ends of the recessed guide sections of said front side plate and said back side plate, the projected guide sections of said movable upper connecting section are moved to bottom ends of the slots of said movable main section, said movable main section is moved upward and is slightly rotated upward about an upper portion thereof, said movable lower connecting section, said movable upper connecting section and said lower bent piece of said movable main section are aligned substantially on one straight line, an upper surface of the stacking main section of said sheet stacking section is set in the processing mode position at which the stacking main section is placed on a plane extended from the upper surface of said processing tray, and said movable main section is inclined at a smaller angle with respect to a horizontal direction than that in the non-processing mode position.

14. A sheet post-processing apparatus comprising:

a processing tray being inclined;

a discharge tray being inclined in the same direction as said processing tray, for stacking thereon discharged sheets, said discharge tray being capable of selectively moving between a processing mode position corresponding to a processing mode and a non-processing mode position corresponding to a non-processing mode by adjusting an inclined angle and a height position thereof;

tray drive means for switching a position of said discharge tray between the processing mode position and the non-processing mode position by adjusting the inclined angle and the height position of said discharge tray;

post-processing means for post-processing sheets stacked on said processing tray;

discharge means for moving the processed sheets along said processing tray to be discharged onto said discharge tray through a sheet discharge section and for discharging the non-processed sheets onto said discharge tray through the sheet discharge section; and control means for controlling said tray drive means such that when the processing mode is selected in which the processed sheets are discharged by said discharge means, said discharge tray is set in the processing mode position, while when the non-processing mode is selected in which the non-processed sheets are discharged by said discharge means, said discharge tray is set in the non-processing mode position, wherein said tray drive means includes:

a tray drive motor;

a drive member which is selectively moved between a processing mode position for moving a sheet stacking section of said discharge tray to the processing mode position and a non-processing mode position for moving said sheet stacking section of said discharge tray to the non-processing mode position by said tray drive motor; and tray position detection means for detecting a position to which said drive member is moved.

15. The sheet post-processing apparatus as set forth in claim 14, wherein said tray drive motor is a stepping motor.

16. The sheet post-processing apparatus as set forth in claim 14, wherein said drive member is composed of:

a first arm with one end thereof being supported by a main body of said discharge tray and the other end thereof being supported by a back surface of a sheet stacking section so as to be freely rotatable, said first arm being provided at a downstream in a sheet discharge direction; and a second arm with one end thereof being supported by the main body of said discharge tray and the other end thereof being supported by the back surface of said sheet stacking section, said second arm being provided at an upstream in the sheet discharge direction, said second arm being longer than said first arm, and said first and second arms are simultaneously moved to respective processing mode positions at which said first and second arms are upright to be substantially vertical to a plane including respective drive shafts for the first and second arms and are simultaneously moved to respective non-processing mode positions at which said first and second arms are fallen to be substantially parallel to the plane by moving a belt which is wound around both pulleys respectively provided on shaft support sections of said first and second arms by said drive motor.

17. A sheet post-processing apparatus comprising:

a processing tray being inclined;

a discharge tray being inclined in the same direction as said processing tray, for stacking thereon discharged sheets, said discharge tray being capable of selectively moving between a processing mode position corresponding to a processing mode and a non-processing mode position corresponding to a non-processing mode by adjusting an inclined angle and a height position thereof;

tray drive means for switching a position of said discharge tray between the processing mode position and the non-processing mode position by adjusting the inclined angle and the height position of said discharge tray;

post-processing means for post-processing sheets stacked on said processing tray;

discharge means for moving the processed sheets along said processing tray to be discharged onto said discharge tray through a sheet discharge section and for discharging the non-processed sheets onto said discharge tray through the sheet discharge section;

control means for controlling said tray drive means such that when the processing mode is selected in which the processed sheets are discharged by said discharge means, said discharge tray is set in the processing mode position, while when the non-processing mode is selected in which the non-processed sheets are discharged by said discharge means, said discharge tray is set in the non-processing mode position; and sheet detection means for detecting whether or not a sheet exists on said discharge tray, wherein said control means prohibits a mode switching operation for said discharge tray by said tray drive means when said sheet detection means detects that a sheet exists on said discharge tray.

18. A sheet post-processing apparatus comprising:

a processing tray being inclined;

a discharge tray being inclined in the same direction as said processing tray, for stacking thereon discharged sheets, said discharge tray being capable of selectively moving between a processing mode position corresponding to a processing mode and a non-processing mode position corresponding to a non-processing mode by adjusting an inclined angle and a height position thereof;

tray drive means for switching a position of said discharge tray between the processing mode position and the non-processing mode position by adjusting the inclined angle and the height position of said discharge tray;

post-processing means for post-processing sheets stacked on said processing tray;

discharge means for moving the processed sheets along said processing tray to be discharged onto said discharge tray through a sheet discharge section and for discharging the non-processed sheets onto said discharge tray through the sheet discharge section;

control means for controlling said tray drive means such that when the processing mode is selected in which the processed sheets are discharged by said discharge means, said discharge tray is set in the processing mode position, while when the non-processing mode is selected in which the non-processed sheets are discharged by said discharge means, said discharge tray is set in the non-processing mode position; and sheet detection means for detecting whether or not a sheet exists on said discharge tray, wherein said control means prohibits a mode switching operation for raising said discharge tray by said tray drive means when said sheet detection means detects that a sheet exists on said discharge tray.

19. A sheet post-processing apparatus comprising:

a processing tray being inclined;

a discharge tray being inclined in the same direction as said processing tray, for stacking thereon discharged sheets, said discharge tray being capable of selectively moving between a processing mode position corresponding to a processing mode and a non-processing mode position corresponding to a non-processing mode by adjusting an inclined angle and a height position thereof;

tray drive means for switching a position of said discharge tray between the processing mode position and the non-processing mode position by adjusting the inclined angle and the height position of said discharge tray;

post-processing means for post-processing sheets stacked on said processing tray;

discharge means for moving the processed sheets along said processing tray to be discharged onto said discharge tray through a sheet discharge section and for discharging the non-processed sheets onto said discharge tray through the sheet discharge section;

control means for controlling said tray drive means such that when the processing mode is selected in which the processed sheets are discharged by said discharge means, said discharge tray is set in the processing mode position, while when the non-processing mode is selected in which the non-processed sheets are discharged by said discharge means, said discharge tray is set in the non-processing mode position; and sheet detection means for detecting whether or not a sheet exists on said discharge tray, wherein said control means controls said tray drive means such that when said sheet detection means detects that a sheet exists on said discharge tray, a mode switching operation for said discharge tray is carried out at a lower speed than said sheet detection means detects that no sheets exist on said discharge tray.

20. A sheet post-processing apparatus comprising:

a processing tray being inclined;

a discharge tray being inclined in the same direction as said processing tray, for stacking thereon discharged sheets, said discharge tray being capable of selectively moving between a processing mode position corresponding to a processing mode and a non-processing mode position corresponding to a non-processing mode by adjusting an inclined angle and a height position thereof;

tray drive means for switching a position of said discharge tray between the processing mode position and the non-processing mode position by adjusting the inclined angle and the height position of said discharge tray;

post-processing means for post-processing sheets stacked on said processing tray;

discharge means for moving the processed sheets along said processing tray to be discharged onto said discharge tray through a sheet discharge section and for discharging the non-processed sheets onto said discharge tray through the sheet discharge section;

control means for controlling said tray drive means such that when the processing mode is selected in which the processed sheets are discharged by said discharge means, said discharge tray is set in the processing mode position, while when the non-processing mode is selected in which the non-processed sheets are discharged by said discharge means, said discharge tray is set in the non-processing mode position; and sheet detection means for detecting whether or not a sheet exists on said discharge tray, wherein said control means said tray drive means such that when said sheet detection means detects that a sheets exists on said discharge tray, a mode switching operation for raising said discharge tray is carried out at lower speed than a mode switching operation for lowering said discharge tray.

21. A sheet post-processing apparatus comprising:

a processing tray being inclined;

a discharge tray being inclined in the same direction as said processing tray, for stacking thereon discharged sheets, said discharge tray being capable of selectively moving between a processing mode position corresponding to a processing mode and a non-processing mode position corresponding to a non-processing mode by adjusting an inclined angle and a height position thereof;

tray drive means for switching a position of said discharge tray between the processing mode position and the non-processing mode position by adjusting the inclined angle and the height position of said discharge tray;

post-processing means for post-processing sheets stacked on said processing tray;

discharge means for moving the processed sheets along said processing tray to be discharged onto said discharge tray through a sheet discharge section and for discharging the non-processed sheets onto said discharge tray through the sheet discharge section;

control means for controlling said tray drive means such that when the processing mode is selected in which the processed sheets are discharged by said discharge means, said discharge tray is set in the processing mode position, while when the non-processing mode is selected in which the non-processed sheets are discharged by said discharge means, said discharge tray is set in the non-processing mode position; and sheet amount detection means for detecting an amount of sheets stacked on said discharge tray, wherein said control means prohibits a mode switching operation for said discharge tray by said tray drive means when said sheet amount detection means detects that more than a predetermined amount of sheets is stacked on said discharge tray.

22. A sheet post-processing apparatus comprising:

a processing tray being inclined;

a discharge tray being inclined in the same direction as said processing tray, for stacking thereon discharged sheets, said discharge tray being capable of selectively moving between a processing mode position corresponding to a processing mode and a non-processing mode position corresponding to a non-processing mode by adjusting an inclined angle and a height position thereof;

tray drive means for switching a position of said discharge tray between the processing mode position and the non-processing mode position by adjusting the inclined angle and the height position of said discharge tray;

post-processing means for post-processing sheets stacked on said processing tray;

discharge means for moving the processed sheets along said processing tray to be discharged onto said discharge tray through a sheet discharge section and for discharging the non-processed sheets onto said discharge tray through the sheet discharge section;

control means for controlling said tray drive means such that when the processing mode is selected in which the processed sheets are discharged by said discharge means, said discharge tray is set in the processing mode position, while when the non-processing mode is selected in which the non-processed sheets are discharged by said discharge means, said discharge tray is set in the non-processing mode position; and sheet amount detection means for detecting an amount of sheets stacked on said discharge tray, wherein said control means prohibits a mode switching operation for raising said discharge tray by said tray drive means when said sheet amount detection means detects that more than a predetermined amount of sheets is stacked on said discharge tray.

23. A sheet post-processing apparatus comprising:

a processing tray being inclined;

a discharge tray being inclined in the same direction as said processing tray, for stacking thereon discharged sheets, said discharge tray being capable of selectively moving between a processing mode position corresponding to a processing mode and a non-processing mode position corresponding to a non-processing mode by adjusting an inclined angle and a height position thereof;

tray drive means for switching a position of said discharge tray between the processing mode position and the non-processing mode position by adjusting the inclined angle and the height position of said discharge tray;

post-processing means for post-processing sheets stacked on said processing tray;

discharge means for moving the processed sheets along said processing tray to be discharged onto said discharge tray through a sheet discharge section and for discharging the non-processed sheets onto said discharge tray through the sheet discharge section;

control means for controlling said tray drive means such that when the processing mode is selected in which the processed sheets are discharged by said discharge means, said discharge tray is set in the processing mode position, while when the non-processing mode is selected in which the non-processed sheets are discharged by said discharge means, said discharge tray is set in the non-processing mode position; and sheet amount detection means for detecting an amount of sheets stacked on said discharge tray, wherein said control means controls said tray drive means such that a mode switching operation for said discharge tray is carried out at a speed according to an amount of sheets detected by said sheet amount detection means.

24. The sheet post-processing apparatus comprising:

a processing tray being inclined;

post-processing means for post-processing sheets stacked on said processing tray;

discharge tray having formed thereon a sheet receiving face, a horizontal face, an auxiliary tray and auxiliary tray drive means, said discharge tray being inclined in the same direction as said processing tray, for stacking thereon discharged sheets and being recessed from a virtual plane extended from an upper surface of said processing tray, said horizontal section being formed on a trailing edge of said sheet receiving face on a side of said processing tray, said auxiliary tray being provided so as to be freely coming in and out of said sheet receiving face and said auxiliary tray being selectively moved between a position at which an upper surface thereof is on the virtual plane and a position at which the upper surface thereof is on said sheet receiving face; and control means for controlling said auxiliary tray drive means such that in the processing mode, the upper surface of said auxiliary tray is on the virtual plane, while in the non-processing mode, the upper surface of said auxiliary tray is on the sheet receiving face.

25. The sheet post-processing apparatus as set forth in claim 24, wherein:

said auxiliary tray is provided in such a position that it is not in contact with a processed section of processed sheets discharged on said auxiliary tray.

26. The sheet post-processing apparatus as set forth in claim 24, wherein said processing tray includes aligning means for aligning sheets stacked on said processing tray in a widthwise direction.

27. The sheet post-processing apparatus as set forth in claim 26, wherein said aligning means includes a positioning plate which is fixed to one side of said processing tray in a widthwise direction and a width aligning plate which is moved in a widthwise direction of said processing tray.

28. The sheet post-processing apparatus as set forth in claim 24, wherein:

said discharge tray includes aligning means for aligning sheets discharged on said discharge tray, and said aligning means includes a aligner plate formed on a trailing end portion of said discharge tray and an aligning roller provided in a vicinity of the sheet discharge section, and aligns trailing edges of sheets by moving the trailing edges of discharged sheets to said aligner plate by rotating said aligning roller.

29. The sheet post-processing apparatus as set forth in claim 24, wherein:

slots are formed on the sheet receiving face of said discharge tray so that said auxiliary tray is moved along the slots so as to be freely coming in and out of the slots by said auxiliary tray drive means.

30. The sheet post-processing apparatus as set forth in claim 24, wherein:

one end of said auxiliary tray is supported by a support shaft so as to freely swing, and the other end thereof having the projected guide sections slides along a guide hole formed on a side face of said discharge tray so that said auxiliary tray can be moved from a position at which an upper surface of said auxiliary tray is on a virtual plane extended from an upper surface of said processing tray to a position at which the upper surface of said auxiliary tray is on said sheet receiving face of said discharge tray.

31. The sheet post-processing apparatus as set forth in claim 24, wherein:

one end of said auxiliary tray is supported by said discharge tray with a support shaft so as to freely swing, and the other end thereof is in contact with an eccentric cam provided in said discharge tray, and said auxiliary tray is moved from a position at which an upper surface of said auxiliary tray is on a virtual plane extended from an upper surface of said processing tray and to a position at which the upper surface of said auxiliary tray is on said sheet receiving face of said discharge tray by rotating the eccentric cam.

32. A sheet post-processing apparatus comprising:

a processing tray being inclined;

post-processing means for post-processing sheets stacked on said processing tray;

discharge tray having formed thereon a sheet receiving face, a horizontal face, an auxiliary tray and auxiliary tray drive means, said discharge tray being inclined at the same direction as said processing tray, for stacking thereon discharged sheets and being recessed from a virtual plane extended from an upper surface of said processing tray, said horizontal section being formed on a trailing edge of said sheet receiving face on a side of said processing tray, said auxiliary tray being provided so as to be freely coming in and out of said sheet receiving face and said auxiliary tray being selectively moved between a position at which an upper surface thereof is on the virtual plane and a position at which the upper surface thereof is on said sheet receiving face;

first tray upper limit detection means for detecting an upper limit position of said discharge tray where the processed section of the upper surface of the top sheet placed on said sheet receiving face is set in a vicinity of a virtual plane including said sheet receiving face;

second tray upper limit detection means for detecting an upper limit position of said discharge tray where a non-processed section of the upper surface of the top sheet placed on said sheet receiving face is set in a vicinity of a virtual plane including said sheet receiving face; and control means for controlling said auxiliary tray drive means by said auxiliary tray such that detection signals from the first and second upper limit detection means are identical.

33. The sheet post-processing apparatus as set forth in claim 32, wherein:

slots are formed on the sheet receiving face of said discharge tray so that said auxiliary tray is moved along the slots so as to be freely coming in and out of the slots by said auxiliary tray drive means.

34. The sheet post-processing apparatus as set forth in claim 32, wherein:

one end of said auxiliary tray is supported by a support shaft so as to freely swing, and the other end thereof having the projected guide sections slides along a guide hole formed on a side face of said discharge tray so that said auxiliary tray can be moved from a position at which an upper surface of said auxiliary tray is on a virtual plane extended from an upper surface of said processing tray to a position at which the upper surface of said auxiliary tray is on said sheet receiving face of said discharge tray.

35. The sheet post-processing apparatus as set forth in claim 32, wherein:

one end of said auxiliary tray is supported by said discharge tray with a support shaft so as to freely swing, and the other end thereof is in contact with an eccentric cam provided in said discharge tray, and said auxiliary tray is moved from a position at which an upper surface of said auxiliary tray is on a virtual plane extended from an upper surface of said processing tray and to a position at which the upper surface of said auxiliary tray is on said sheet receiving face of said discharge tray by rotating the eccentric cam.

* * * * *